US011409225B2

(12) United States Patent
Kawaguchi et al.

(10) Patent No.: US 11,409,225 B2
(45) Date of Patent: Aug. 9, 2022

(54) IMAGE FORMING APPARATUS WITH DRAW-OUT UNIT HAVING ELECTRICALLY CONTACTABLE CONTACT PAIRS

(71) Applicant: Canon Kabushiki Kaisha, Tokyo (JP)

(72) Inventors: Yuta Kawaguchi, Shizuoka (JP); Shinkichi Yamamoto, Shizuoka (JP); Takateru Ohkubo, Shizuoka (JP); Kazuki Takase, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/126,362

(22) Filed: Dec. 18, 2020

(65) Prior Publication Data

US 2021/0200141 A1 Jul. 1, 2021

(30) Foreign Application Priority Data

Dec. 27, 2019 (JP) ..... JP2019-239949
Dec. 27, 2019 (JP) ..... JP2019-239950
Dec. 27, 2019 (JP) ..... JP2019-239951
Dec. 27, 2019 (JP) ..... JP2019-239952

(51) Int. Cl.
*G03G 21/00* (2006.01)
*G03G 21/16* (2006.01)
(Continued)

(52) U.S. Cl.
CPC ..... *G03G 21/1633* (2013.01); *G03G 15/0863* (2013.01); *G03G 21/1652* (2013.01); *G03G 21/1867* (2013.01); *G03G 15/0808* (2013.01); *G03G 2221/163* (2013.01); *G03G 2221/166* (2013.01); *G03G 2221/1684* (2013.01); *G03G 2221/1869* (2013.01)

(58) Field of Classification Search
CPC ..... G03G 15/0863; G03G 15/80; G03G 21/1633; G03G 21/1652; G03G 21/1867; G03G 21/1875; G03G 21/1885; G03G 2221/1684; G03G 2221/166; G03G 2221/1869; G03G 2221/1823
USPC ..... 399/90, 107, 111
See application file for complete search history.

(56) References Cited

U.S. PATENT DOCUMENTS 8,737,872 B2 * 5/2014 Hiramatsu ..... G03G 15/0863 399/110
9,268,293 B2 2/2016 Nakao et al. ..... G03G 21/1633
(Continued)

FOREIGN PATENT DOCUMENTS

JP 2019-28346 A 2/2019

*Primary Examiner* — Robert B Beatty
(74) *Attorney, Agent, or Firm* — Venable LLP

(57) ABSTRACT

An image forming apparatus includes an apparatus body including a control board, a draw-out unit including a photosensitive drum configured to bear a toner image and rotate about a rotation axis, a developing unit, and a unit contact, the developing unit including a developing roller and a memory, and a door configured to face the draw-out unit at a closed position. The door includes a door contact electrically connected to the control board. The draw-out unit includes a facing surface configured to face the door positioned at the closed position, and a grip portion provided at a center portion of the facing surface in an axial direction of the rotation axis. The unit contact is provided in a region outside an end surface of the grip portion in the axial direction and below the grip portion in a vertical direction.

14 Claims, 41 Drawing Sheets

(51) Int. Cl.
*G03G 21/18* (2006.01)
*G03G 15/08* (2006.01)

(56) References Cited

U.S. PATENT DOCUMENTS

| | | | | |
|---|---|---|---|---|
| 9,690,252 | B2 | 6/2017 | Kusano et al. | G03G 21/1647 |
| 9,785,110 | B2 * | 10/2017 | Wei | G03G 21/1875 |
| 2007/0154233 | A1 * | 7/2007 | Ukai | G03G 21/1867 399/90 |
| 2013/0121719 | A1 * | 5/2013 | Park | G03G 21/1652 399/90 |
| 2014/0205314 | A1 * | 7/2014 | Chang | G03G 21/1821 399/110 |
| 2016/0124381 | A1 | 5/2016 | Nakao et al. | 399/110 |
| 2019/0041791 | A1 | 2/2019 | Kishi | |

* cited by examiner

IMAGE FORMING APPARATUS WITH DRAW-OUT UNIT HAVING ELECTRICALLY CONTACTABLE CONTACT PAIRS

BACKGROUND OF THE INVENTION

Field of the Invention

The present invention relates to an image forming apparatus that forms an image on a sheet.

Description of the Related Art

Conventionally, an image forming apparatus including a drum unit that holds four developing cartridges and a cover that covers an accommodating portion of the drum unit and is openable and closable is proposed as disclosed in Japanese Patent Laid-Open No. 2019-28346. A casing of the drum unit is provided with four electric terminals respectively capable of electrically contacting integrated circuit chips: IC chips of the respective developing cartridges, and these four electric terminals are electrically connected to a relay board via a wiring portion.

The relay board is disposed on a rear surface of a fourth frame plate disposed at a front end portion of the casing of the drum unit, and is electrically connected to an electric contact surface provided on the front surface of the fourth frame plate. The cover is provided with an electric contact, and this electric contact comes into contact with the electric contact surface when the cover is positioned at a closed position.

In recent years, an image forming apparatus including an IC chip as described above has still a room for improvement.

SUMMARY OF THE INVENTION

According to one aspect of the present invention, an image forming apparatus includes an apparatus body including a control board, a draw-out unit including a photosensitive drum, a developing unit, and a unit contact, the photosensitive drum being configured to bear a toner image and rotate about a rotation axis, the developing unit including a developing roller and a memory, the developing roller being configured to bear toner and supply the toner to the photosensitive drum, the memory being configured to store information, the unit contact being electrically connected to the memory of the developing unit, the draw-out unit being configured to be drawn out of the apparatus body from a first position in which the developing unit is used for an image formation to a second position in which the developing unit is exposed to an outside of the apparatus body, and a door supported by the apparatus body so as to be movable between a closed position where the door closes an opening portion of the apparatus body and an open position where the door opens the opening portion, the draw-out unit being configured to pass through the opening portion in a case where the draw-out unit is drawn out of the apparatus body, the door positioned at the closed position being configured to face the draw-out unit. The door includes a door contact electrically connected to the control board and configured to be in contact with and electrically connected to the unit contact in a case where the door is positioned at the closed position. The draw-out unit includes a facing surface configured to face the door positioned at the closed position, and a grip portion provided at a center portion of the facing surface in an axial direction of the rotation axis. The unit contact is provided in a region outside an end surface of the grip portion in the axial direction and below the grip portion in a vertical direction.

Further features of the present invention will become apparent from the following description of exemplary embodiments with reference to the attached drawings.

DESCRIPTION OF THE EMBODIMENTS

In the description below, embodiments of the present invention will be described in detail as examples with reference to drawings and examples. To be noted, functions, materials, shapes, relative layouts, and the like of constituent components of the present invention should not be limited to those described in the examples unless otherwise described. In addition, in the description below, functions, materials, shapes, and the like of members that have been already described once are substantially the same as those in initial descriptions unless otherwise described.

In addition, in the description below, a side of an image forming apparatus on which a front door is provided will be referred to as the front side, and a side of the image forming apparatus opposite to the front side will be referred to as a back side. Further, the left side and the right side of the image forming apparatus as viewed from the front will be respectively referred to as the left side and the right side.

In addition, a direction along a drum axis of a photosensitive drum included in a cartridge tray will be referred to as a "first direction D1". Further, a direction intersecting with the first direction D1 will be referred to as a "second direction D2". In the present embodiments, the second direction D2 is an insertion direction of a developing cartridge with respect to the cartridge tray. In addition, a direction in which the cartridge tray is inserted in the image forming apparatus will be referred to as a "third direction D3". The first direction D1 and the second direction D2 intersect with each other, preferably at a right angle. The second direction D2 and the third direction D3 intersect with each other, preferably at a right angle. The third direction D3 and the first direction D1 intersect with each other, preferably at a right angle.

First Embodiment

Overall Configuration

Figure 1:
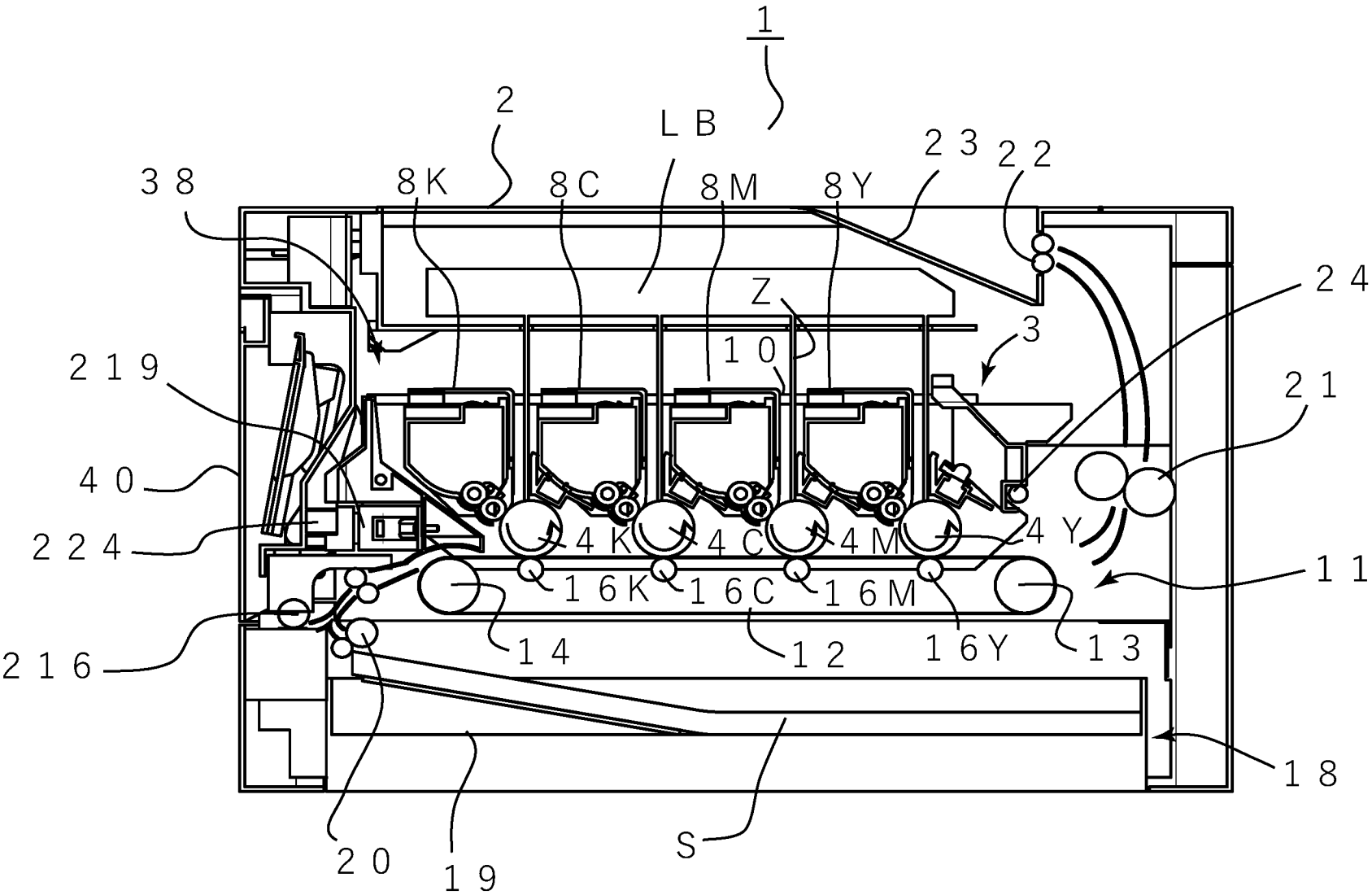
FIG. 1 is an overall schematic diagram illustrating an image forming apparatus according to a first embodiment.

First, a first embodiment of the present invention will be described. FIG. 1 is an overall schematic view of an image forming apparatus 1 according to the present embodiment. The image forming apparatus 1 is a full-color laser beam printer employing an electrophotographic image formation process, and forms an image of four colors on a sheet S.

As illustrated in FIG. 1, the image forming apparatus 1 includes an apparatus body 2, a cartridge tray 3, and four developing cartridges 8Y, 8M, 8C, and 8K. The cartridge tray 3 and the developing cartridges 8Y, 8M, 8C, and 8K are detachably attached to the apparatus body 2. The cartridge tray 3 is a tray capable of holding the four developing cartridges 8Y, 8M, 8C, and 8K. The cartridge tray 3 and the four developing cartridges 8Y, 8M, 8C, and 8K constitute a draw-out unit 38.

To be noted, in the description below, the cartridge tray 3 to which the four developing cartridges 8Y, 8M, 8C, and 8K are attached will be also simply referred to as a cartridge tray 3, and the cartridge tray 3 in this state constitutes the draw-out unit 38. The cartridge tray 3 serving as a draw-out unit can be drawn out of the apparatus body 2 from an attached position serving as a first position where the photosensitive drum is capable of forming an image to a drawn-out position serving as a second position where the developing cartridges 8Y, 8M, 8C, and 8K are exposed to the outside of the apparatus body 2. The image forming apparatus 1 forms an image on a sheet S with developer supplied from the developing cartridges 8Y, 8M, 8C, and 8K. For example, the developer is toner and the sheet S is a printing paper sheet.

In the present embodiment, the four developing cartridges 8Y, 8M, 8C, and 8K are attached to the one cartridge tray 3. The four developing cartridges 8Y, 8M, 8C, and 8K accommodate developer of colors different from one another. For example, the four developing cartridges 8Y, 8M, 8C, and 8K respectively accommodate developer of yellow, magenta, cyan, and black. To be noted, the number of the developing cartridges 8 attached to the cartridge tray 3 may be 1 to 3 or 5 or more.

Figure 4:
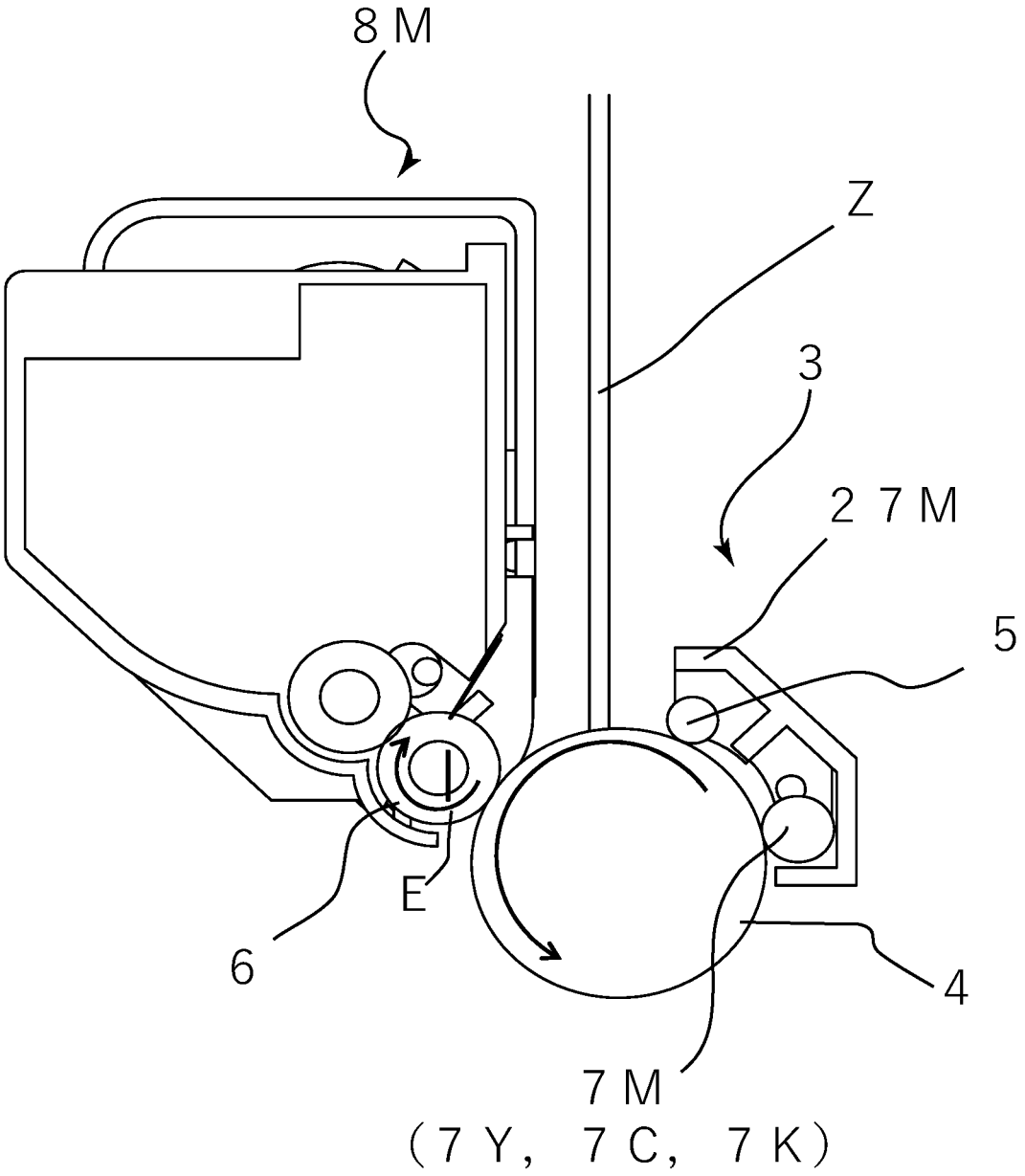
FIG. 4 is a schematic section view of the cartridge tray and a developing cartridge.

To be noted, the developing cartridges 8Y, 8M, 8C, and 8K have substantially the same configurations except for the colors of the toner images to be formed. Therefore, only the configuration of the developing cartridge 8M will be described, and description of the other developing cartridges 8Y, 8C, and 8K will be omitted. FIG. 4 is a schematic section view of the cartridge tray 3 and the developing cartridge 8M according to the present embodiment. As illustrated in FIG. 4, the cartridge tray 3 is provided with a photosensitive drum 4M in correspondence with the developing cartridge 8M. The photosensitive drum 4M bears a toner image and rotates about a rotation axis extending in the first direction D1. That is, the first direction D1 is an axial direction of the rotation axis of the photosensitive drum 4M. In addition, the cartridge tray 3 includes a charging roller 5 and a cleaning roller 7 that act on the photosensitive drum 4M. The developing cartridge 8M includes a developing roller 6 that develops an electrostatic latent image on the photosensitive drum 4.

As illustrated in FIG. 1, a laser scanner unit LB is provided above the cartridge tray 3. This laser scanner unit LB outputs laser light Z in correspondence with image information. The laser light Z exposes the surface of the photosensitive drum 4M in a scanning manner through an exposing window portion 10.

An electrostatic attraction belt unit 11 is provided below the developing cartridges 8Y, 8M, 8C, and 8K and the cartridge tray 3. This electrostatic attraction belt unit 11 includes a driving roller 13 and a tension roller 14, and an electrostatic attraction belt 12 that is flexible is stretched over the driving roller 13 and the tension roller 14. Photosensitive drums 4Y, 4M, 4C, and 4K provided in the respective developing cartridges are in contact with an upper surface of the electrostatic attraction belt 12.

In a space enclosed by the electrostatic attraction belt 12, transfer rollers 16Y, 16M, 16C, and 16K are respectively provided in positions opposing the photosensitive drums 4Y, 4M, 4C, and 4K. Toner images born on the photosensitive drums 4Y, 4M, 4C, and 4K are transferred onto the sheet S as a result of a transfer bias applied to the transfer rollers 16Y, 16M, 16C, and 16K.

A feeding unit 18 is provided below the electrostatic attraction belt unit 11. This feeding unit 18 includes a feeding tray 19 and a feeding roller 20, and feeds the sheet S. The feeding tray 19 supports and accommodates the sheet S. A fixing unit 21 that fixes an image to the sheet S is disposed on the back side of the electrostatic attraction belt unit 11, that is, on the right side in FIG. 1, and a discharge unit 22 that discharges the sheet S to the outside of the apparatus is disposed in an upper portion of the apparatus body 2.

Figure 2A:
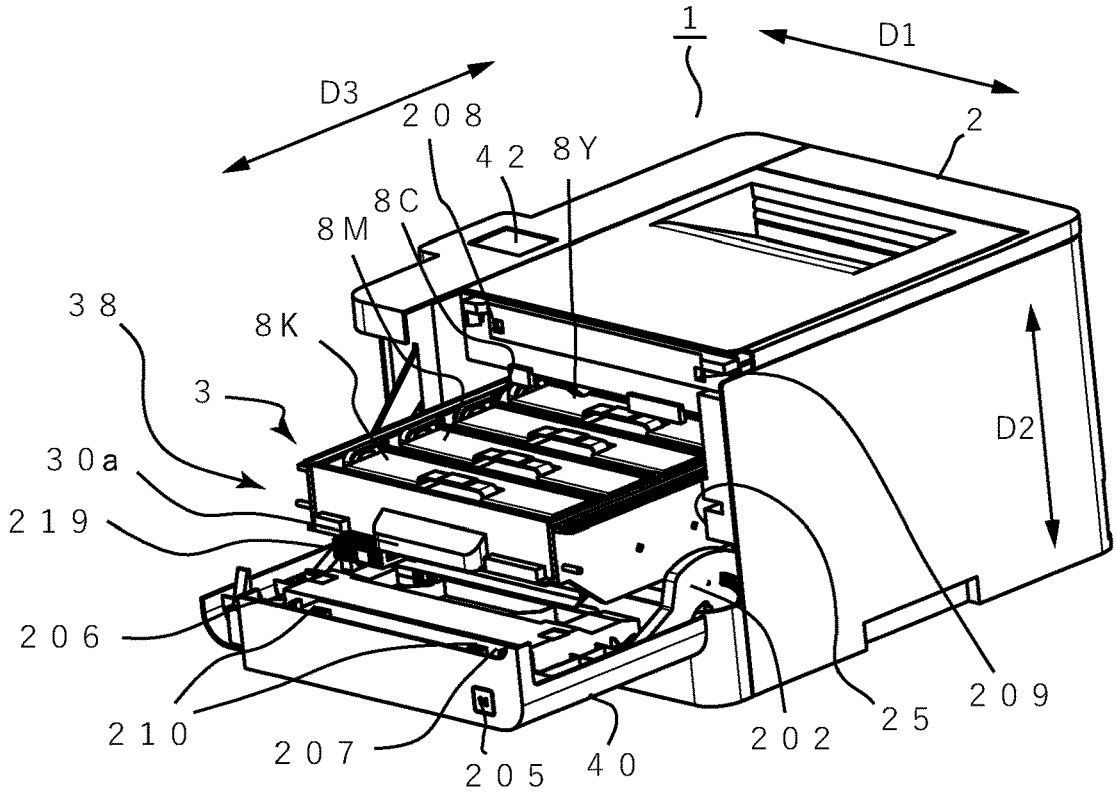
FIG. 2A is a perspective view of the image forming apparatus.
Figure 2B:
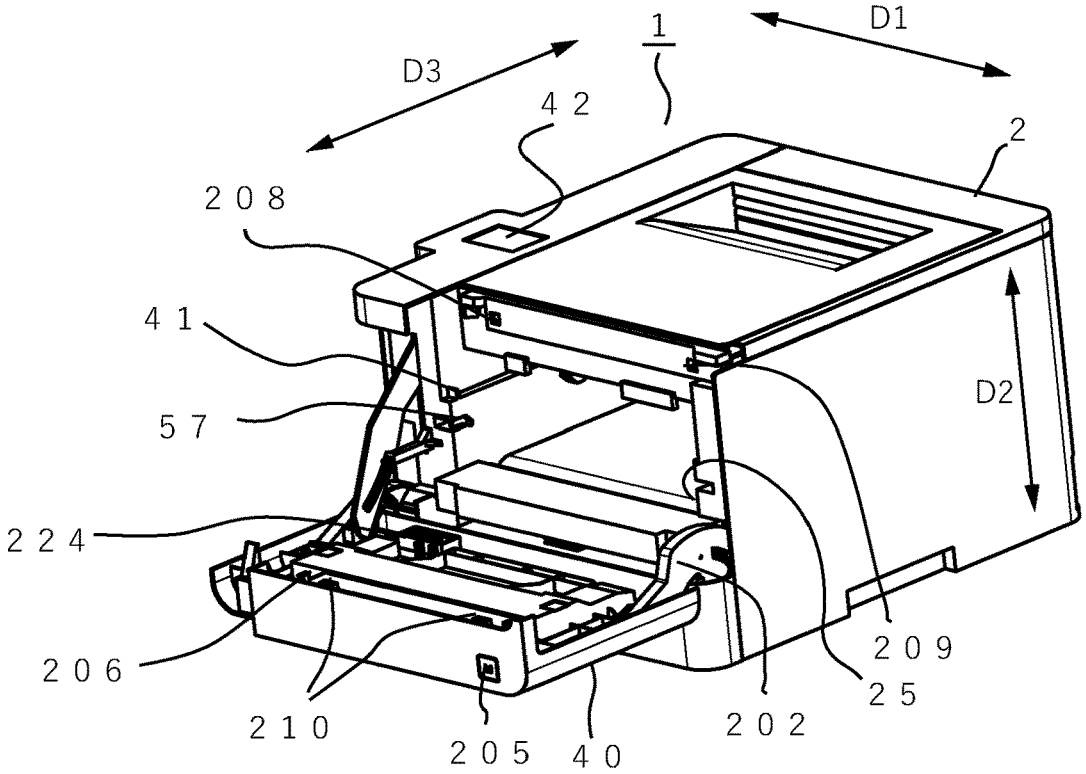
FIG. 2B is a perspective view of the image forming apparatus in a state in which a cartridge tray is detached.

FIG. 2A is a perspective view of the image forming apparatus 1 according to the present embodiment, and FIG. 2B is a perspective view of the image forming apparatus 1 in a state in which the cartridge tray 3 is detached. As illustrated in FIG. 2A, the cartridge tray 3 is disposed so as to be movable in the third direction D3 along guide rails 41 provided in the apparatus body 2 as illustrated in FIG. 2B after a front door 40 of the image forming apparatus 1 is opened. The front door 40 will be described in detail later. The developing cartridges 8Y, 8M, 8C, and 8K can be each individually replaced on the cartridge tray 3.

The apparatus body 2 includes an opening portion 25 through which the draw-out unit 38 passes when being drawn out from the apparatus body 2. The front door 40 serving as a door is supported so as to be movable between a closed position where the front door 40 closes the opening portion 25 and an open position where the front door 40 opens the opening portion 25. In other words, the door 40 makes the opening portion 25 closed at the closed position, and makes the opening portion 25 open at the open position.

Figure 3:
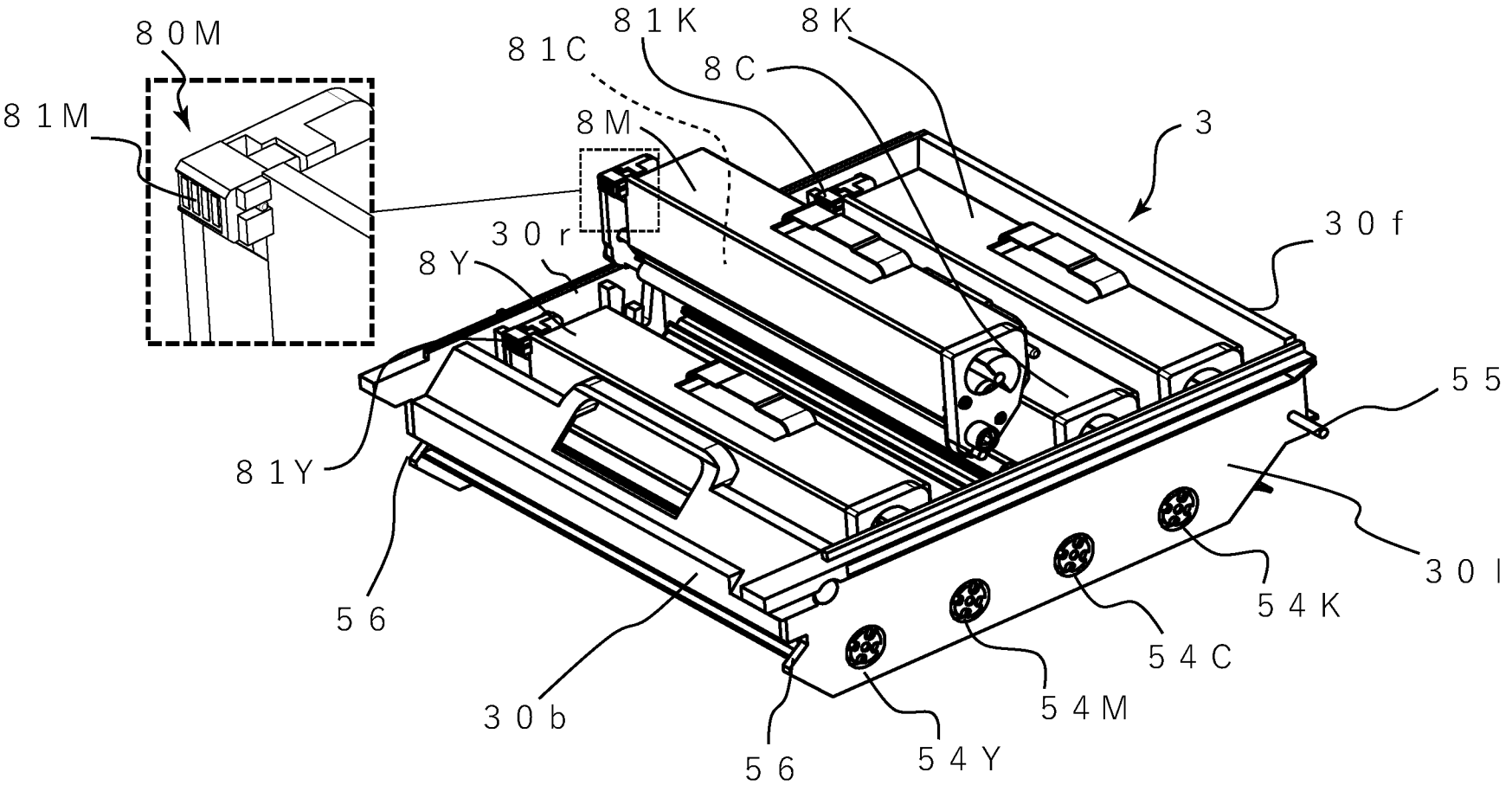
FIG. 3 is a perspective view of the cartridge tray and developing cartridges.

FIG. 3 is a perspective view of the cartridge tray 3 and the developing cartridges 8Y, 8M, 8C, and 8K according to the present embodiment. In FIG. 3, the developing cartridge 8M is detached. Attachment and detachment of the developing cartridges 8Y, 8M, 8C, and 8K are performed in four slots provided in the cartridge tray 3.

In addition, as illustrated in FIG. 3, the developing cartridge 8M serving as a developing unit includes a memory tag unit 80M to which a memory tag 81M serving as a memory is attached. For example, the memory tag 81M is a contact IC chip, and has an electric contact portion. Further, the memory tag 81M can be electrically connected to the image forming apparatus 1 by coming into contact with a tray memory contact 720M provided in the cartridge tray 3 illustrated in FIG. 6. The memory tag 81M stores information about the developing cartridge 8M.

Figure 9:
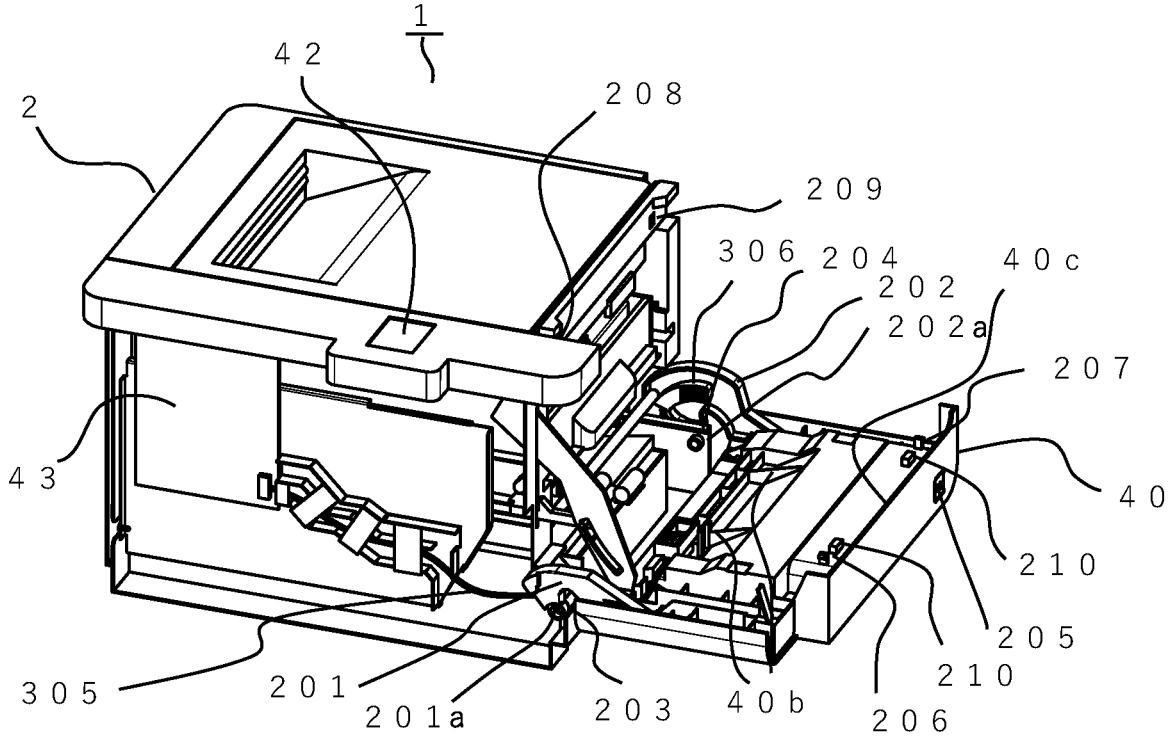
FIG. 9 is a perspective view of the image forming apparatus illustrating a configuration of the front door.

Further, the image forming apparatus 1 includes a control board 43 and a display portion 42 as illustrated in FIG. 9. The control board 43 includes a processor such as a central processing unit: CPU, and various memories, is constituted by, for example, a circuit board, and performs various processes in the image forming apparatus 1 by a processor operating in accordance with a program. In addition, the control board 43 is connected to memory tags 81Y, 81M, 81C, and 81K as will be described later, and performs information processing of the memory tags 81Y, 81M, 81C, and 81K of the developing cartridges 8Y, 8M, 8C, and 8K. As a result of this, information such as a developer remainder amount of the developing cartridges 8Y, 8M, 8C, and 8K can be shown to the user via a display portion 42 provided in the image forming apparatus 1.

Image Forming Operation

Next, an image forming operation will be described with reference to FIGS. 1 and 4. An operation for forming a full-color image is as follows. Attachment of the cartridge tray 3 and the developing cartridges 8Y, 8M, 8C, and 8K to the image forming apparatus 1 is completed in a state in which the front door 40 is closed.

When the front door 40 is closed, an unillustrated drum driving coupling provided in the image forming apparatus 1 engages with drum couplings 54Y, 54M, 54C, and 54K connected to photosensitive drums 4Y, 4M, 4C, and 4K illustrated in FIG. 3. The drum couplings 54Y, 54M, 54C, and 54K are rotationally driven via a drive output motor and a gear of the image forming apparatus 1 that are not illustrated. The photosensitive drums 4Y, 4M, 4C, and 4K are rotationally driven in an arrow direction of FIG. 1 via the drum couplings 54Y, 54M, 54C, and 54K at a predetermined speed. The electrostatic attraction belt 12 is also rotationally driven at a speed corresponding to the speed of the photosensitive drums 4Y, 4M, 4C, and 4K.

At this time, the laser scanner unit LB is also driven, and emits light. The surfaces of the photosensitive drums 4Y, 4M, 4C, and 4K are uniformly charged to a predetermined polarity and a predetermined potential by the charging rollers 5 in synchronization with the light emission from the laser scanner unit LB. The laser scanner unit LB scans and exposes the surface of the photosensitive drums 4Y, 4M, 4C, and 4K with laser light Z in accordance with image signals of respective colors. As a result of this, an electrostatic latent image corresponding to an image signal of a corresponding color is formed on the surface of each photosensitive drum.

This electrostatic latent image is developed by the developing roller 6 rotationally driven in an arrow E direction of FIG. 4 at a predetermined speed. Through this electrophotographic image formation process described above, a yellow toner image corresponding to a yellow component of a full-color image is formed on the photosensitive drum 4Y Meanwhile, a sheet S is fed by the feeding unit 18 at a predetermined control timing. When a plurality of sheets S are fed, one sheet S is separated from the sheets S and fed. Then, the sheet S is conveyed along the photosensitive drums 4Y, 4M, 4C, and 4K by the electrostatic attraction belt 12.

The sheet S reaches the photosensitive drum 4Y at a predetermined control timing, and the toner image on the photosensitive drum 4Y is transferred onto the sheet S. Similarly, toner images corresponding to magenta, cyan and black components of the full-color image are respectively formed on the photosensitive drums 4M, 4C, and 4K. Then, the magenta, cyan, and black toner images are transferred onto the sheet S so as to be superimposed on one another. In this manner, an unfixed full-color toner image of four-colors of yellow, magenta, cyan, and black is formed on the sheet S.

The toner image transferred onto the sheet S is fixed by the fixing unit 21. Then, the sheet S having passed through the fixing unit 21 is discharged onto the discharge tray 23 by the discharge unit 22.

Configuration of Cartridge Tray

Figure 5A:
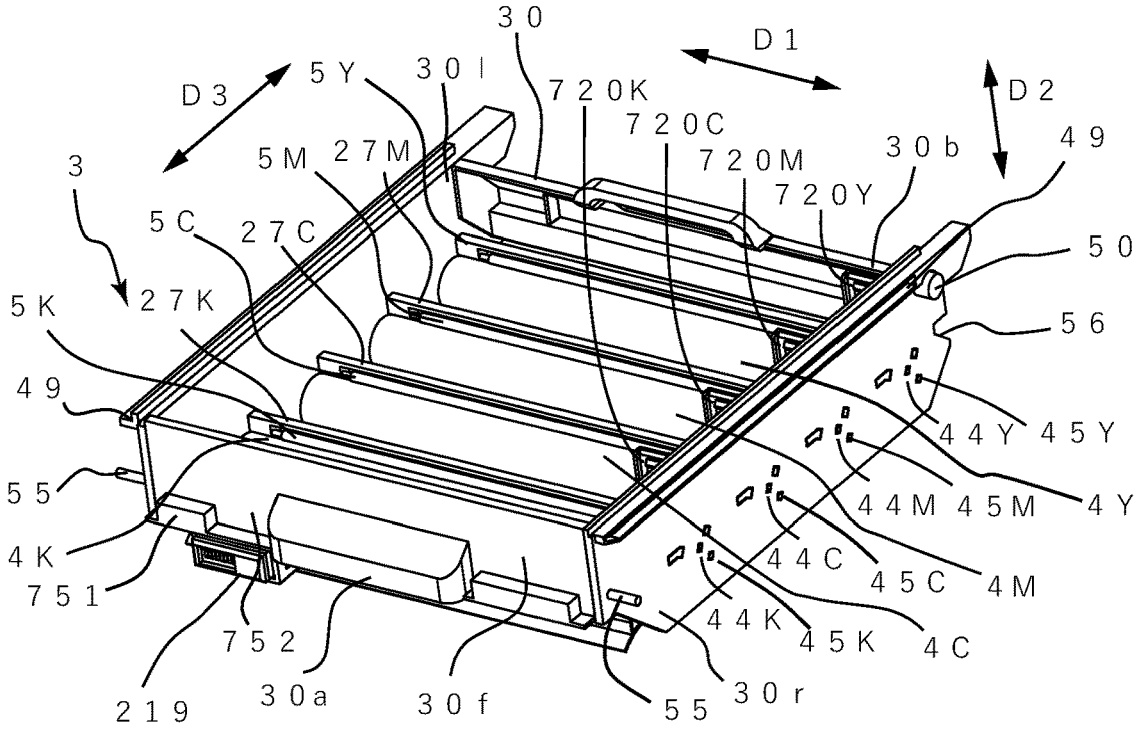
FIG. 5A is a perspective view of the cartridge tray.
Figure 5B:
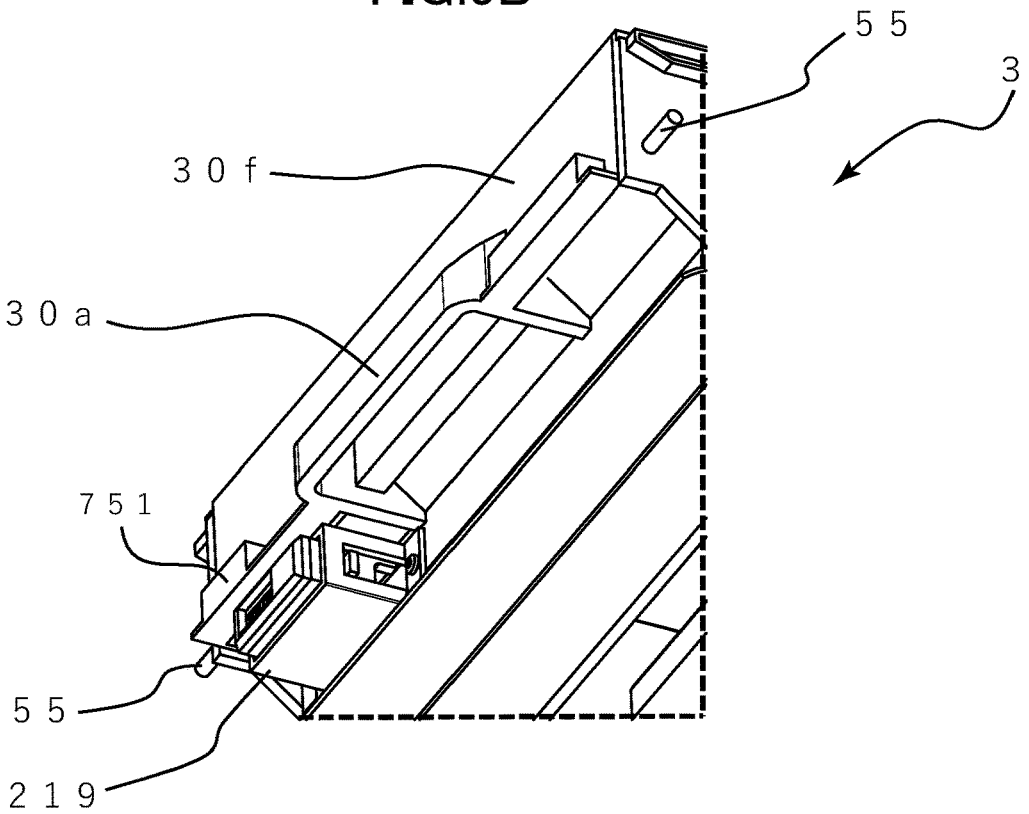
FIG. 5B is an enlarged perspective view of a front portion of the cartridge tray.

Next, the configuration of the cartridge tray 3 will be described. FIG. 5A is a perspective view of the cartridge tray 3, and FIG. 5B is an enlarged perspective view of a front portion of the cartridge tray 3. The cartridge tray 3 includes a tray frame member 30, a tray penetrating shaft 55, the photosensitive drums 4Y, 4M, 4C, and 4K, charging rollers 5Y, 5M, 5C, and 5K, and cleaning frame members 27Y, 27M, 27C, and 27K. In addition, the cartridge tray 3 includes tray charging contacts 44Y, 44M, 44C, and 44K, tray cleaner contacts 45Y, 45M, 45C, and 45K, unillustrated tray developing contacts, and so forth.

As illustrated in FIG. 5A, the tray frame member 30 is a frame member having four surfaces of a tray right side surface 30*r*, a tray left side surface 301, a tray front surface 30*f*, and a tray back surface 30*b*. The tray right side surface 30*r* is a side surface that covers the right side and is positioned at an outer position of the cartridge tray 3 in the first direction D1 with respect to the apparatus. Similarly, the tray left side surface 301 is a side surface that covers the left side and is positioned at an outer position of the cartridge tray 3 in the first direction D1 with respect to the apparatus. In addition, the tray front surface 30*f* and the tray back surface 30*b* are surfaces that interconnect the tray right side surface 30*r* and the tray left side surface 301. The tray front surface 30*f* is positioned on the front side of the cartridge tray 3, and the tray back surface 30*b* is positioned on the back side of the cartridge tray 3.

The tray penetrating shaft 55 is supported by the tray right side surface 30*r* and the tray left side surface 301, and end portions of the tray penetrating shaft 55 projects outward from the tray right side surface 30*r* and the tray left side surface 301 in the first direction D1. In addition, a tray positioning groove 56 is defined on the back side of each of the tray right side surface 30*r* and the tray left side surface 301. Here, the tray penetrating shaft 55 is supported by tray shaft engagement portions 57 of the apparatus body 2 illustrated in FIG. 2B, and the tray positioning grooves 56 are supported by a tray positioning shaft 24 of the apparatus body 2 illustrated in FIG. 1. As a result of this, the cartridge tray 3 is positioned with respect to the apparatus body 2.

As illustrated in FIG. 5A, the photosensitive drums 4Y, 4M, 4C, and 4K are supported by the tray right side surface 30*r* and the tray left side surface 301 and are rotatably attached to rotation shafts extending in the first direction D1. The charging rollers 5Y, 5M, 5C, and 5K are rotatable about rotation shafts extending in the first direction D1, and are supported by the cleaning frame members 27Y, 27M, 27C, and 27K so as to be in contact with and rotationally driven by the photosensitive drums 4Y, 4M, 4C, and 4K. The cleaning frame members 27Y, 27M, 27C, and 27K are supported by the tray right side surface 30*r* and the tray left side surface 301.

In addition, the tray charging contacts 44Y, 44M, 44C, and 44K are provided on the tray right side surface 30*r*, and are electrically connected to the charging rollers 5Y, 5M, 5C, and 5K. The tray charging contacts 44Y, 44M, 44C, and 44K are exposed on the outer side of the tray right side surface 30*r*, and come into contact with unillustrated charging contacts of the apparatus body 2, and thus the charging rollers 5 are electrically connected to the apparatus body 2. The surfaces of the photosensitive drums 4Y, 4M, 4C, and 4K are uniformly charged to a predetermined polarity and a predetermined potential by the charging rollers 5. Here, although the charging rollers 5 are used as charging portions in the present embodiment, the configuration is not limited to this, and different components such as corona chargers may be used.

As illustrated in FIGS. 4 and 5A, the cleaning frame members 27Y, 27M, 27C, and 27K are provided with cleaning rollers 7Y, 7M, 7C, and 7K that are rotatable about rotation shafts extending in the first direction D1. The tray cleaner contacts 45Y, 45M, 45C, and 45K are provided on the tray right side surface 30*r*, and are electrically connected to the cleaning rollers 7Y, 7M, 7C, and 7K, respectively. The tray cleaner contacts 45Y, 45M, 45C, and 45K are exposed on the outer side of the tray right side surface 30*r*, and come into contact with unillustrated cleaner contacts of the apparatus body 2, and thus the cleaning rollers 7Y, 7M, 7C, and 7K are electrically connected to the apparatus body 2.

As a result of this, the cleaning rollers 7Y, 7M, 7C, and 7K effectively remove waste developer on the surface of the photosensitive drums 4Y, 4M, 4C, and 4K that has been not transferred during image formation and has remained Here, although the cleaning rollers 7 are used as cleaning portions in the present embodiment, the cleaning portions do not have to be provided, and different components such as rubber blades or sheets may be used.

As illustrated in FIGS. 5A and 5B, a tray operation portion 30*a*, and a pressed portion 751 that can be pressed by a projection portion 40*a* of the front door 40 that will be described later are provided on the tray front surface 30*f*. To be noted, the pressed portion 751 may be configured not to be pressed by the projection portion 40*a*. The tray front surface 30*f* serving as a facing surface faces the front door 40 positioned at a closed position. The tray operation portion 30*a* and the pressed portion 751 project to the front with respect to the tray front surface 30*f*.

The tray operation portion 30*a* serving as a grip portion is disposed in a center portion of the tray front surface 30*f* in the first direction D1, and has a concave shape facing downward such that a user can grip the tray operation portion 30*a* from below. The pressed portion 751 is disposed at a left end portion of the tray front surface 30*f* in the first direction D1. A recess portion 752 is provided between the tray operation portion 30*a* and the pressed portion 751 in the first direction D1.

Figure 6:
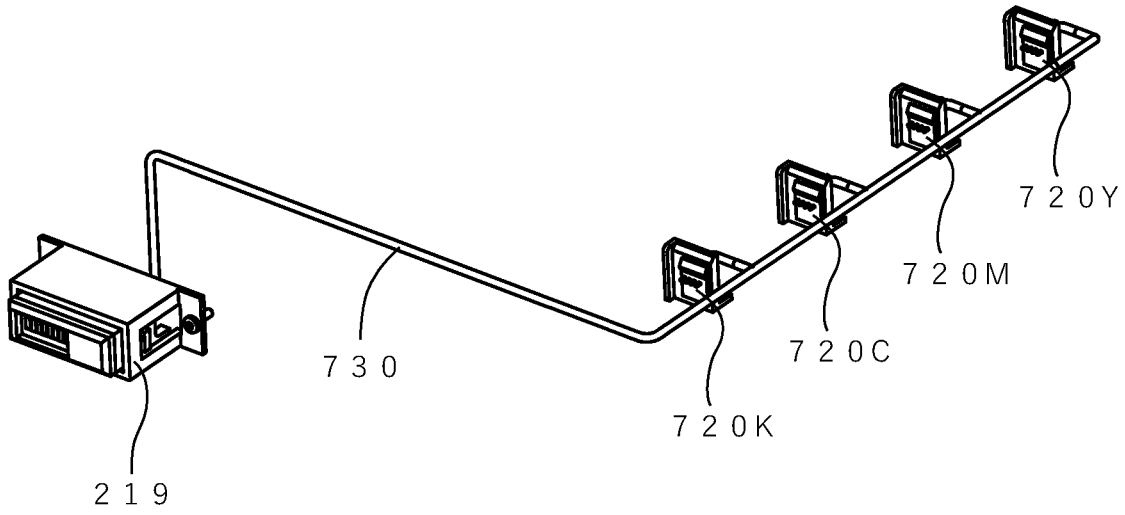
FIG. 6 is a perspective view of a tray contact unit and tray memory contacts corresponding to respective developing cartridges.

FIG. 6 is a perspective view of a tray contact unit 219 and tray memory contacts 720Y, 720M, 720C, 720K corresponding to the respective developing cartridges. As illustrated in FIGS. 5A and 6, a tray contact unit 219 is attached to the tray front surface 30*f*. The tray memory contacts 720Y, 720M, 720C, and 720K are respectively attached to end portions of the cleaning frame members 27Y, 27M, 27C, and 27K on the tray right side surface 30*r* side.

The tray memory contacts 720Y, 720M, 720C, and 720K are respectively disposed at positions at which the tray memory contacts 720Y, 720M, 720C, and 720K can be connected to electric contact portions of the memory tags 81Y, 81M, 81C, and 81K of the developing cartridges 8Y, 8M, 8C, and 8K illustrated in FIG. 3. The tray memory contacts 720Y, 720M, 720C, and 720K are electrically connected to the tray contact unit 219 serving as a unit contact via a wiring portion 730 and an unillustrated relay board.

Insertion and Removal of Cartridge Tray

Figure 7A:
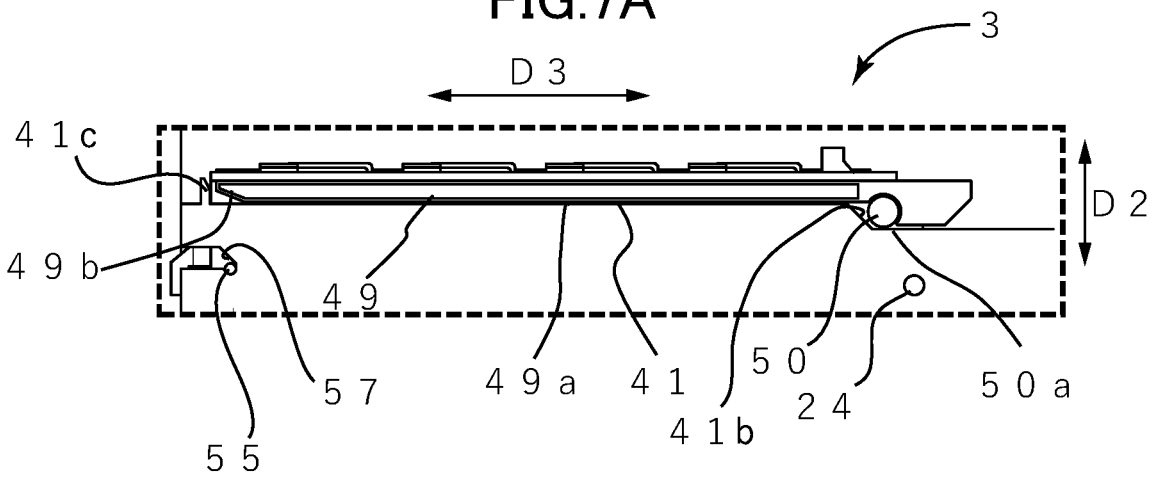
FIG. 7A is a side view of the cartridge tray in an attached state.
Figure 7B:
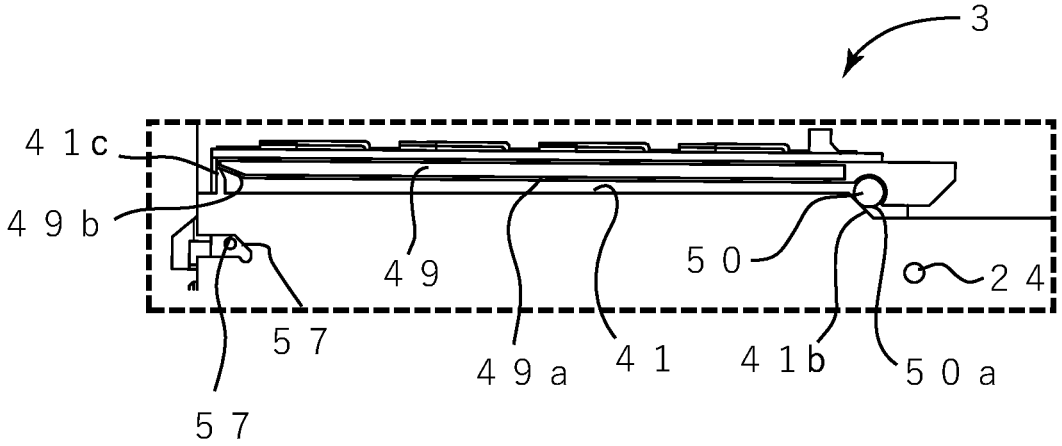
FIG. 7B is a side view of the cartridge tray drawn out from an attached position.
Figure 7C:
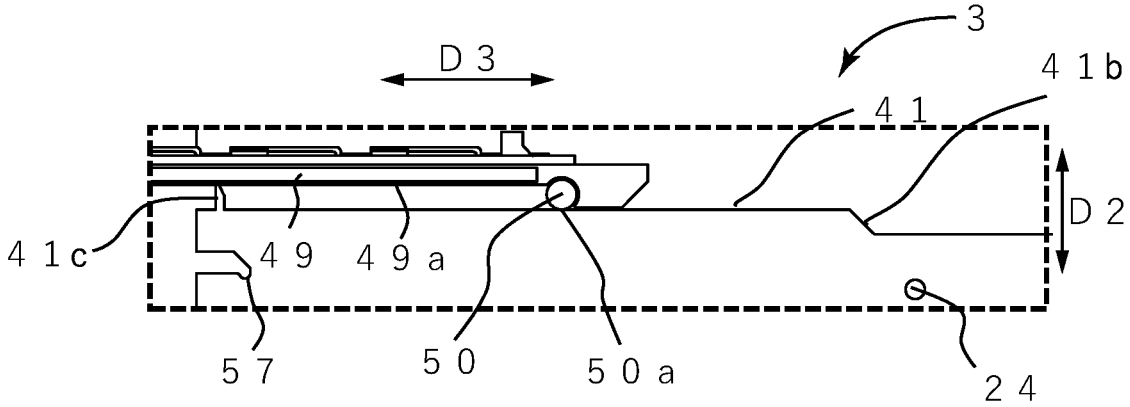
FIG. 7C is a side view of the cartridge tray drawn out further.

Next, a draw-out operation of the cartridge tray 3 from the apparatus body 2 will be described with reference to FIGS. 2A, 2B, 5A, 7A, 7B, and 7C. FIGS. 7A to 7C are diagrams illustrating a behavior of the cartridge tray 3 being drawn out from the apparatus body 2, and illustrate transition of the state of the cartridge tray 3 and the apparatus body 2 as viewed from the right side of the image forming apparatus 1.

As illustrated in FIG. 5, a tray guide 49 projecting outward in the first direction D1 is formed on each of the tray right side surface 30*r* and the tray left side surface 301. In addition, a guide roller 50 supported so as to be rotatable with respect to the tray frame member 30 is provided on the back surface side of each tray guide 49 in the image forming apparatus 1.

Here, as illustrated in FIG. 7A, a lowermost portion 50*a* of the guide roller 50 is positioned below the tray guide 49. In addition, a tray guide inclined surface 49*b* is formed at an end portion of the tray guide 49 on the front side of the image forming apparatus 1. Here, the tray guide inclined surface 49*b* is inclined such that a part thereof closer to the front end of the tray guide 49 is higher.

In addition, as illustrated in FIG. 2B, a guide rail 41 is provided on each side surface of a part of the apparatus body 2 that accommodates the cartridge tray 3. Further, as illustrated in FIG. 7A, a rail inclined surface 41*b* inclined such that a part thereof closer to the back end thereof is lower is provided on the back side of the guide rail 41 in the image forming apparatus 1. In addition, a tray stopper 41*c* projecting upward from the lower surface of the guide rail 41 is formed at an end portion of the guide rail 41 on the front side of the image forming apparatus 1.

Here, as illustrated in FIG. 7A, a position of the cartridge tray 3 attached to the apparatus body 2 will be referred to as a first position. When the cartridge tray 3 is positioned at the first position, the guide rollers 50 and the tray guide inclined surfaces 49*b* are respectively positioned upstream of the rail inclined surfaces 41*b* and the tray stoppers 41*c* in the draw-out direction of the cartridge tray 3. When replacing the developing cartridges 8Y, 8M, 8C, and 8K, the user opens the front door 40 of the image forming apparatus 1, and draws out the cartridge tray 3 to the front from the first position with respect to the apparatus body 2.

At this time, as illustrated in FIG. 7B, the tray guide inclined surfaces 49*b* come into contact with the tray stoppers 41*c*, and the guide rollers 50 come into contact with the rail inclined surfaces 41*b*. Then, the cartridge tray 3 moves upward in the second direction D2 with respect to the apparatus body 2 as the cartridge tray 3 is drawn out to the front side of the image forming apparatus 1.

As a result of this, the photosensitive drums 4Y, 4M, 4C, and 4K are separated from the electrostatic attraction belt 12, and thus the cartridge tray 3 can be drawn out without damaging the surfaces of the photosensitive drums 4Y, 4M, 4C, and 4K. Here, as illustrated in FIG. 7C, a position where the cartridge tray 3 has been completely moved upward in the second direction D2 by being drawn out from the first position to the front side of the apparatus body 2 will be referred to as a second position.

When the cartridge tray 3 is positioned at the second position or further on the front side, the tray guide lower surfaces 49*a* are in contact with the tray stoppers 41*c*, and the guide rollers 50 are in contact with the guide rails 41. As a result of this, the cartridge tray 3 is drawn out to the front side of the apparatus body 2 in the third direction D3 while the position of the cartridge tray 3 in the second direction D2 is maintained. After the cartridge tray 3 has been drawn out, the upper side of the developing cartridges 8Y, 8M, 8C, and 8K to which the developing cartridges 8Y, 8M, 8C, and 8K are detached is open, and therefore the developing cartridges 8Y, 8M, 8C, and 8K can be easily replaced.

In addition, in the case of inserting the cartridge tray 3 in the apparatus body 2 after drawing out the cartridge tray 3, the cartridge tray 3 moves to the first position via the second position in an order reversed from the case of drawing out the cartridge tray 3. Also in this case, since the photosensitive drums 4 and the electrostatic attraction belt 12 are separated until the cartridge tray 3 reaches the first position, the insertion of the cartridge tray 3 can be completed without damaging the surfaces of the photosensitive drums 4.

Opening/Closing Front Door

Figure 8A:
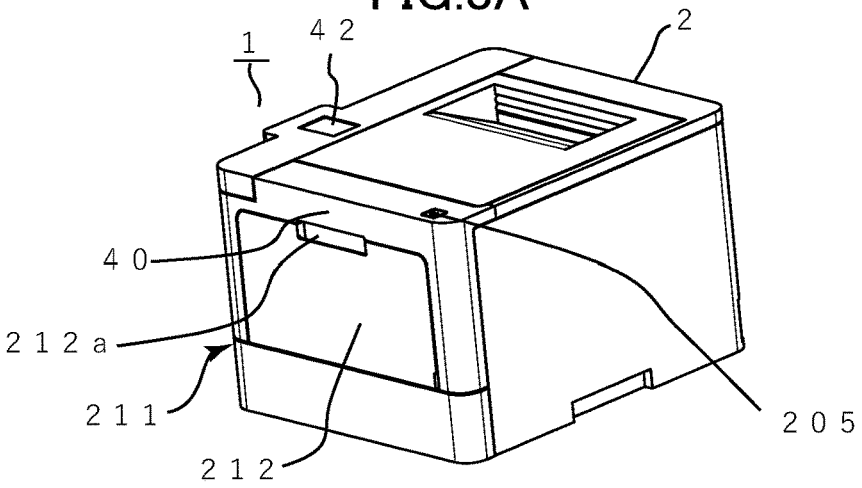
FIG. 8A is a perspective view of a front door positioned at a closed position and an apparatus body.
Figure 8B:
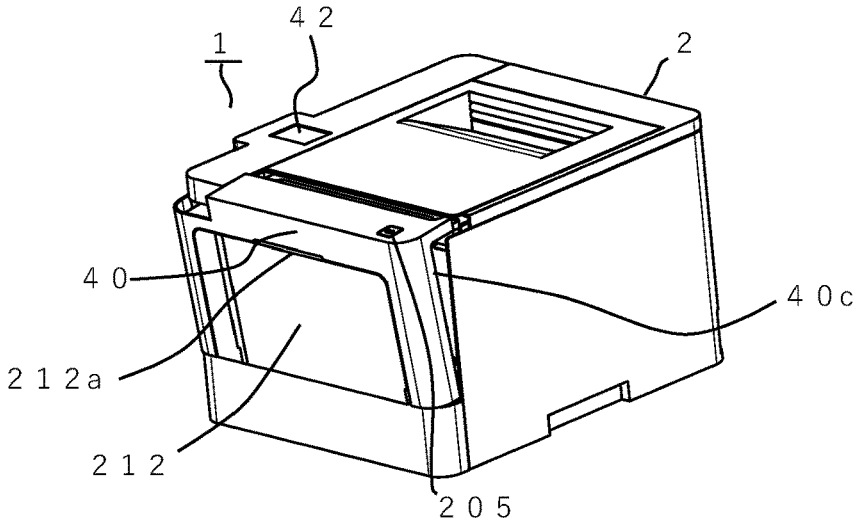
FIG. 8B is a perspective view of the apparatus body in a state in which the front door is slightly opened.
Figure 8C:
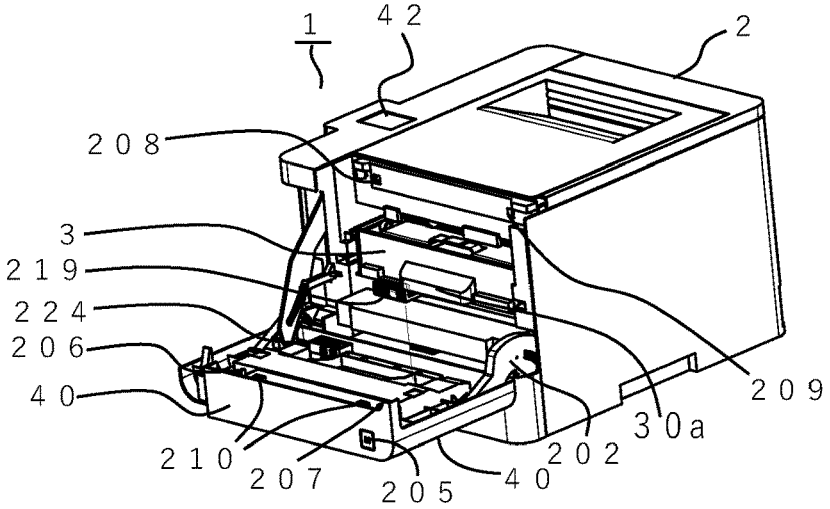
FIG. 8C is a perspective view of the front door positioned in an open position and the apparatus body.

Next, an opening/closing operation of the front door 40 will be described with reference to FIGS. 8A to 9. FIGS. 8A to 8C are each a perspective view of the image forming apparatus 1 illustrating a stage of the opening/closing operation of the front door 40. FIG. 9 is a perspective view of the image forming apparatus 1 illustrating a configuration of the front door 40.

As illustrated in FIG. 9, a left hinge 201 and a right hinge 202 are attached to the front door 40. The left hinge 201 and the right hinge 202 are disposed at different positions in the first direction D1. The left hinge 201 is provided with a left hinge rotation shaft 201*a*, and the right hinge 202 is provided with a right hinge rotation shaft 202*a*. The apparatus body 2 includes a left hinge supporting portion 203 and a right hinge supporting portion 204, which are respectively engaged with the left hinge rotation shaft 201*a* and the right hinge rotation shaft 202*a*. Further, the front door 40 is held so as to be rotatable about the left hinge rotation shaft 201*a* and the right hinge rotation shaft 202*a* with respect to the apparatus body 2.

In addition, the front door 40 is provided with an opening/closing button 205, a left locking member 206, and a right locking member 207, and the apparatus body 2 is provided with a left locking member holding portion 208 and a right locking member holding portion 209. When the front door 40 is closed, the left locking member 206 engages with the left locking member holding portion 208, and the right locking member 207 engages with the right locking member holding portion 209. As a result of the engagement between these members, the front door 40 is held in a position where the front door 40 is closed with respect to the apparatus body 2. Further, the front door 40 is provided with a front door urging member 210. When the front door 40 is closed, the front door urging member 210 applies an urging force to the front door 40 and the apparatus body 2. This urging force urges the front door 40 in such a direction as to open with respect to the apparatus body 2.

When a user opens the front door 40, the user first presses the opening/closing button 205. When the opening/closing button 205 is pressed, the left locking member 206 and the right locking member 207 are moved by an unillustrated link mechanism, and the engagement between the left locking member 206 and the left locking member holding portion 208 and the engagement between the right locking member 207 and the right locking member holding portion 209 are released. When the engagement between the left locking member 206 and the left locking member holding portion 208 and the engagement between the right locking member 207 and the right locking member holding portion 209 are released, the front door 40 is rotated from the position of FIG. 8A to the position of FIG. 8B about the left hinge rotation shaft 201*a* and the right hinge rotation shaft 202*a* by the urging force of the front door urging member 210.

As a result of the front door 40 moving to this position, it becomes possible for the user to grab an edge portion 40*c* of the front door 40. By operating the edge portion 40*c*, the user can open the front door 40 to a position where the front door 40 has been rotated by about 90° with respect to the closed state as illustrated in FIG. 8C. Here, the right hinge 202 is provided with a tension spring 306 illustrated in FIG. 9. This tension spring 306 relieves the impact of the user opening the front door 40.

The left hinge 201 and the right hinge 202 are respectively provided with a left hinge stopper portion and a right hinge stopper portion that are not illustrated. When the front door 40 rotates to the position of FIG. 8C, the left hinge stopper portion and the right hinge stopper portion respectively abut unillustrated stoppers provided in the apparatus body 2, thus the position of the front door 40 is restricted to this position and the front door 40 does not open further. In addition, in the case of closing the front door 40, the left locking member 206 and the right locking member 207 rotate in an order reversed from the case of opening the front door 40 and respectively engage with the left locking member holding portion 208 and the right locking member holding portion 209, and thus the front door 40 is closed.

Configuration of Multi-Tray Unit

Figure 10A:
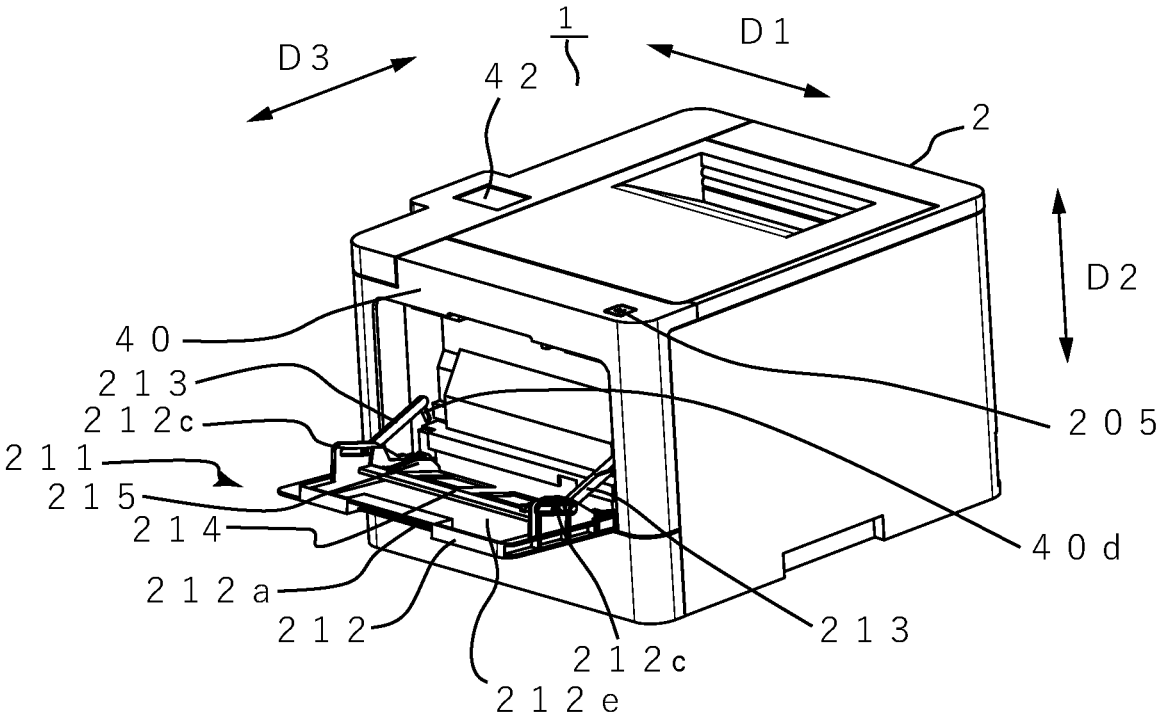
FIG. 10A is a perspective view of a multi-tray unit during use.

Next, a configuration of a multi-tray unit 211 will be described with reference to FIGS. 8A, 10A, and 10B. FIG. 10A is a perspective view of the multi-tray unit 211 during use, and FIG. 10B is an enlarged perspective view of the multi-tray unit 211.

Figure 10B:
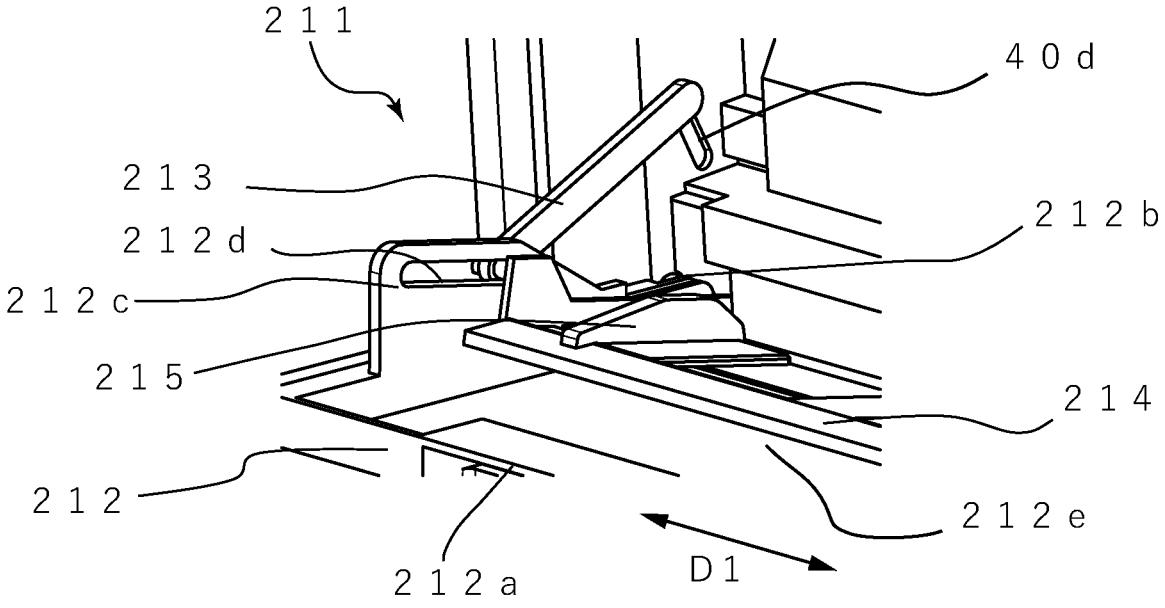
FIG. 10B is an enlarged perspective view of the multi-tray unit.

As illustrated in FIGS. 10A and 10B, the multi-tray unit 211 serving as a stacking portion includes a multi-tray frame member 212, a pair of multi-tray stoppers 213, and a multi-tray 214. The multi-tray unit 211 is configured to be opened and closes with respect to the front door 40. When the multi-tray unit 211 is open, sheets are supported on the multi-tray 214 and a stacking surface 212*e* provided on an upper surface of the multi-tray frame member 212. The multi-tray frame member 212 is provided with a multi-tray frame member grip 212*a* that the user can grip. When the user uses the multi-tray unit 211, the user holds the multi-tray frame member grip 212*a* and rotates the multi-tray unit 211 in an opening direction about a rotation shaft 212*b*.

Here, front door rails 40*d* having elongated hole shapes are defined in the front door 40, and multi-tray frame member rails 212*c* projecting in the thickness direction of the sheets supported on the multi-tray 214 are formed in the multi-tray frame member 212. The multi-tray frame member rails 212*c* serving as engagement portions project from the stacking surface 212*e* toward the apparatus body 2. An elongated hole portion 212*d* is defined in each of the multi-tray frame member rails 212*c*.

The multi-tray stoppers 213 serving as holding portions are slidably held by the front door rails 40*d* and the elongated hole portions 212*d* of the multi-tray frame member rails 212*c*. That is, the elongated hole portions 212*d* slidably engage with the multi-tray stoppers 213. When the multi-tray unit 211 rotates to the position illustrated in FIG. 10A, the multi-tray stoppers 213 abut end portions of the front door rails 40*d* and the elongated hole portions 212*d* of the multi-tray frame member rails 212*c*.

At this time, rotational force derived from the weight of the multi-tray unit 211 acts in a direction to open the multi-tray unit 211, the multi-tray stoppers 213 act to counter the rotational force of the multi-tray unit 211, and thus the position of the multi-tray unit 211 is maintained. Further, the user can use the multi-tray unit 211 in a state in which the multi-tray unit 211 is held at the position illustrated in FIG. 10A.

The multi-tray frame member 212 movably supports a width regulation plate 215 in the first direction D1. Sheets are loaded on the stacking surface 212*e* of the multi-tray frame member 212 and the multi-tray 214 by the user, and the position of the sheets in the first direction D1 is regulated by the width regulation plate 215. Further, in image formation, a sheet supported on the multi-tray 214 is fed by the feeding roller 216 illustrated in FIG. 1.

Configuration of Tray Contact Unit

Figure 11:
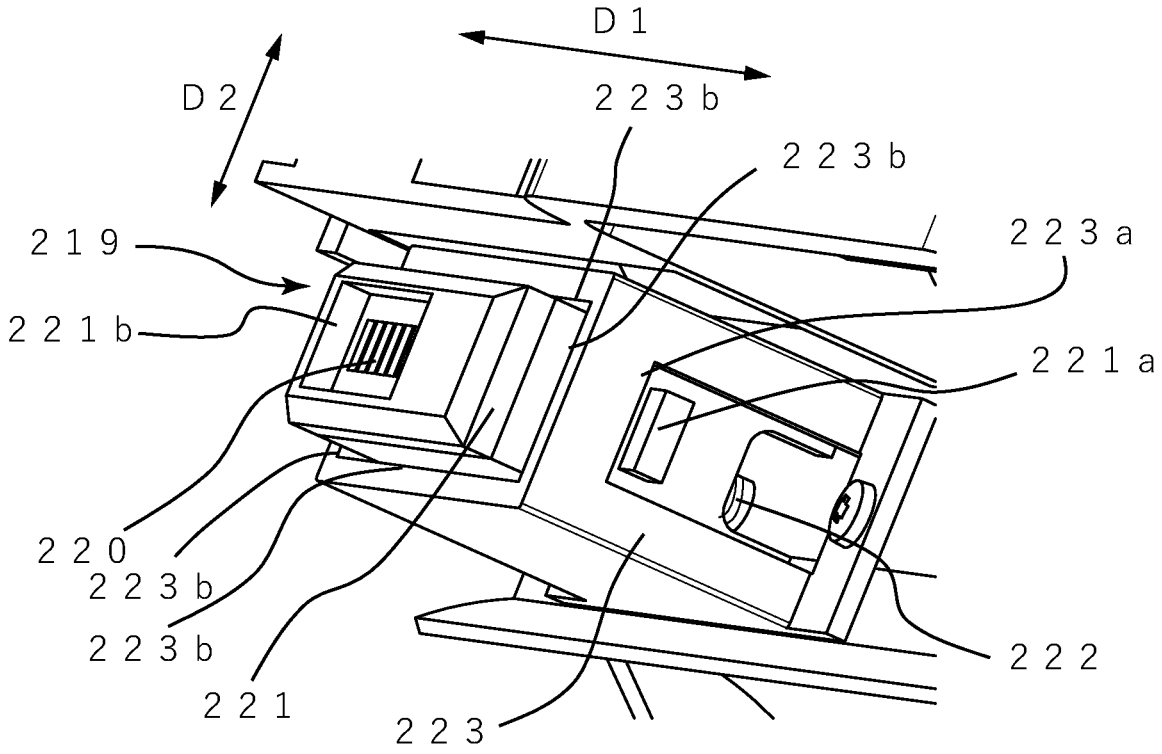
FIG. 11 is an enlarged perspective view of a tray contact unit.

Next, the tray contact unit 219 will be described with reference to FIGS. 5A, 6, and 11. FIG. 11 is an enlarged perspective view of the tray contact unit 219. As described above, when the developing cartridges 8Y, 8M, 8C, and 8K are attached to the cartridge tray 3, the electric contact portions of the developing cartridges 8Y, 8M, 8C, and 8K are connected to the tray memory contacts 720Y, 720M, 720C, and 720K.

The tray memory contacts 720Y, 720M, 720C, and 720K are connected to an unillustrated relay board provided on the tray front surface 30*f* via the wiring portion 730 as illustrated in FIG. 6. The relay board is provided with an unillustrated drum memory tag that is a memory storing information about each photosensitive drum.

As illustrated in FIG. 5A, the tray contact unit 219 is provided on the tray front surface 30*f* of the cartridge tray 3. As illustrated in FIG. 11, the tray contact unit 219 is constituted by a tray contact board 220, a contact board holding member 221, a contact board pressing spring 222, and a tray contact frame member 223. The tray contact board 220 is electrically connected to the relay board described above via an unillustrated wiring portion.

The tray contact board 220 is fixed to the contact board holding member 221 by arbitrary means such as an adhesive, a double-sided tape, or thermal caulking. The contact board pressing spring 222 is a compression spring, abuts each of the contact board holding member 221 and the cartridge tray 3, and is compressed from a natural state thereof. The spring force of the contact board pressing spring 222 holds a holding member regulation portion 221*a* of the contact board holding member 221 and a tray contact frame member regulation portion 223*a* of the tray contact frame member 223 in a state of being in contact with each other. The tray contact frame member 223 is fixed to the cartridge tray 3.

The tray contact frame member 223 is provided with a float holding portion 223*b*. The float holding portion 223*b* is provided in a rectangular shape so as to surround the contact board holding member 221. The float holding portion 223*b* and the contact board holding member 221 are provided with a clearance therebetween, and thus the contact board holding member 221 is held by the tray contact frame member 223 so as to be movable in the first direction D1 and the second direction D2 by a certain amount.

Peripheral Configuration of Door Contact Unit

Figure 12:
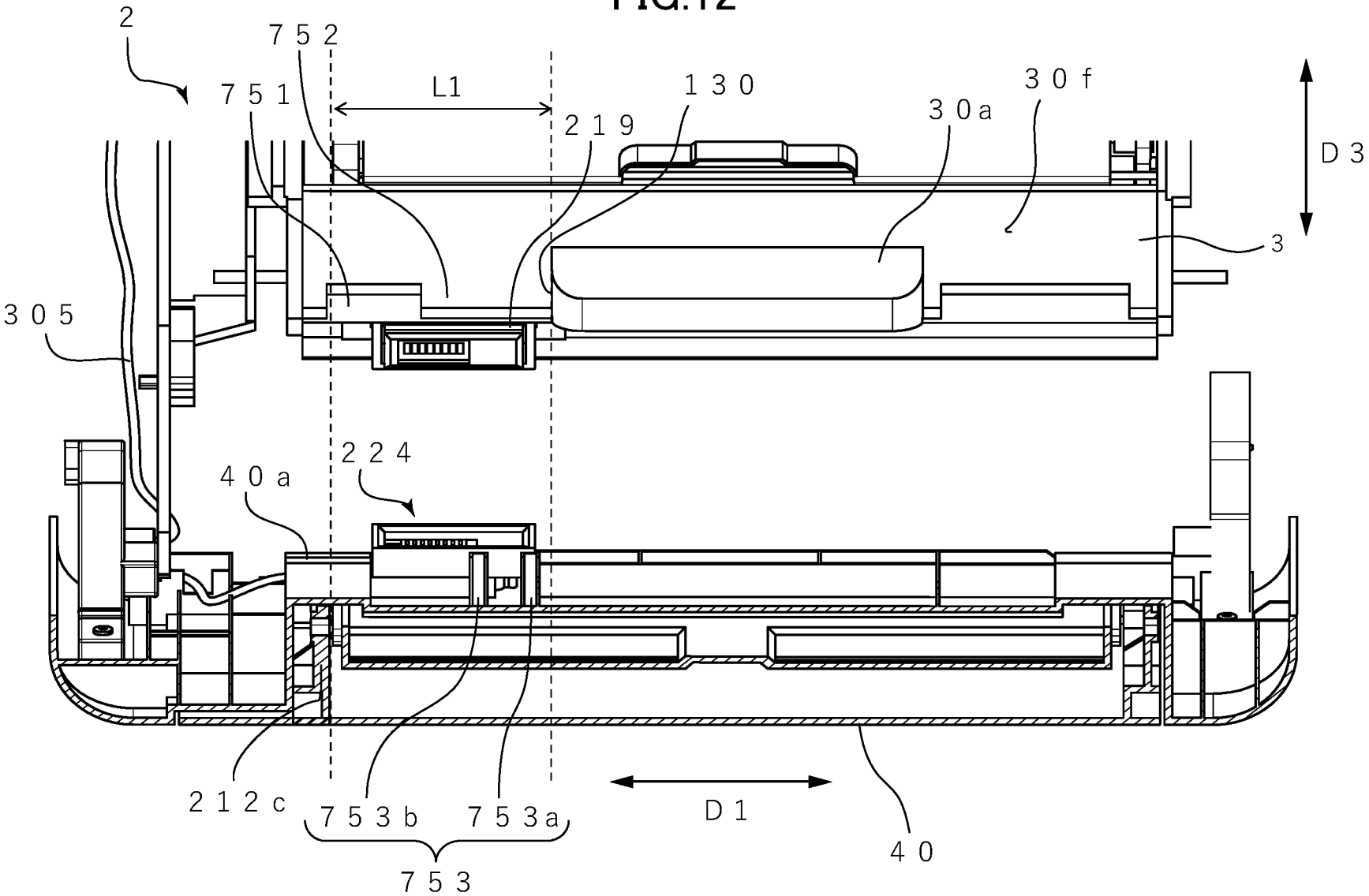
FIG. 12 is a perspective view of a door contact unit and the tray contact unit.
Figure 13:
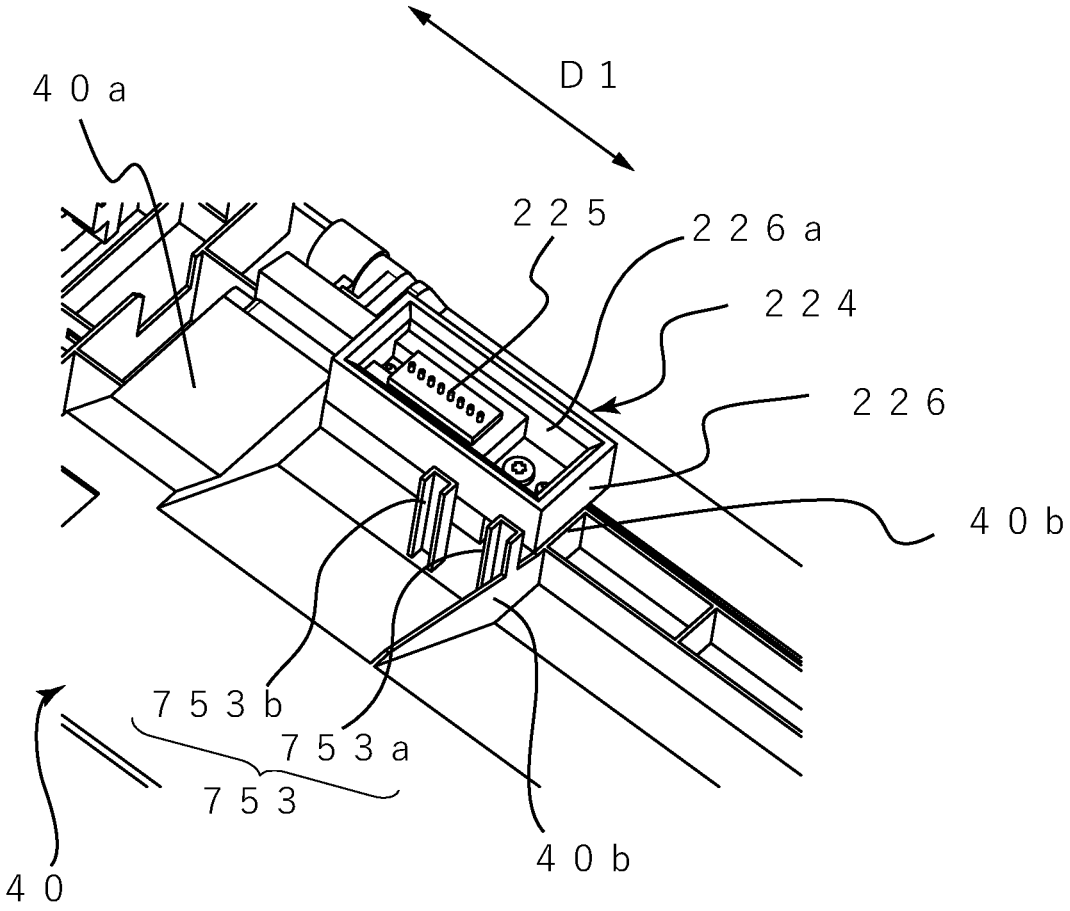
FIG. 13 is a perspective view of the door contact unit and the surroundings thereof.
Figure 14:
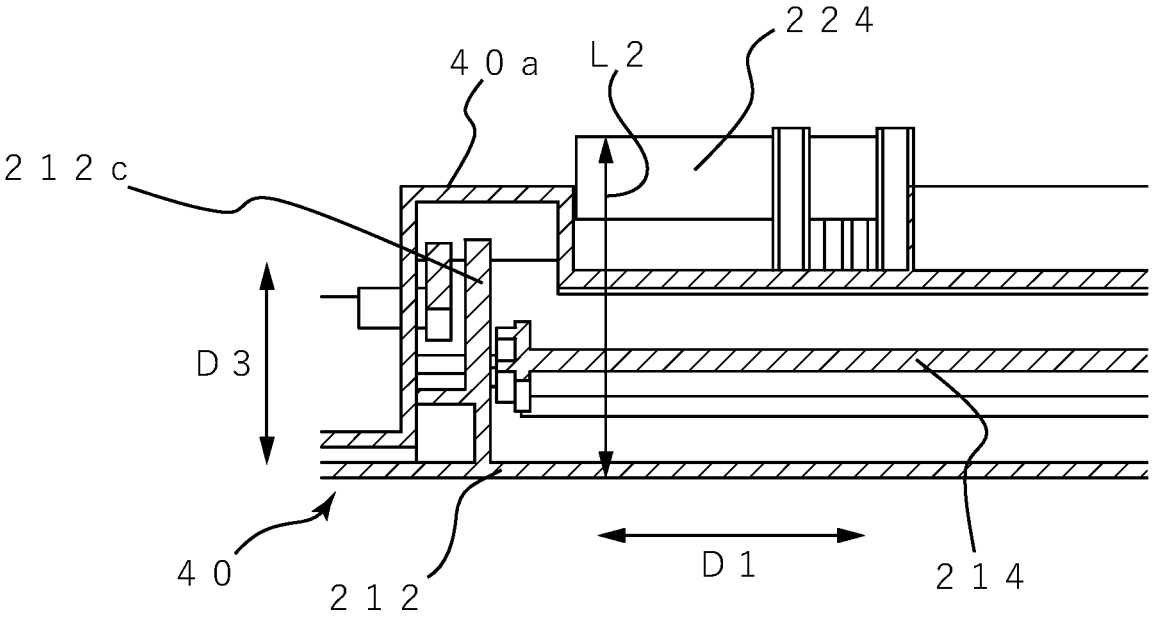
FIG. 14 is a section view of a multi-tray frame member and a multi-tray frame rail.

Next, a peripheral configuration of the door contact unit 224 provided in the front door 40 will be described with reference to FIGS. 12 to 14. FIG. 12 is a perspective view of the door contact unit 224 and the tray contact unit 219. FIG. 13 is a perspective view of the door contact unit 224 and the surroundings thereof. FIG. 14 is a section view of the multi-tray frame member 212 and the multi-tray frame member rails 212*c*.

As illustrated in FIGS. 12 to 14, the door contact unit 224 serving as a door contact is disposed so as to come into contact with and be electrically connected to the tray contact unit 219 provided in the cartridge tray 3 when the front door 40 is closed. The door contact unit 224 includes a door contact holder 226 fixed to the front door 40 and a door contact member 225 held by the door contact holder 226.

The door contact holder 226 is formed in a box shape a side of which opposing the apparatus body 2 is opened, and the door contact member 225 is accommodated in the door contact holder 226. An edge portion of the door contact holder 226 constitutes a contact positioning portion 226*a* formed in a shape tapered toward the door contact member 225, and the contact positioning portion 226*a* positions the tray contact unit 219 when the front door 40 is closed. The door contact member 225 has a metal contact portion and is connected to a tag body bundle wire 305 serving as a bundle wire.

In addition, the front door 40 includes a projection portion 40*a* disposed on the left side of the door contact unit 224 in the first direction D1 and projecting toward the cartridge tray 3 attached to the apparatus body 2. As illustrated in FIG. 14, the projection portion 40*a* accommodates a multi-tray frame member rail 212*c*, and is formed to project toward the cartridge tray 3 so as not to interfere with the multi-tray frame member rail 212*c*.

Figure 15:
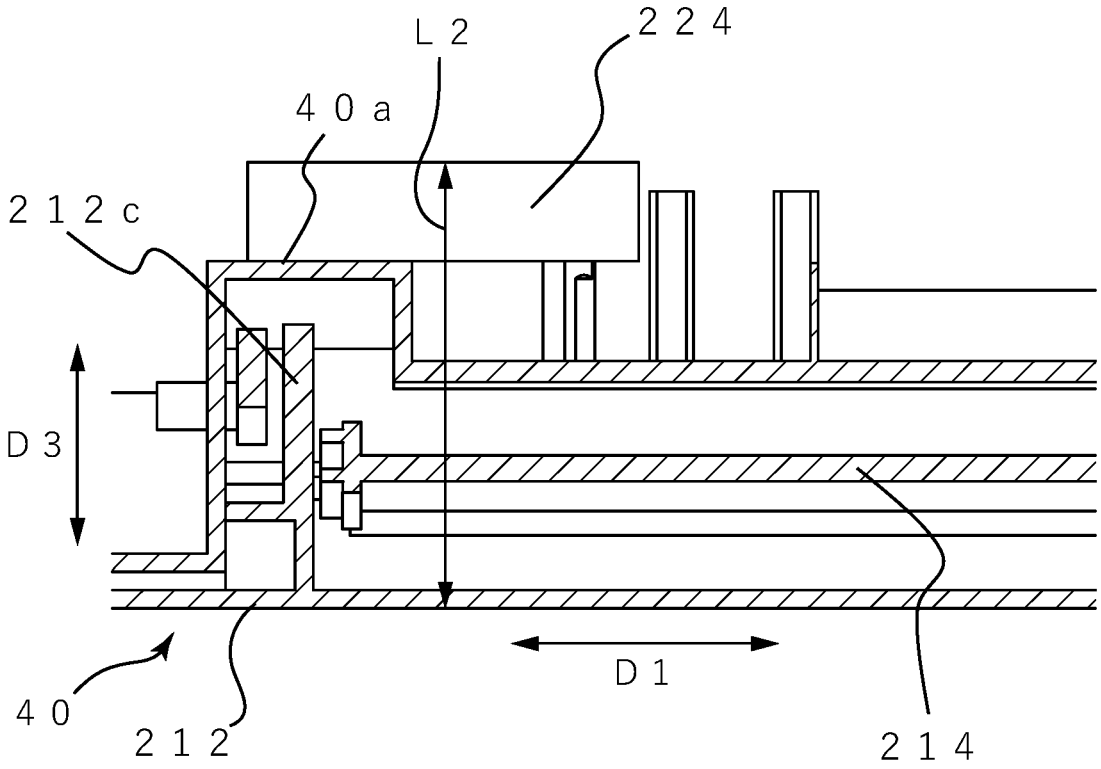
FIG. 15 is a section view of a comparative example of the first embodiment.

The door contact unit 224 is disposed further on the inside of the apparatus in the first direction D1 than the projection portion 40*a*, that is, on the right side of the projection portion 40*a* in the first direction D1. This arrangement is employed so as to reduce the size of the front door 40 in the third direction D3 to miniaturize the image forming apparatus 1. FIG. 15 illustrates a comparative example in which the door contact unit 224 is disposed in a region overlapping with the projection portion 40*a* in the first direction D1. In this comparative example, the distance from the front surface of the multi-tray frame member 212 to the back surface of the door contact unit 224 in the front door 40 is a distance L3 as illustrated in FIG. 15.

In contrast, in the present embodiment, the distance from the front surface of the multi-tray frame member 212 to the back surface of the door contact unit 224 is a distance L2 as illustrated in FIG. 14. The distance L2 is smaller than the distance L3. As described above, the image forming apparatus 1 can be miniaturized by displacing the door contact unit 224 from the projection portion 40*a* in the first direction D1.

In addition, as illustrated in FIG. 5B, the tray operation portion 30*a* has a concave portion facing down so as to be held by hand from below. Therefore, if the tray contact unit 219 is disposed in the same region as the tray operation portion 30*a* in the first direction D1, the door contact unit 224 may interrupt the operation by the user or the risk of the user touching the door contact unit 224 may increase. Here, as described above, the tray contact unit 219 and the door contact unit 224 are disposed in the same region in the first direction D1 so as to be in contact with each other.

Therefore, in the present embodiment, the tray contact unit 219 and the door contact unit 224 are disposed further on the outside of the apparatus than a left end surface 130 of the tray operation portion 30*a* in the first direction D1 as illustrated in FIG. 12. In addition, the tray contact unit 219 and the door contact unit 224 are disposed in a region below the tray operation portion 30*a* in the second direction D2, which is the vertical direction. As a result of this, even when the front door 40 is opened by the user, the user is less likely to touch the tray contact unit 219, and breakage of the tray contact unit 219 can be suppressed.

Further, as illustrated in FIGS. 12 to 14, a protrusion portion 753 projecting from the back surface of the front door 40 and a reinforcing rib 40*b* are provided in the vicinity of the door contact unit 224. The protrusion portion 753 includes two protrusions 753*a* and 753*b*, and the reinforcing rib 40*b* serving as a rib is integrally formed with the protrusion 753*a*.

The protrusion portion 753 is disposed at a position opposing the recess portion 752 provided in the tray front surface 30*f* of the cartridge tray 3 when the front door 40 is closed. Therefore, when the front door 40 is closed with respect to the apparatus body 2, the protrusion portion 753 provided in the front door 40 enters the recess portion 752 of the cartridge tray 3. The protrusion portion 753 is disposed such that there is a small gap between the protrusion portion 753 and the tray front surface 30*f* of the cartridge tray 3 at this time.

The protrusion portion 753 and the recess portion 752 are components that enable attachment of only the cartridge tray 3 applicable to the apparatus body 2. For example, when a cartridge tray that is not applicable to the apparatus body 2 and does not have the recess portion 752 is attached to the apparatus body 2, even if it is attempted to close the front door 40, the protrusion portion 753 interferes with the attached cartridge tray, and thus the front door 40 cannot be closed tightly. In addition, when the cartridge tray 3 that is applicable to the apparatus body 2 and has the recess portion 752 is attached to the apparatus body 2, the protrusion portion 753 does not interfere with the cartridge tray 3, and thus the front door 40 can be closed tightly. As a result of this, attachment of a cartridge tray not compatible with the image forming apparatus 1 can be prevented.

In addition, the reinforcing rib 40*b* is disposed so as to avoid interference with the tray operation portion 30*a*, and imparts rigidity to the front door 40. Further, the door contact unit 224 and the tray contact unit 219 are disposed further on the outside than the reinforcing rib 40*b* in the first direction D1 with respect to the apparatus, that is, on the left side of the reinforcing rib 40*b*. In other words, the reinforcing rib 40*b* is disposed between the end surface 130 of the tray operation portion 30*a* and the multi-tray frame member rail 212*c* in the first direction D1

Therefore, the tray contact unit 219 and the door contact unit 224 are preferably disposed in a region L1 in the first direction D1 as illustrated in FIG. 12. The region L1 is a region between the end surface 130 of the tray operation portion 30*a* and the multi-tray frame member rail 212*c* in the first direction D1. More preferably, the tray contact unit 219 and the door contact unit 224 is disposed further on the tray operation portion 30*a* side than the projection portion 40*a* in the first direction D1. In other words, the tray contact unit 219 and the door contact unit 224 is disposed between the projection portion 40*a* and the tray operation portion 30*a* in the first direction D1.

More preferably, the tray contact unit 219 and the door contact unit 224 are disposed on the same side as the protrusion portion 753 in the first direction D1 with respect to the tray operation portion 30*a*. More preferably, the tray contact unit 219 and the door contact unit 224 are disposed between the multi-tray frame member rail 212*c* and the reinforcing rib 40*b* in the first direction D1.

Contact Operation of Door Contact

Figure 16:
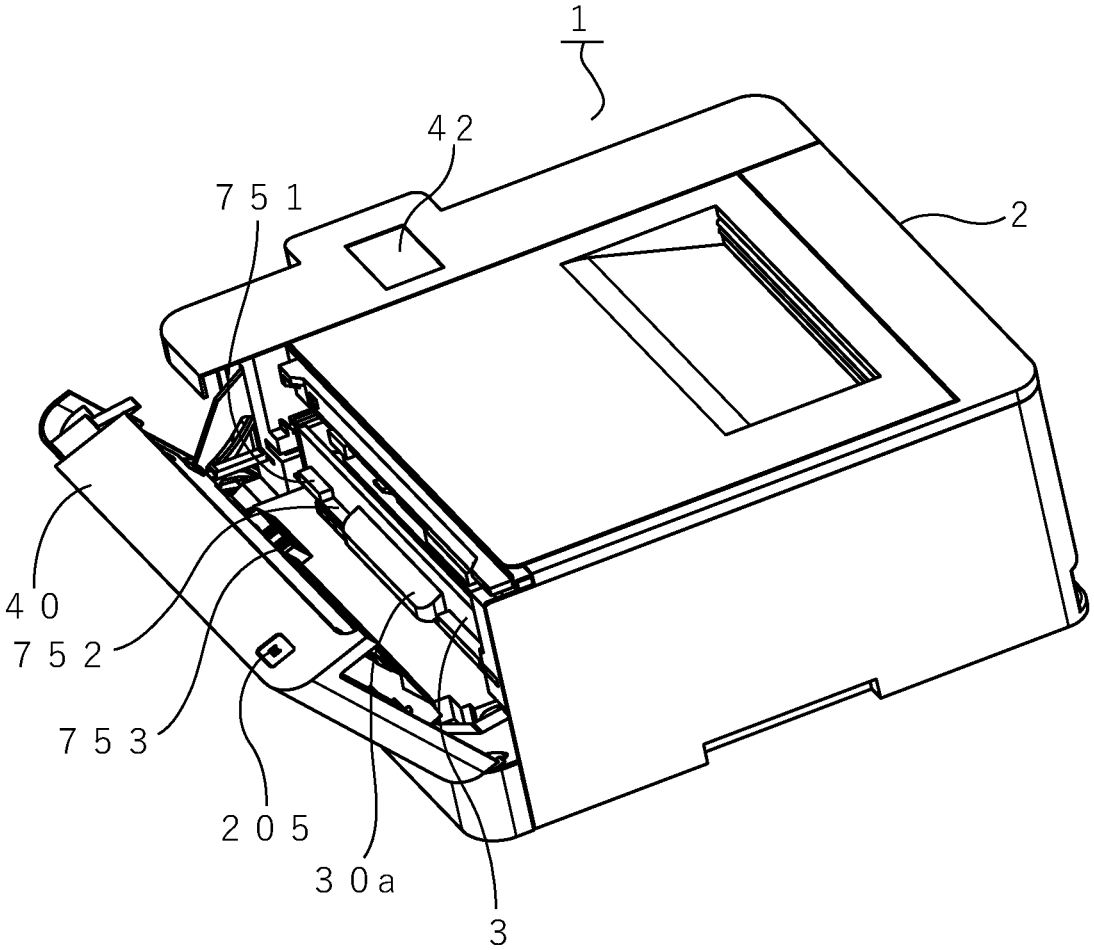
FIG. 16 is a perspective view of the image forming apparatus during a closing operation of the front door.
Figure 17:
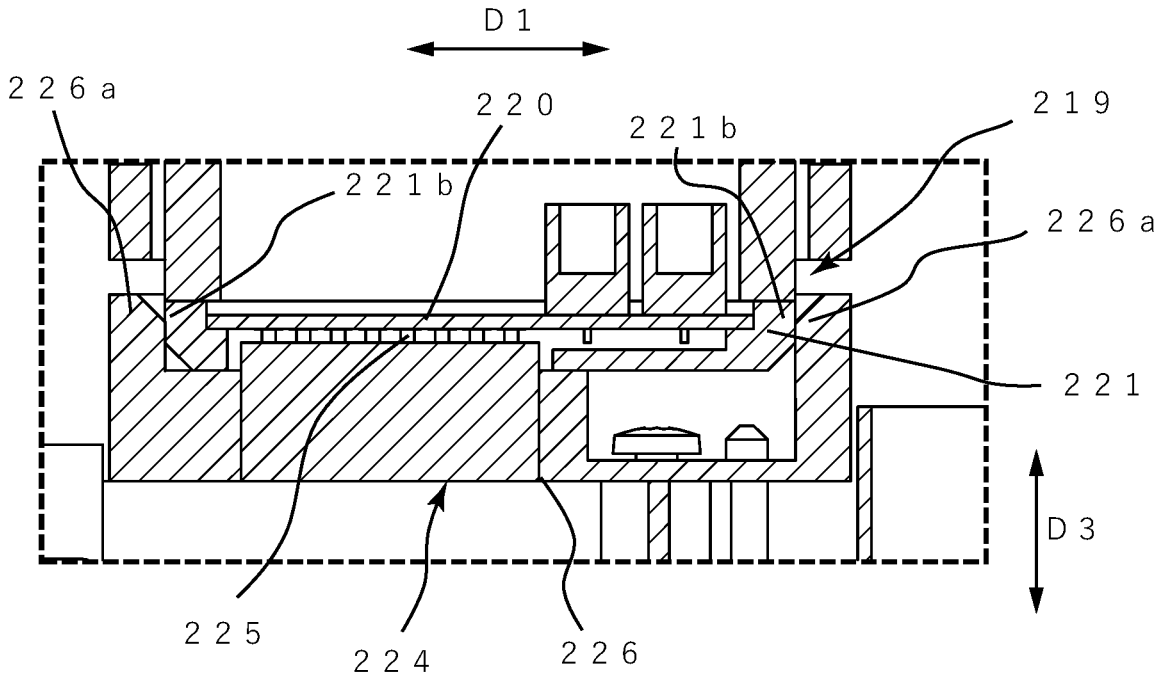
FIG. 17 is a section view of the image forming apparatus illustrating a state in which the door contact unit is in contact with the tray contact unit.

Next, a contact operation of the door contact unit 224 with the tray contact unit 219 will be described with reference to FIGS. 12, 13, 16, and 17. FIG. 16 is a perspective view of the image forming apparatus 1 in the middle of an operation of closing the front door 40. FIG. 17 is a section view of the door contact unit 224 and the tray contact unit 219 in contact with each other.

When the front door 40 is closed from an open state, a contact positioned portion 221*b* of the contact board holding member 221 engages with a contact positioning portion 226*a* of the door contact holder 226 as illustrated in FIGS. 16 and 17. As described above, movement of the contact board holding member 221 held so as to be movable by a certain amount in the first direction D1 and the second direction D2 is restricted in the first direction D1 and the second direction D2 by this engagement. As a result of this restriction, the tray contact board 220 held by the contact board holding member 221 and the door contact member 225 held by the door contact holder 226 are aligned in the first direction D1 and the second direction D2. In this state, the contact portion provided in the tray contact board 220 and the contact portion of the door contact member 225 are in contact with and electrically connected to each other.

To be noted, although the movement of the tray contact unit 219 is restricted in the first direction D1 and the second direction D2 by the door contact unit 224 in the present embodiment, the configuration is not limited to this. For example, the contact board holding member 221 of the door contact unit 224 may be configured to be movable in the first direction D1 and the second direction D2, and the movement of the contact board holding member 221 may be restricted by the tray contact unit 219. In addition, the component of the contact is not limited to a board and may be a different component such as a spring or a metal wire.

As described above, in the present embodiment, the tray contact unit 219 and the door contact unit 224 are disposed in the region L1 in the first direction D1 as illustrated in FIG. 12. As a result of this, the apparatus can be miniaturized, and the user touching the door contact unit 224 can be suppressed without degrading the operability of the tray operation portion 30*a*. As described above, according to the present embodiment, an embodiment of image forming apparatus simultaneously satisfying the operability and miniaturization can be provided.

To be noted, although the tray contact unit 219 and the door contact unit 224 are disposed on the left side of the tray operation portion 30*a* in the present embodiment, the configuration is not limited to this. For example, the tray contact unit 219 and the door contact unit 224 may be disposed on the right side of the tray operation portion 30*a*.

In addition, although the tray contact unit 219 is disposed in a region below the tray operation portion 30*a* in the second direction D2 in the present embodiment, the configuration is not limited to this. For example, the tray contact unit 219 may be provided at the same height as the tray operation portion 30*a*, or the tray contact unit 219 may be provided above the tray operation portion 30*a*.

Second Embodiment

Next, a second embodiment of the present invention will be described. The second embodiment has a configuration in which a measure to electrostatic discharge is added to the image forming apparatus the first embodiment. Therefore, the same elements as in the first embodiment will be denoted by the same reference signs or description thereof will be omitted.

Problem

Figure 18:
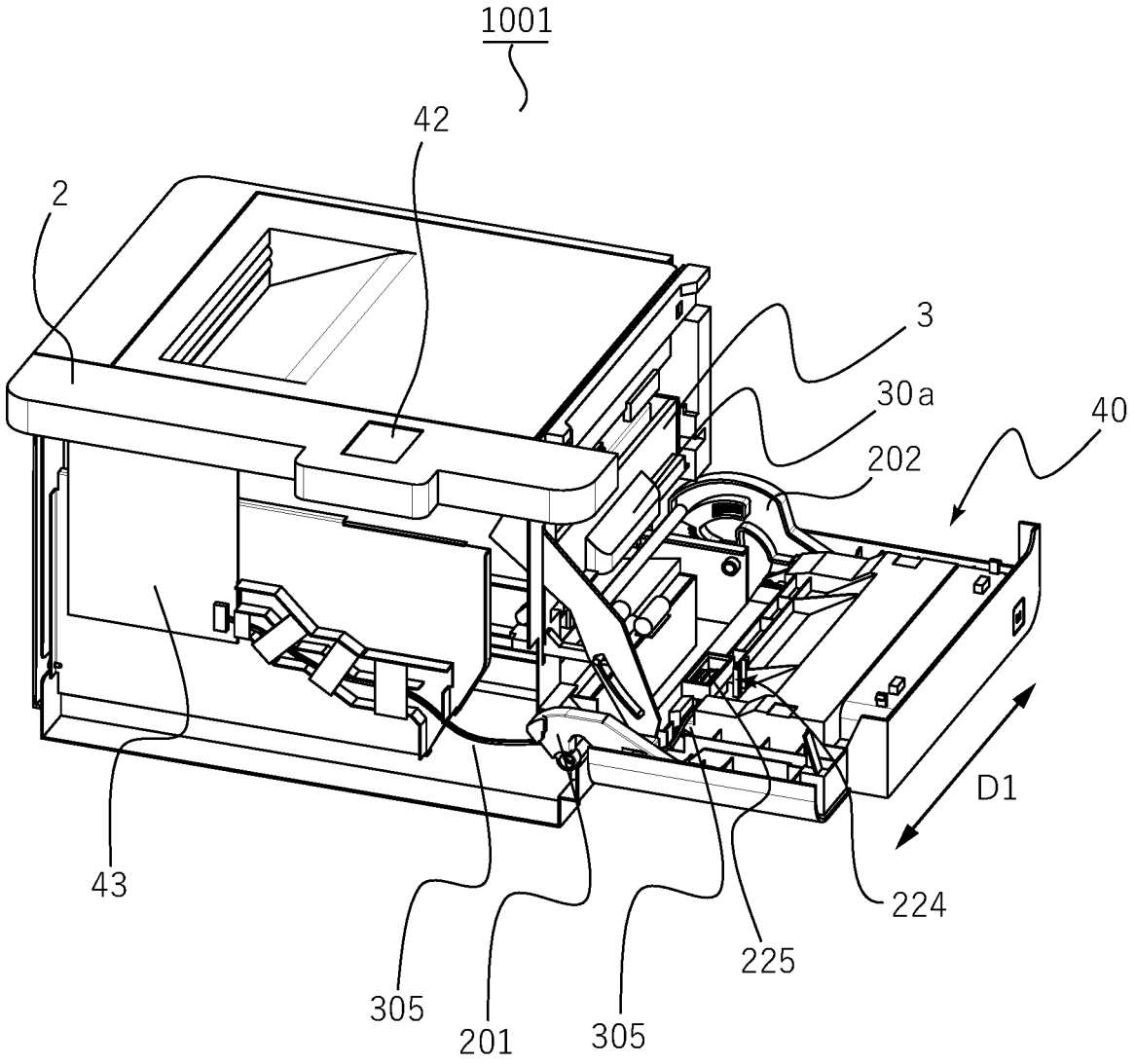
FIG. 18 is a section view of a comparative example of a second embodiment.

FIG. 18 is a perspective view of an image forming apparatus 1001 serving as a comparative example. To be noted, in FIG. 18, a state in which the front door is open is illustrated without illustrating the left side exterior and the exterior of the feeding tray for the sake of convenience of description. As illustrated in FIG. 18, the front door 40 is openably and closably supported by the left hinge 201 and the right hinge 202 with respect to the apparatus body 2. The tag body bundle wire 305 is electrically connected to the door contact member 225 of the door contact unit 224 provided in the front door 40. The tag body bundle wire 305 is electrically connected to the control board 43 via the left hinge 201.

The image forming apparatus 1001 serving as a comparative example has the following problem. When a conductor or a user charged with static electricity approaches or contacts the door contact member 225 or the tag body bundle wire 305, electrostatic discharge: ESD can occur. Further, for example, if a current derived from ESD reaches the control board 43 from the door contact member 225 via the tag body bundle wire 305, a device on the control board 43 can be electrically destroyed.

Particularly, in the image forming apparatus 1001, the user performs attachment and detachment of the cartridge tray 3 by operating the tray operation portion 30*a*. In a state in which the front door 40 is open, since the door contact member 225 faces a region that the hand of the user accesses, there is a high possibility that the user approaches or contacts the door contact member 225.

Configuration

Figure 19:
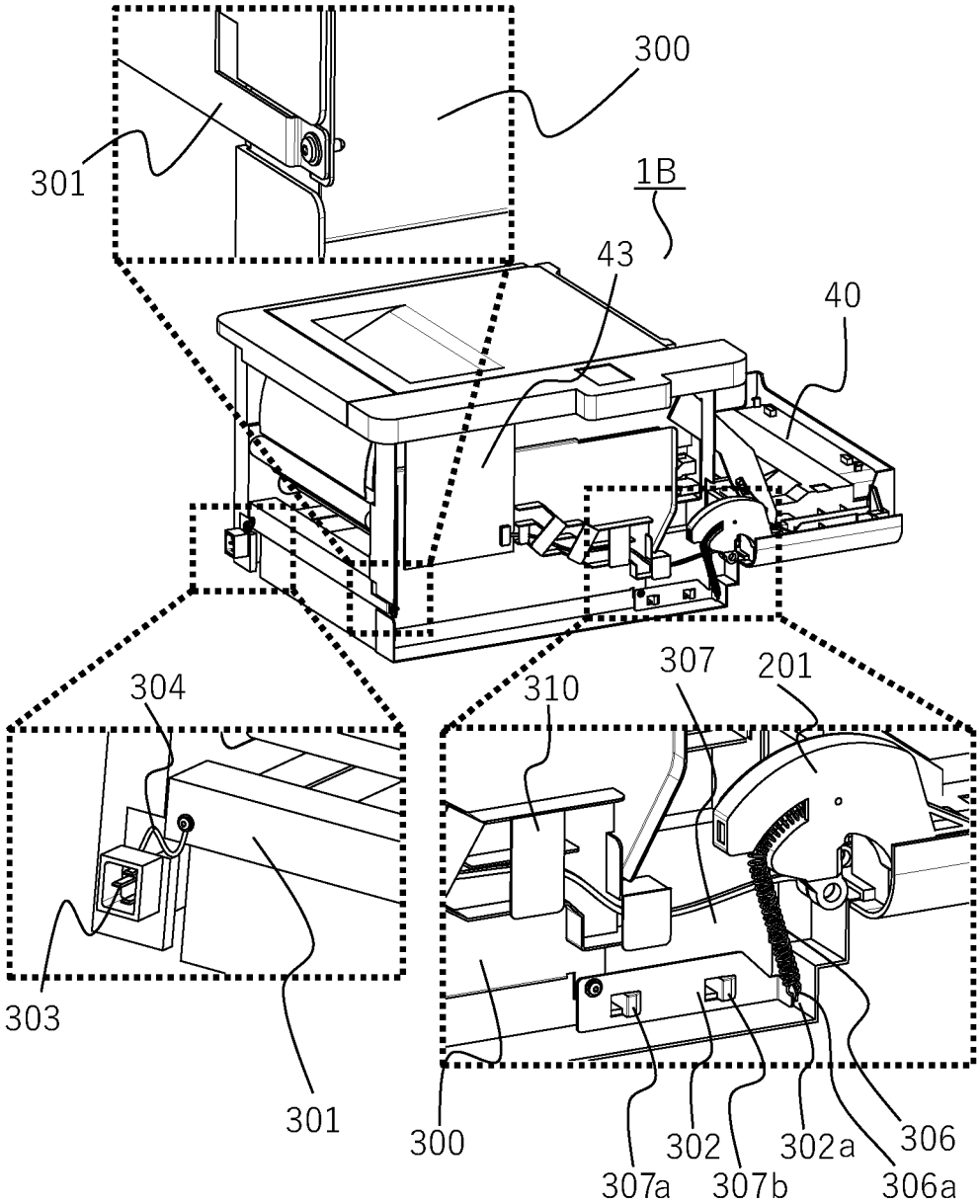
FIG. 19 illustrates enlarged perspective views of parts of an image forming apparatus according to the second embodiment indicated by broken lines.
Figure 20:
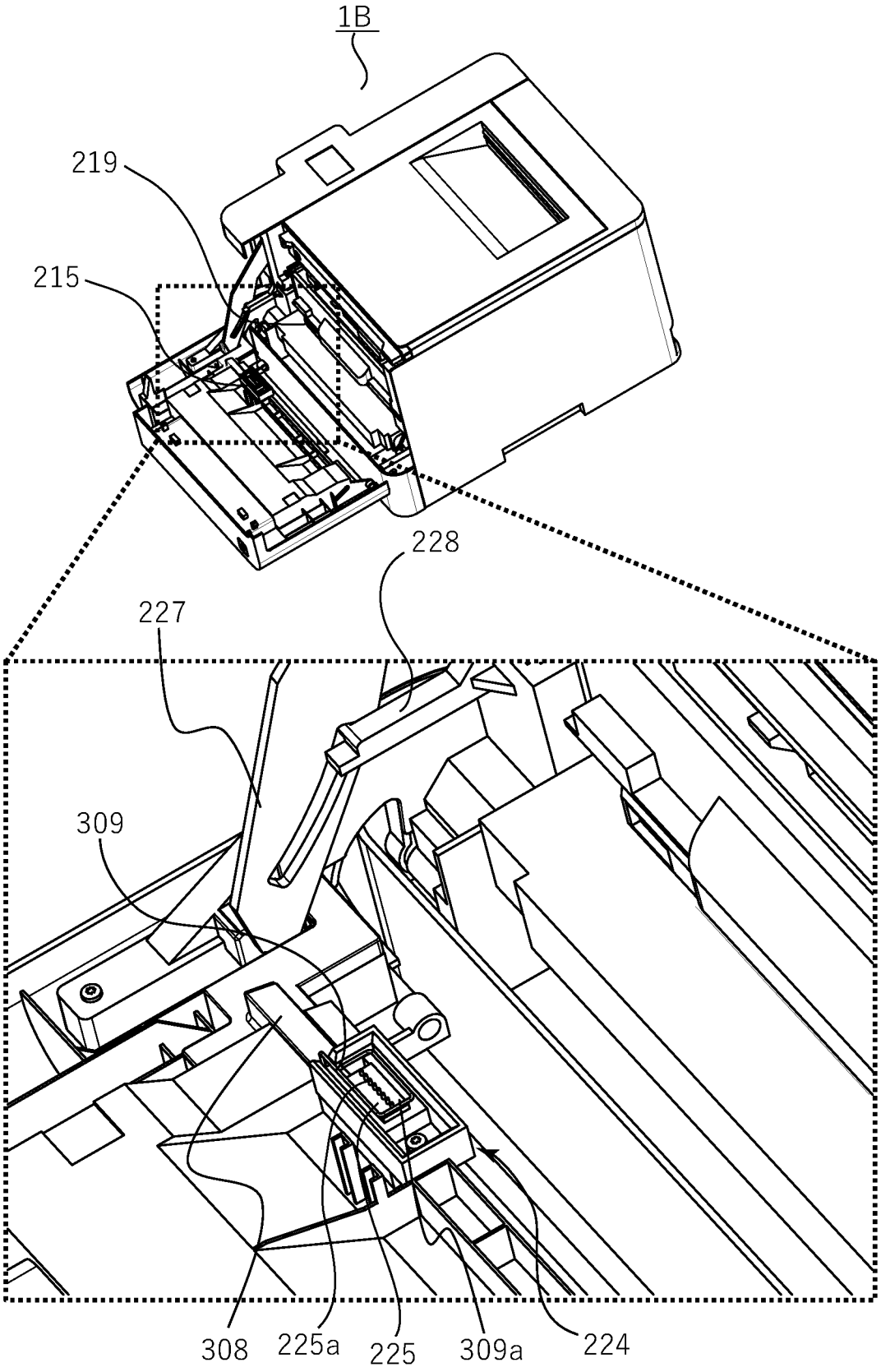
FIG. 20 is an enlarged perspective view of a door contact member of the door contact unit and the surroundings thereof.
Figure 21:
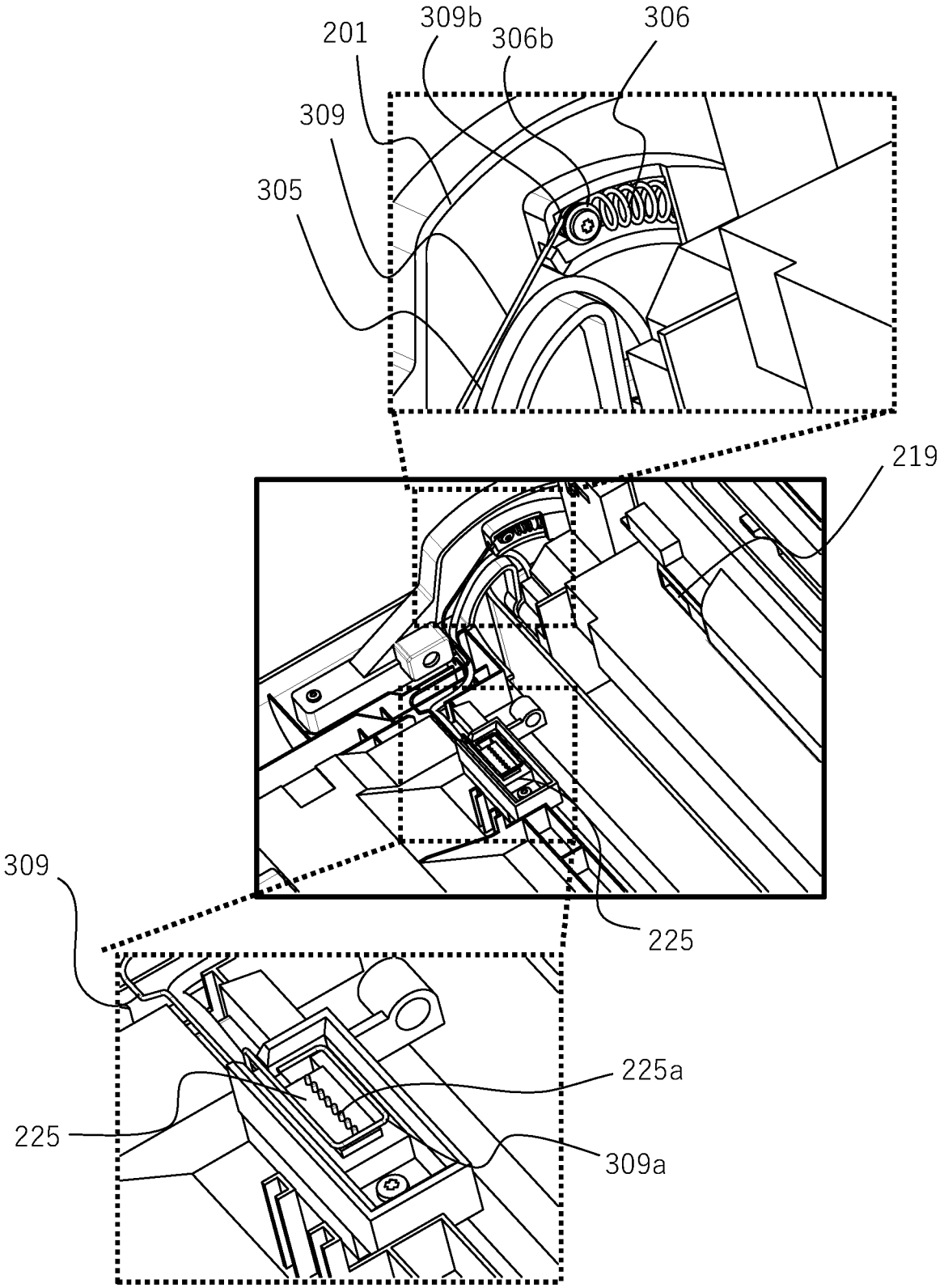
FIG. 21 illustrates enlarged perspective views of a tension spring and a wire spring.
Figure 22:
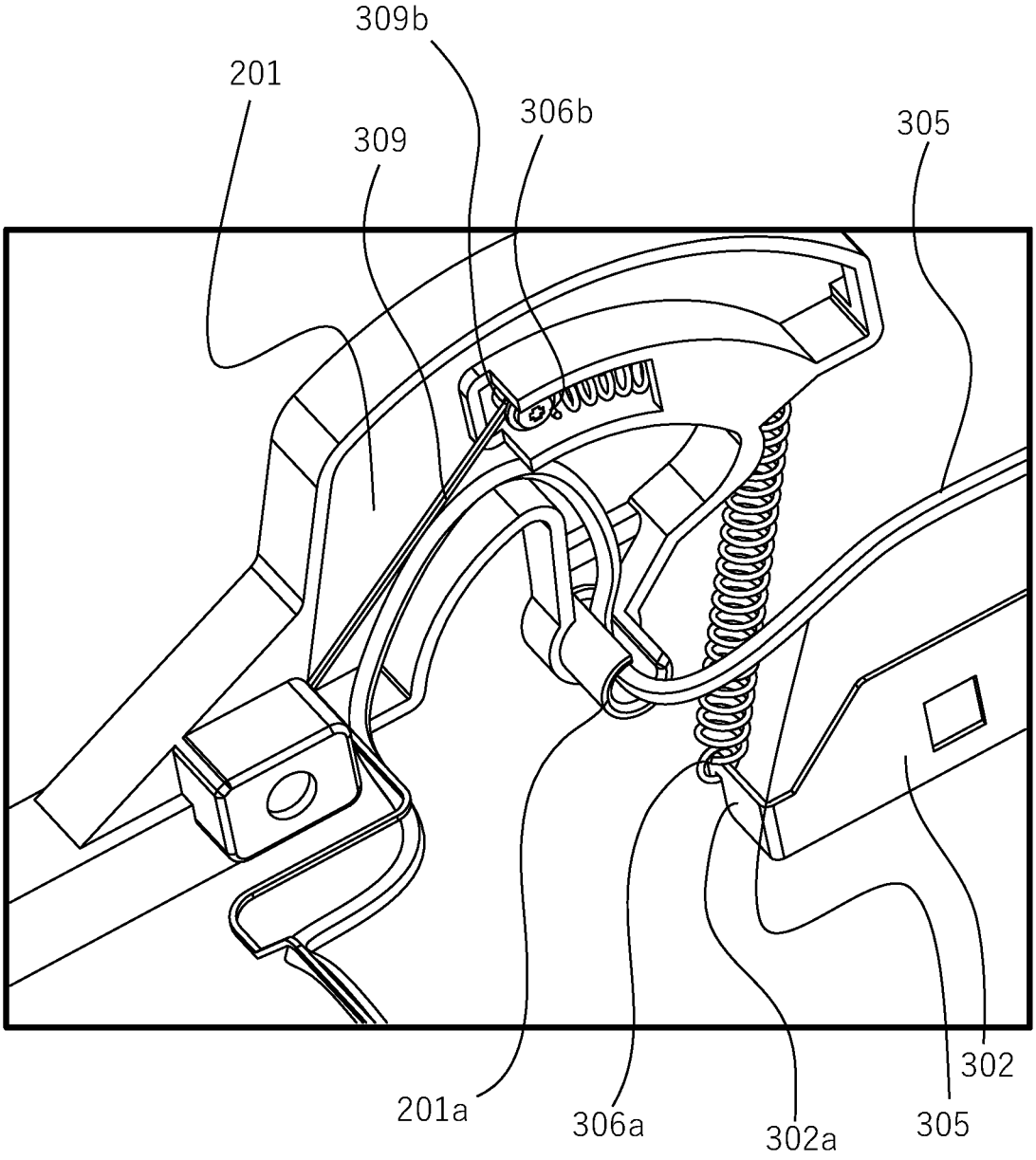
FIG. 22 is a perspective view of a left hinge and the surroundings thereof.
Figure 23A:
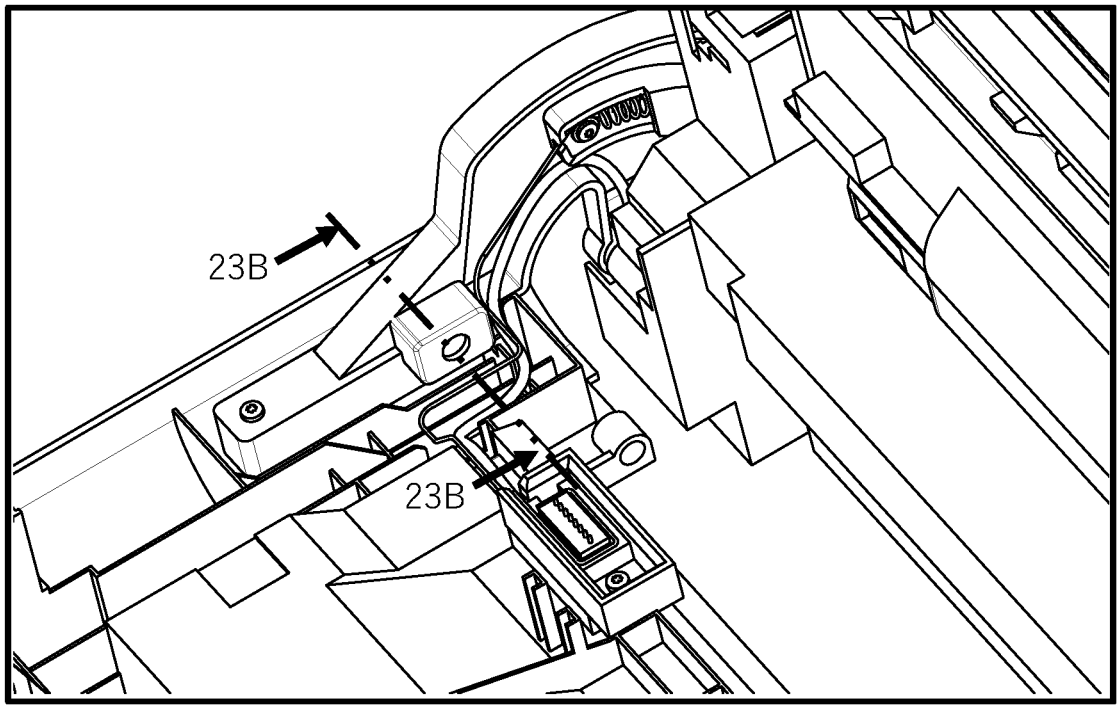
FIG. 23A is a perspective view of a wire spring and a tag body bundle wire illustrating a layout relationship thereof.
Figure 23B:
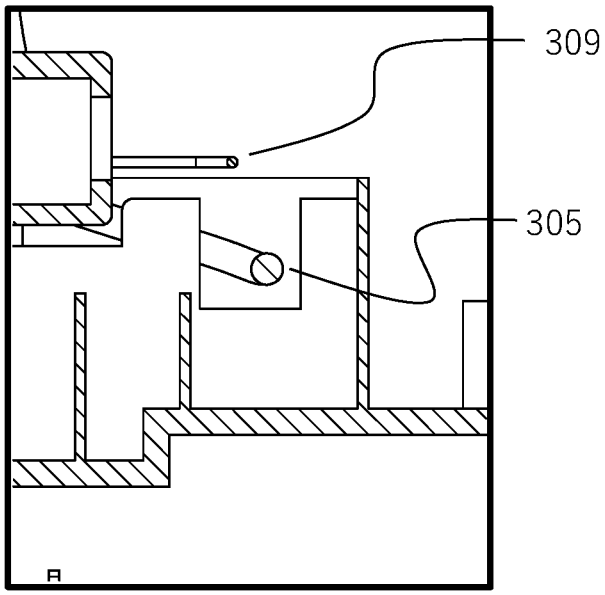
FIG. 23B is a section view taken along a line 23B-23B of FIG. 23A.

Next, a configuration that solves the problem described above will be described with reference to FIGS. 19 to 22B. FIG. 19 illustrates enlarged perspective views of parts of an image forming apparatus 1B indicated by broken lines. FIG. 20 is an enlarged perspective view of the door contact member 225 of the door contact unit 224 and the surroundings thereof. FIG. 21 illustrates enlarged perspective views of the tension spring 306 and the wire spring 309. FIG. 22 is a perspective view of the left hinge 201 and the surroundings thereof. FIG. 23A is a perspective view of the wire spring 309 and the tag body bundle wire 305 illustrating a layout relationship therebetween. FIG. 23B is a section view taken along a line 23B-23B of FIG. 23A. To be noted, for the sake of convenience of description, illustration of the left side exterior, the back side exterior, and the exterior of the feeding tray is omitted in FIG. 19.

As illustrated in FIG. 19, an image forming apparatus 1B includes a left side plate 300, a rear metal plate 301, and a left front metal plate 302, and the left side plate 300 is fastened to and thus electrically connected to the rear metal plate 301 and the left front metal plate 302 via a screw. The rear metal plate 301 is connected to a grounding pin 303 of an inlet via a grounding pin cable 304 and a screw. The left front metal plate 302 is positioned by hook portions 307*a* and 307*b* of a mold frame 397.

To be noted, although the electric connection between the members described above is established by a screw and a cable, the configuration is not limited to this. For example, other means such as welding or a contact spring may be used as long as electric connection can be established between members.

The tension spring 306 that urges the front door 40 in such a direction as to close the front door 40 with respect to the apparatus body 2 is provided in the left hinge 201 for relieving the impact of opening of the front door 40. The tension spring 306 is a conductive elastic member. A first end portion 306*a* of the tension spring 306 is held by a spring hooking portion 302*a* of the left front metal plate 302. The urging force, that is, the elastic force of the tension spring 306 is largest when the front door 40 is open. Therefore, the contact pressure between the tension spring 306 and the left front metal plate 302 is largest when the front door 40 is open, and thus the tension spring 306 is stably and electrically connected to the left front metal plate 302.

Next, the configuration of the front door 40 and the surroundings thereof will be described with reference to FIGS. 20 and 21. As illustrated in FIG. 20, the front door 40 is held at the open position by a front door link 227 and a front door rod 228. To be noted, in FIG. 21, illustration of the front door link 227, the front door rod 228, and a bundle wire protection cover 308 is omitted for the sake of convenience of description.

As illustrated in FIG. 20, the door contact member 225 of the door contact unit 224 is electrically connected to the control board 43. In addition, the door contact unit 224 comes into contact with and is electrically connected to the tray contact unit 219 when the front door 40 is positioned at the closed position. Further, the door contact unit 224 is configured to be exposed to the outside of the image forming apparatus 1B without coming into contact with the tray contact unit 219 when the front door 40 is positioned at the open position.

As illustrated in FIG. 21, a second end portion 309*b* of the wire spring 309 having conductivity is fastened to a second end portion 306*b* of the tension spring 306 via a screw, and thus the tension spring 306 is electrically connected to the wire spring 309. As a result of this, the wire spring 309, the tension spring 306, the left front metal plate 302, the left side plate 300, the grounding pin cable 304, and the grounding pin 303 are electrically connected to one another, and thus the wire spring 309 and the tension spring 306 function as grounding. That is, the tension spring 306 constitutes a grounding portion that is grounded and an urging portion. To be noted, although the wire spring 309 is used as a conductive member in the present embodiment, the shape and material of the conductive member are not limited. For example, a conductive member having a sheet shape or a plate shape may be used. In addition, the wire spring 309 is provided so as not to be electrically connected to the electric path from the door contact unit 224 to the control board 43.

The tag body bundle wire 305 is connected to the door contact member 225 as illustrated in FIGS. 21 and 22. As a result of the door contact member 225 being electrically connected to the tray contact unit 219 when the front door 40 is closed, information of the memory tags 81Y, 81M, 81C, and 81K of the respective developing cartridges illustrated in FIG. 3 can be transmitted to the control board 43 via the tag body bundle wire 305.

The tag body bundle wire 305 extends from the door contact member 225 toward the left hinge 201 as illustrated in FIGS. 20 to 22. At this time, the bundle wire protection cover 308 that covers the tag body bundle wire 305 is provided above the tag body bundle wire 305. As a result of this, breakage of the control board 43 by ESD caused by the user touching the tag body bundle wire 305 can be suppressed. To be noted, a minute gap is inevitably generated between the front door 40 and the bundle wire protection cover 308, and the electric discharge phenomenon can also occur between the user and the tag body bundle wire 305 in this minute gap.

As illustrated in FIG. 22, the tag body bundle wire 305 passes the left hinge rotation shaft 201*a* serving as a rotation shaft of the front door 40 and is held by a bundle wire holder 310 illustrated in FIG. 19. Further, the tag body bundle wire 305 is distributed in a back portion of the apparatus and connected to the control board 43.

Incidentally, the user accesses the cartridge tray 3 from the upper side of the image forming apparatus 1B. Therefore, as illustrated in FIG. 21, the tension spring 306 and the tag body bundle wire 305 are disposed in the left hinge 201 among the hinges respectively provided on the left side and the right side. In other words, both the tension spring 306 and the tag body bundle wire 305 are disposed in the left hinge 201 serving as a first hinge, and are not disposed in the right hinge 202 serving as a second hinge. As a result of this, the tension spring 306 can protect the tag body bundle wire 305 from ESD and suppress breakage of the control board 43.

In addition, the wire spring 309 is provided in a region above the tag body bundle wire 305 along the tag body bundle wire 305 as illustrated in FIGS. 20 to 23B. Further, a first end portion 309*a* of the wire spring 309 is disposed close to the door contact member 225 so as to be exposed to the outside of the image forming apparatus 1B when the front door 40 is positioned at the open position. More specifically, the first end portion 309*a* of the wire spring 309 is disposed above the contact portion 225*a* of the door contact member 225 so as to surround the door contact member 225. The second end portion 309*b* of the wire spring 309 is electrically connected to the tension spring 306. By providing the wire spring 309 as described above, the hand of the user or a conductor that is normally put in from above touching the door contact member 225 without touching the wire spring 309 can be suppressed.

In addition, ESD can occur also in the case where the hand of the user, a conductor, or the like is near, and the wire spring 309 is closer to the hand of the user, a conductor, or the like than the contact portion 225*a* of the door contact member 225 or the tag body bundle wire 305. Therefore, even if ESD occurs, a current flows to the wire spring 309 or the tension spring 306 that is grounded instead of to the contact portion 225*a* of the door contact member 225 or the tag body bundle wire 305. As a result of this, breakage of the control board 43 can be suppressed. As described above, according to the present embodiment, an embodiment of an image forming apparatus in which breakage of the control board 43 is suppressed can be provided.

To be noted, although the electrical product to be protected from ESD is, for example, the door contact member 225 in the present embodiment, the configuration is not limited to this, and other electric components such as motors and sensors may be configured to be protected from ESD.

Third Embodiment

Next, a third embodiment of the present invention will be described. The third embodiment has a configuration in which the tension spring 306 of the second embodiment is replaced by a torsion coil spring 311. Therefore, the same elements as in the second embodiment will be denoted by the same reference signs or description thereof will be omitted.

Peripheral Configuration of Torsion Coil Spring

Figure 24A:
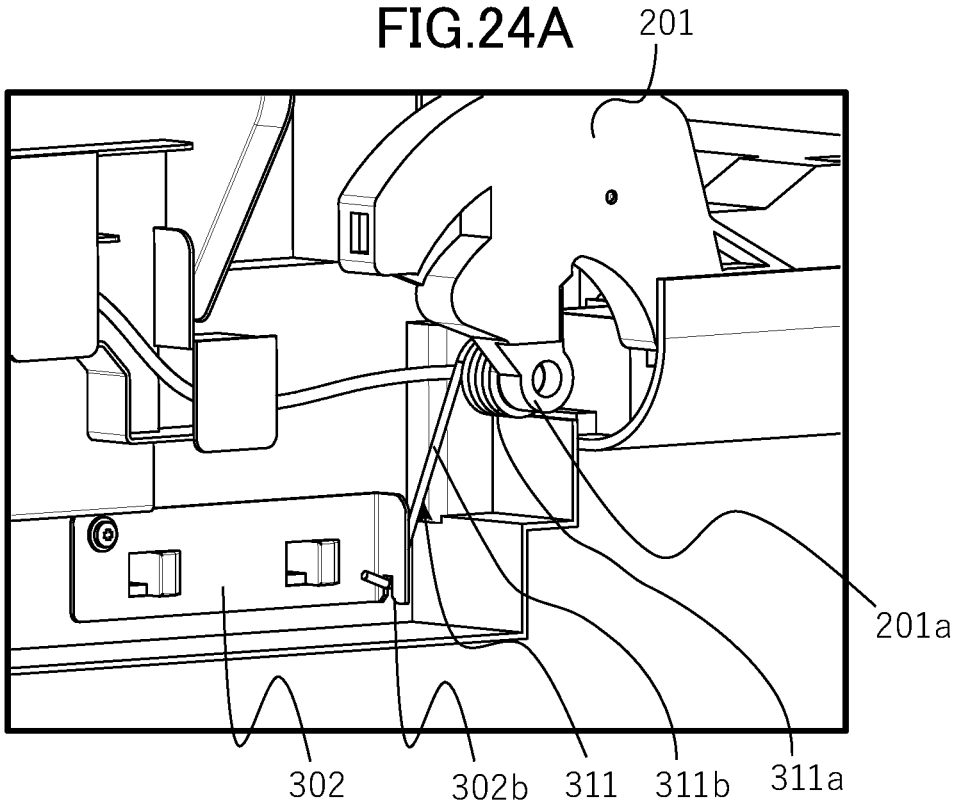
FIG. 24A is an enlarged perspective view of a torsion coil spring according to a third embodiment.
Figure 24B:
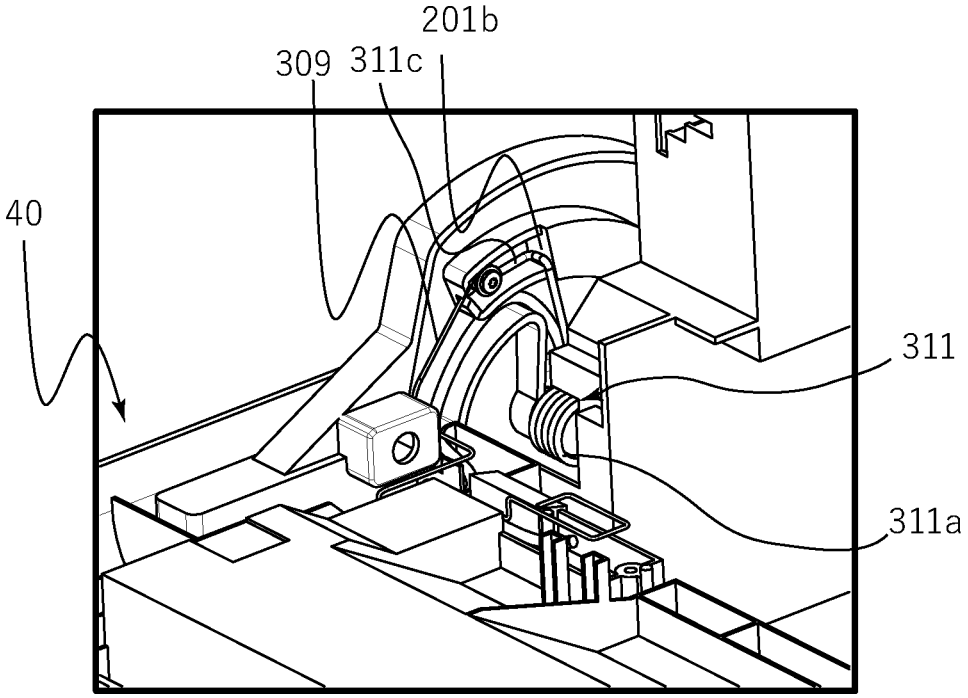
FIG. 24B is a perspective view of the torsion coil spring.

FIGS. 24A and 24B are each a perspective view of the torsion coil spring 311. As illustrated in FIGS. 24A and 24B, the torsion coil spring 311 includes a coil portion 311*a*, a first end portion 311*b* extending in one direction from the coil portion 311*a*, and a second end portion 311*c* extending in the other direction from the coil portion 311*a*. The coil portion 311*a* of the torsion coil spring 311 is rotatably supported by the left hinge rotation shaft 201*a*, and the first end portion 311*b* is locked by a spring receiving portion 302*b* of the left front metal plate 302.

The second end portion 311*c* of the torsion coil spring 311 is electrically connected to the wire spring 309 via a screw. In addition, the torsion coil spring 311 presses a spring receiving portion 201*b* provided in the left hinge 201 by the second end portion 311*c*, and thus relieves the impact of opening of the front door 40.

The urging force, that is, the elastic force of the torsion coil spring 311 is largest when the front door 40 is open similarly to the second embodiment. Therefore, the contact pressure between the torsion coil spring 311 and the left front metal plate 302 is largest when the front door 40 is open, and thus the torsion coil spring 311 is stably and electrically connected to the left front metal plate 302.

Effect

According to such a configuration, the wire spring 309 and the torsion coil spring 311 function as grounding. Further, similarly to the second embodiment, the wire spring 309 and the torsion coil spring 311 protect the tag body bundle wire 305 and the door contact member 225 from ESD, and thus breakage of the control board 43 can be suppressed. In addition, the torsion coil spring 311 can be selected in accordance with the limitation of layout around the left hinge 201, and thus the flexibility of design can be improved. As described above, according to the present embodiment, an embodiment of an image forming apparatus in which breakage of the control board 43 is suppressed while improving the flexibility of design can be provided.

Fourth Embodiment

Next, a fourth embodiment of the present invention will be described. The fourth embodiment has a configuration in which the configuration of the door contact member 225 is changed from the first embodiment. Therefore, the same elements as in the first embodiment will be denoted by the same reference signs or description thereof will be omitted.

Problem

Similarly to the first embodiment, in a configuration in which the door contact member 225 disposed in the front door 40 is electrically connected to the control board 43 via the tag body bundle wire 305 extending through the left hinge 201 has the following problem.

When a conductor or a user charged with static electricity approaches or contacts the door contact member 225 or the tag body bundle wire 305, ESD can occur. Further, for example, if a current derived from ESD reaches the control board 43 from the door contact member 225 via the tag body bundle wire 305, a device on the control board 43 can be electrically destroyed.

Particularly, in a state in which the front door 40 is open, since the door contact member 225 faces a region that the hand of the user accesses, there is a high possibility that the user approaches or contacts the door contact member 225.

Configuration

Figure 25:
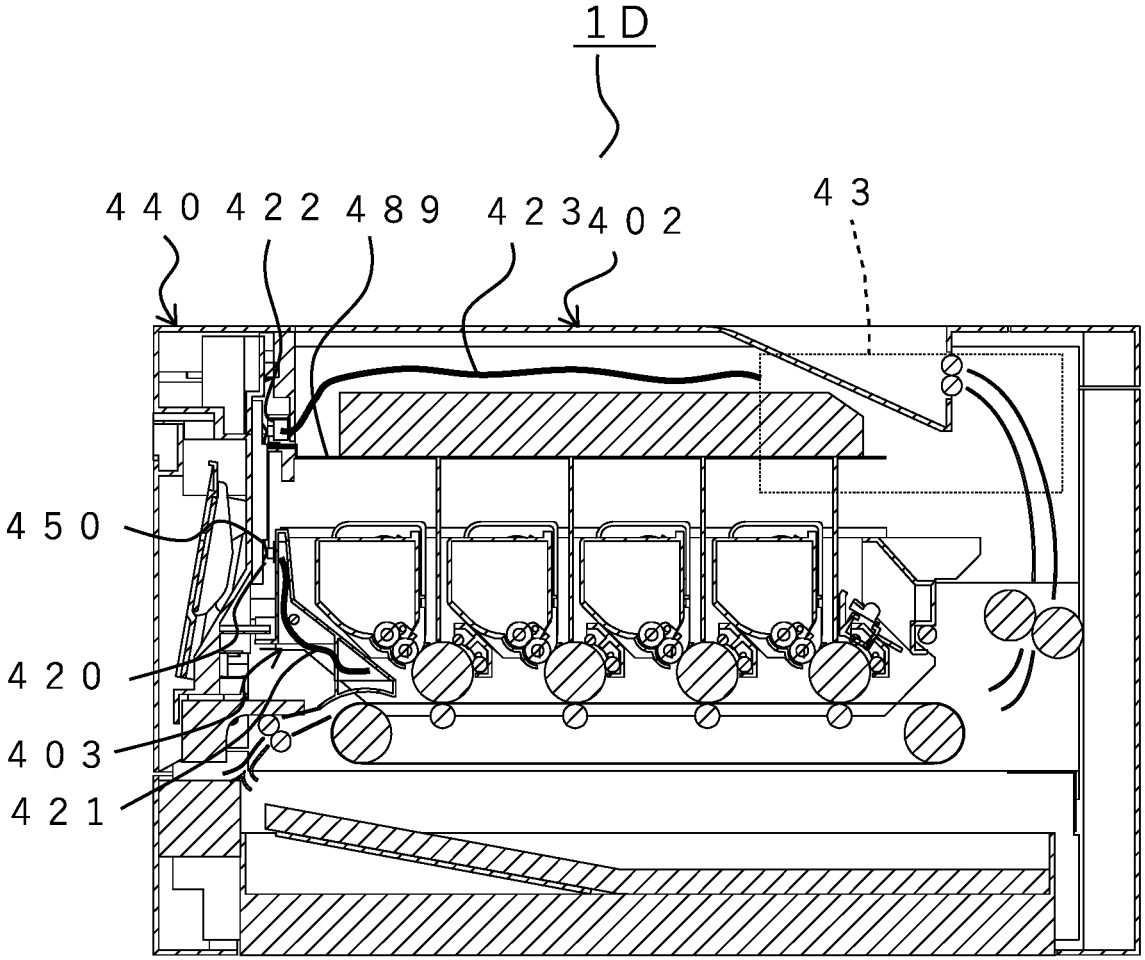
FIG. 25 is a section view of an image forming apparatus according to a fourth embodiment.
Figure 26A:
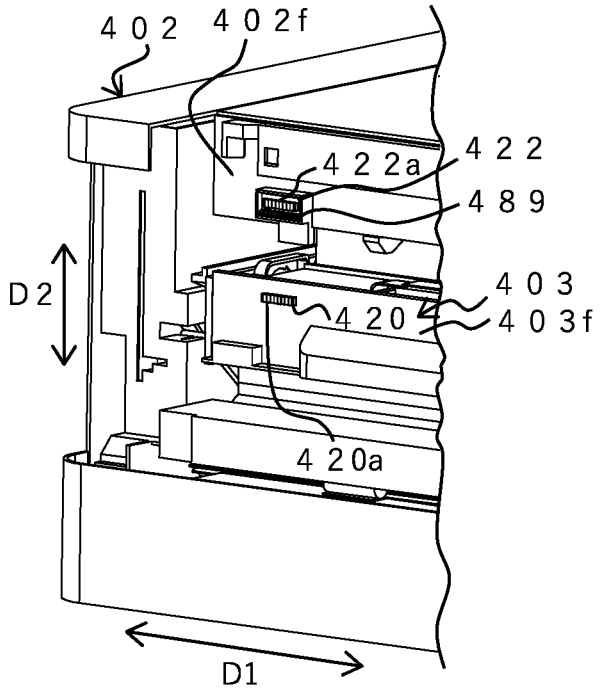
FIG. 26A is a perspective view of an apparatus body and a cartridge tray.
Figure 26B:
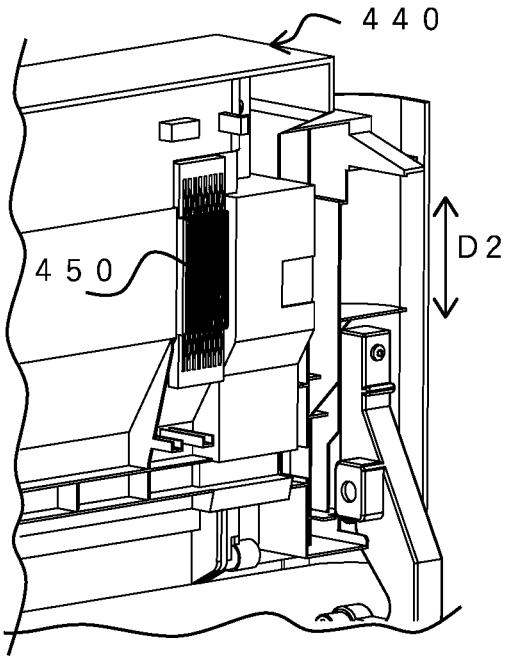
FIG. 26B is a perspective view of an intermediate contact portion.
Figure 26C:
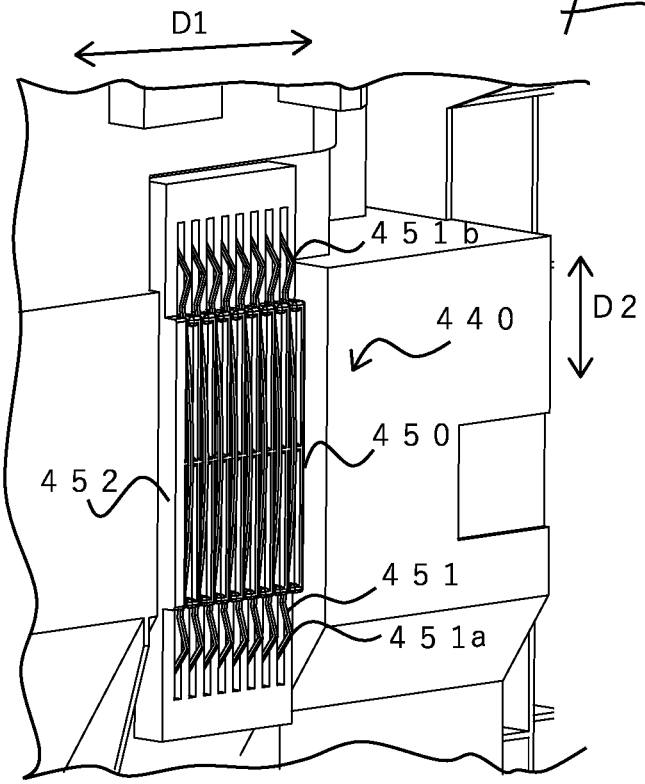
FIG. 26C is an enlarged perspective view of the intermediate contact portion.
Figure 27A:
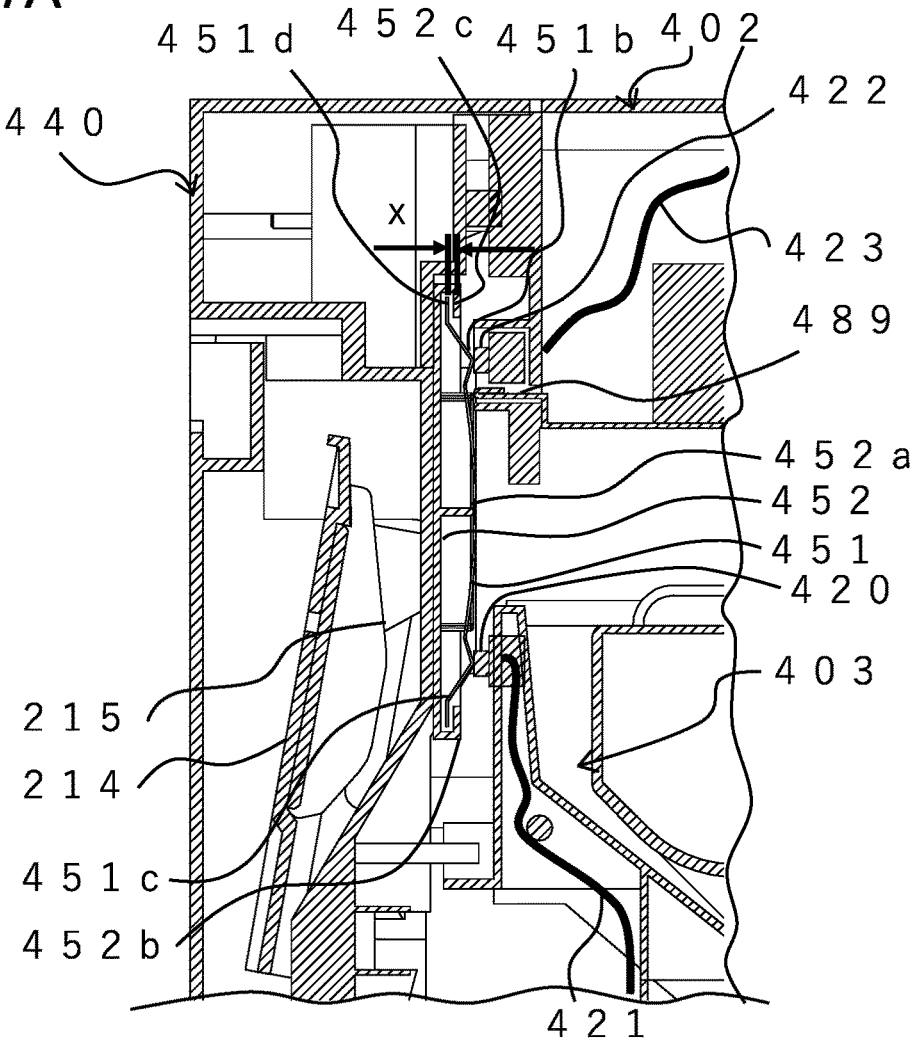
FIG. 27A is a section view of the intermediate contact portion in a state in which the front door is closed.
Figure 27B:
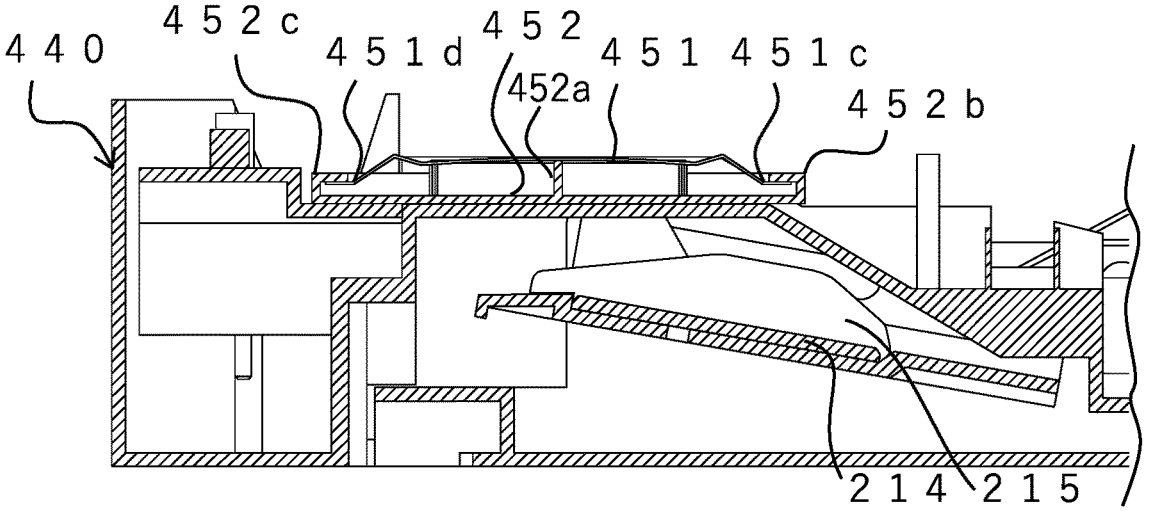
FIG. 27B is a section view of the intermediate contact portion in a state in which the front door is open.

Next, a configuration for solving the problem described above will be described with reference to FIGS. 25 to 27B. FIG. 25 is a section view of an image forming apparatus 1D according to the present embodiment. FIG. 26A is a perspective view of an apparatus body 402 and a cartridge tray 403. FIG. 26B is a perspective view of an intermediate contact portion 450, and FIG. 26C is an enlarged perspective view of the intermediate contact portion 450. FIG. 27A is a section view of the intermediate contact portion 450 in a state in which the front door 440 is closed, and FIG. 27B is a section view of the intermediate contact portion 450 in a state in which the front door 440 is open.

As illustrated in FIGS. 25 to 26C, the image forming apparatus 1D includes the apparatus body 402 and the front door 440 openably and closably supported by the apparatus body 402. The cartridge tray 403 is attached to the apparatus body 402 such that the cartridge tray 403 can be drawn out from the apparatus body 402, and a tray contact board 420 serving as a unit contact is provided on a tray front surface 403*f* of the cartridge tray 403 serving as a unit holder. A body contact board 422 is provided in the apparatus body 402, and the body contact board 422 serving as a body contact is disposed above the tray contact board 420.

The tray contact board 420 is a board-shaped contact member and has a tray contact board contact surface 420*a* that opposes the front door 440 positioned at the closed position. The tray contact board 420 is disposed at a position close to the control board 43 in the first direction D1, and therefore a body contact bundle wire 423 connected to the body contact board 422 that will be described later can be configured to be short.

The body contact board 422 is a board-shaped contact provided on a front surface 402*f* of the apparatus body 402 and above the tray contact board 420 in the second direction D2. The body contact board 422 has a body contact board contact surface 422*a* that opposes the front door 440 positioned at the closed position, and is connected to the control board 43 provided on a side of the apparatus body 402 via a body contact bundle wire 423.

The apparatus body 402 includes an LB stay 489 that holds the laser scanner unit LB illustrated in FIG. 1, and the body contact board 422 is disposed in the vicinity of the LB stay 489 serving as a grounding member. The LB stay 489 is grounded, and therefore the body contact board 422 can be protected from ESD even if the hand of the user approaches or contacts the body contact board 422. As described above, the body contact board 422 can be protected from ESD without providing an additional component.

The intermediate contact portion 450 is disposed in the front door 440, and includes an intermediate contact spring 451 and an intermediate contact holder 452. The intermediate contact spring 451 serving as an elastic member is held by the intermediate contact holder 452, and is constituted by a plurality of wires for spring having conductivity and elasticity. The number of the wires for spring that are provided corresponds to the number of contacts in the tray contact board contact surface 420*a*.

More specifically, as illustrated in FIG. 27B, end portions 451*c* and 451*d* of the intermediate contact spring 451 are held by stopping ribs 452*b* and 452*c* of the intermediate contact holder 452 in a state in which a center portion of the intermediate contact spring 451 is pressed by a pressing rib 452*a* of the intermediate contact holder 452. As described above, the intermediate contact spring 451 is held by the intermediate contact holder 452 in a state of being pressed by the pressing rib 452*a* and elastically deformed, and there is no gap between the end portions 451*c* and 451*d* and the stopping ribs 452*b* and 452*c* in a state in which the front door 440 is open.

The intermediate contact spring 451 includes a first intermediate contact 451*a* that can be electrically connected to the tray contact board contact surface 420*a* of the tray contact board 420 and a second intermediate contact 451*b* that can be electrically connected to the body contact board contact surface 422*a* of the body contact board 422. The first intermediate contact 451*a* constitutes a first contact, and the second intermediate contact 451*b* constitutes a second contact.

As illustrated in FIG. 27A, when the front door 440 is closed with respect to the apparatus body 402, the first intermediate contact 451*a* and the second intermediate contact 451*b* of the intermediate contact spring 451 are respectively pressed by the body contact board 422 and the tray contact board 420.

Then, the intermediate contact spring 451 is elastically deformed, and the first intermediate contact 451*a* and the second intermediate contact 451*b* are held in a state of being urged respectively toward the body contact board 422 and the tray contact board 420. In other words, the intermediate contact spring 451 is elastically deformed such that the first intermediate contact 451*a* is in pressure contact with the tray contact board 420 and the second intermediate contact 451*b* is in pressure contact with the body contact board 422. As a result of this, the first intermediate contact 451*a* and the second intermediate contact 451*b* of the intermediate contact spring 451 are respectively stably in contact with the body contact board 422 and the tray contact board 420, and thus electric connection can be secured. Therefore, the memory tags 81Y, 81M, 81C, and 81K of the respective developing cartridges illustrated in FIG. 3 are reliably electrically connected to the control board 43 via the tray contact board 420, the intermediate contact spring 451, and the body contact board 422.

To be noted, in a state in which the front door 440 is closed, the first intermediate contact 451*a* and the second intermediate contact 451*b* are respectively pressed by the body contact board 422 and the tray contact board 420, and thus a gap x is generated between the end portions 451*c* and 451*d* and the stopping ribs 452*b* and 452*c*. That is, play for retracting the end portions 451*c* and 451*d* of the intermediate contact spring 451 is provided in the intermediate contact holder 452. As a result of this, the first intermediate contact 451*a* and the second intermediate contact 451*b* can be more reliably pressed against the body contact board 422 and the tray contact board 420 when the front door 440 is closed.

In other words, the first intermediate contact 451*a* is in contact with and electrically connected to the tray contact board 420 when the front door 440 is positioned at the closed position. In addition, the first intermediate contact 451*a* is configured to be exposed to the outside of the image forming apparatus 1D without coming into contact with the tray contact board 420 when the front door 440 is positioned at the open position. The second intermediate contact 451*b* is in contact with and electrically connected to the body contact board 422 when the front door 440 is positioned at the closed position. In addition, the second intermediate contact 451*b* is configured to be exposed to the outside of the image forming apparatus 1D without coming into contact with the body contact board 422 when the front door 440 is positioned at the open position.

In addition, the intermediate contact holder 452 is disposed so as to oppose the multi-tray 214 with the front door 440 therebetween, and has a shape avoiding the width regulation plate 215 such that the multi-tray 214 can be closed no matter where the width regulation plate 215 is positioned in the first direction D1.

Effect

As described above, in the present embodiment, the tray contact board 420, the body contact board 422, and the intermediate contact portion 450 are respectively provided in the cartridge tray 403, the apparatus body 402, and the front door 440. As a result of this, in a state in which the front door 440 is closed, the memory tags 81Y, 81M, 81C, and 81K of the respective developing cartridges illustrated in FIG. 3 are electrically connected to the control board 43, and thus the control board 43 can read information of the memory tags.

In addition, in a state in which the front door 440 is open, other electric components are not electrically connected to the intermediate contact portion 450 provided in the front door 440. As a result of this, even if a current flows in the intermediate contact spring 451 due to occurrence of ESD, other electric components are not broken, and thus a component for protecting a contact component on the front door 440 side from ESD is not necessary. In addition, a path for the body contact bundle wire 423 does not have to be provided in the vicinity of the hinges of the front door 440, and therefore replaceability of the front door 440 in replacement service can be improved. As described above, according to the present embodiment, an embodiment of an image forming apparatus in which breakage of the control board 43 can be suppressed while also reducing the cost can be provided.

Modification Example of Fourth Embodiment

To be noted, although the body contact board 422 is protected from ESD by the LB stay 489 in the present embodiment, the configuration is not limited to this. For example, the body contact board 422 may be protected from ESD by disposing the body contact board 422 in the vicinity of not the LB stay 489 but a different grounded component.

In addition, although the intermediate contact spring 451 is held by the intermediate contact holder 452 in the present embodiment, the intermediate contact spring 451 may be directly held by the front door 440. In addition, the intermediate contact spring 451 may be formed from a different material than a wire for spring or formed in a different shape as long as the intermediate contact spring 451 has conductivity and elasticity.

In addition, the intermediate contact spring 451 may be formed from a nonelastic member as long as the first intermediate contact 451*a* and the second intermediate contact 451*b* of the intermediate contact spring 451 are configured to be respectively pressed by the body contact board 422 and the tray contact board 420 in a state in which the front door 440 is closed. For example, the intermediate contact holder 452 may elastically hold the intermediate contact spring 451, or the body contact board 422 and the tray contact board 420 may be formed to have elasticity.

In addition, although the intermediate contact portion 450 is used for electrically connecting the memory tags 81Y, 81M, 81C, and 81K of the respective developing cartridges to the control board 43 in the present embodiment, the configuration is not limited to this. For example, the intermediate contact portion 450 may be used for connecting a charge contact, contacts of a toner remainder amount detection portion and a sheet detection portion, or the like to the control board 43.

Figure 28:
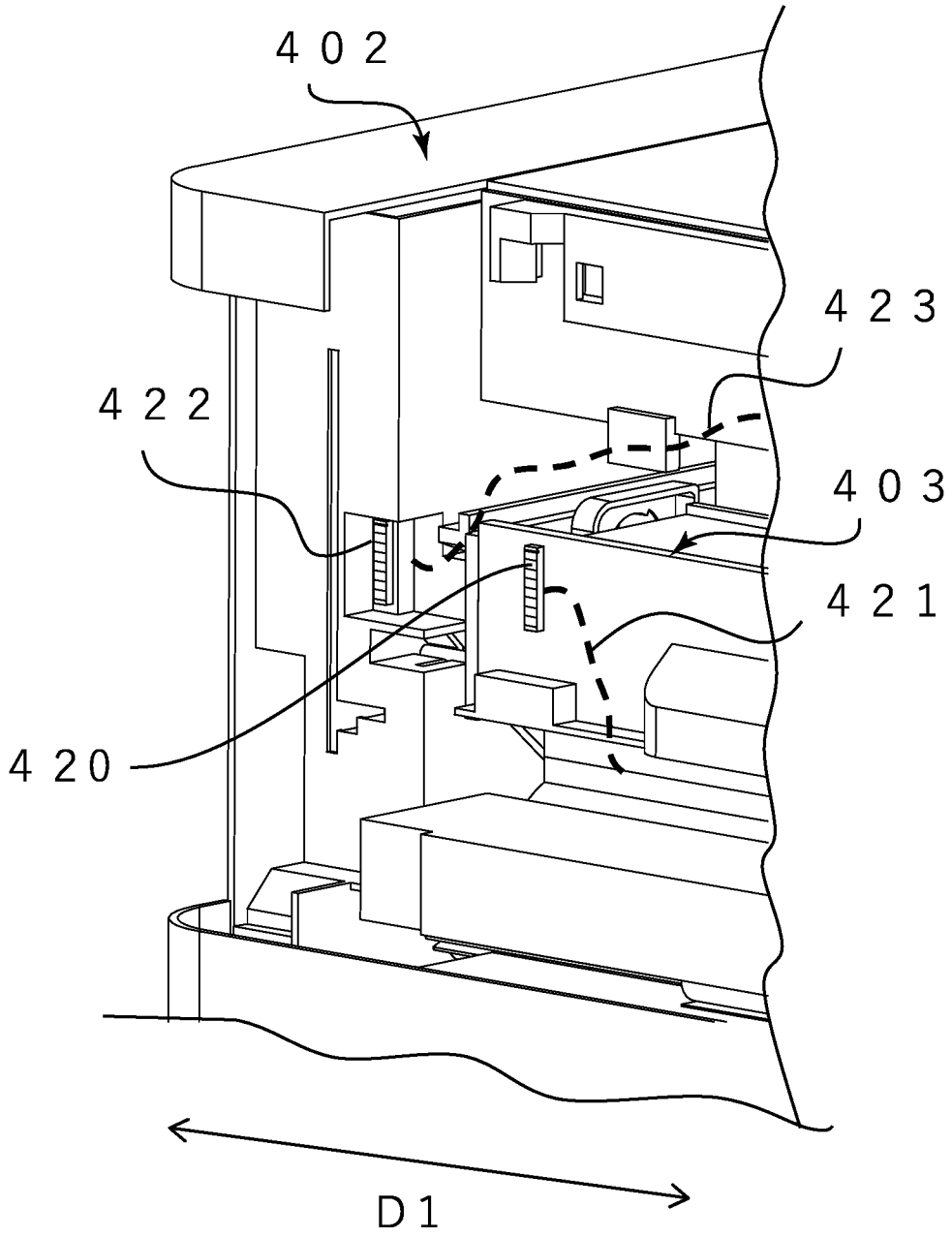
FIG. 28 is a perspective view of a modification example of the fourth embodiment.

In addition, the layout relationship of the tray contact board 420, the body contact board 422, and the intermediate contact portion 450 is not limited to the embodiment described above. For example, as illustrated in FIG. 28, the tray contact board 420 and the body contact board 422 may be arranged in the first direction D1 to be parallel to each other.

Figure 29A:
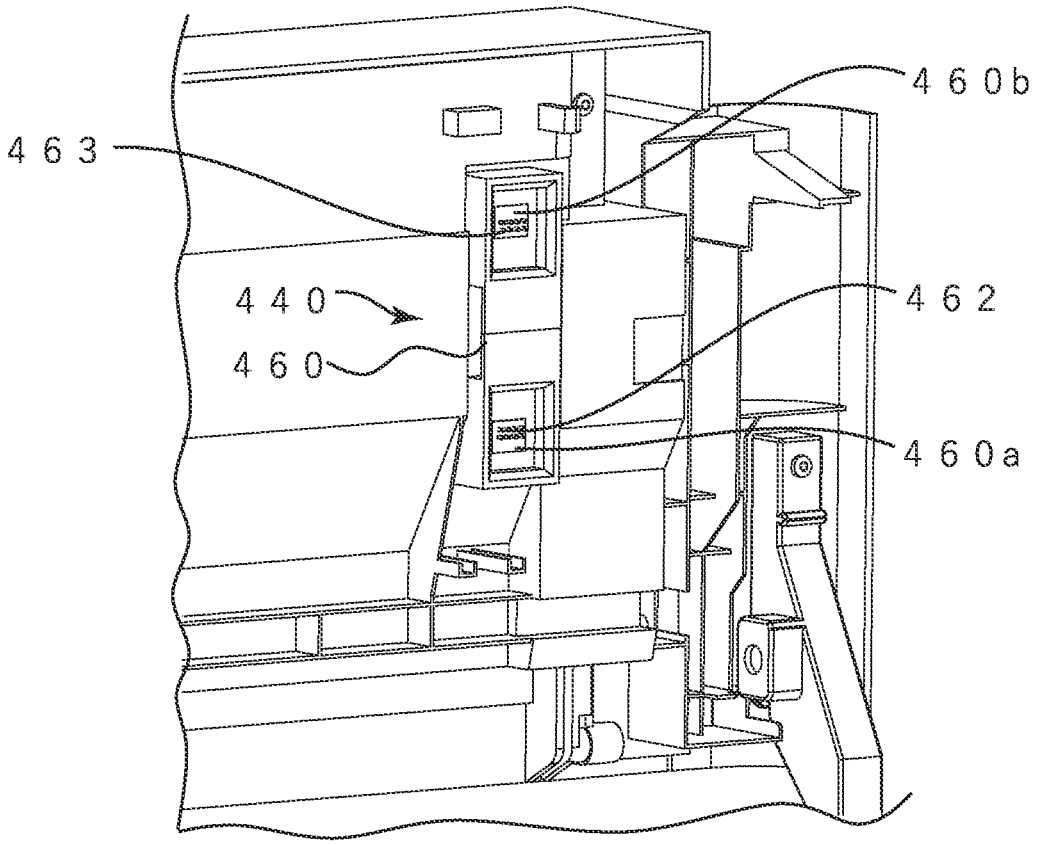
FIG. 29A is a perspective view of a tag contact connector.
Figure 29B:
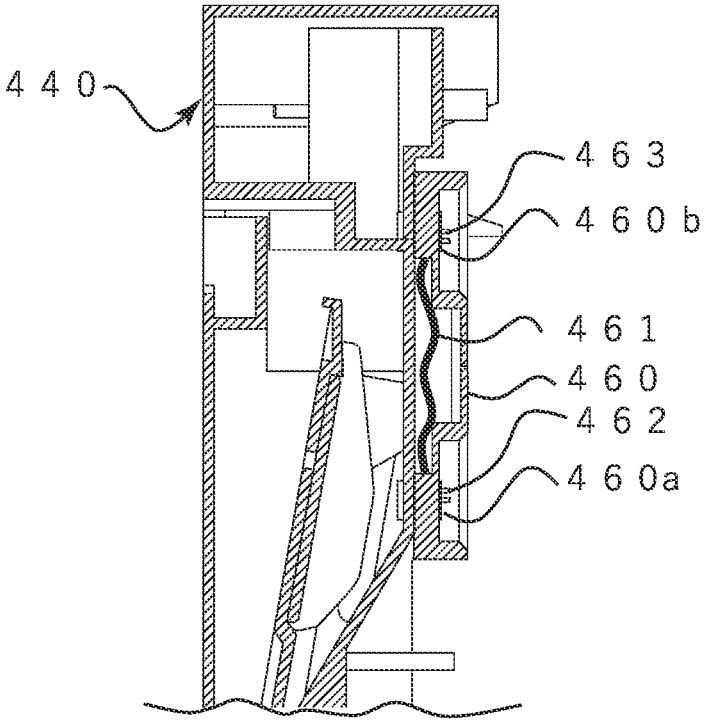
FIG. 29B is a section view of the tag contact connector.

In addition, although the body contact board 422 and the tray contact board 420 are connected to each other via the intermediate contact spring 451 of the intermediate contact portion 450 in the present embodiment, the configuration is not limited to this. For example, a tag contact connector 460 may be used instead of the intermediate contact spring 451 as illustrated in FIGS. 29A and 29B.

The tag contact connector 460 includes a first contact connector 460*a* serving as a first connector and a second contact connector 460*b* serving as a second connector. In a state in which the front door 440 is closed, the first contact connector 460*a* opposes the tray contact board 420, and the second contact connector 460*b* opposes the body contact board 422. In addition, the tag contact connector 460 includes an intermediate contact bundle wire 461 serving as a wiring portion interconnecting the first contact connector 460*a* and the second contact connector 460*b*.

The second contact connector 460*b* is disposed above the first contact connector 460*a*. The first contact connector 460*a* includes a first contact portion 462 electrically connected to the tray contact board 420, and the second contact connector 460*b* includes a second contact portion 463 electrically connected to the body contact board 422.

As described above, by using the tag contact connector 460, the size of the space occupied by the contact can be reduced. Although the tag contact connector 460 of two rows is used in the present embodiment, the tag contact connector 460 may have an arbitrary shape.

Fifth Embodiment

Next, a fifth embodiment of the present invention will be described. The fifth embodiment has a configuration in which the mechanism of pressing the cartridge tray 3 by the front door 40 is changed from the first embodiment. Therefore, the same elements as in the first embodiment will be denoted by the same reference signs or description thereof will be omitted.

Problem

Figure 30:
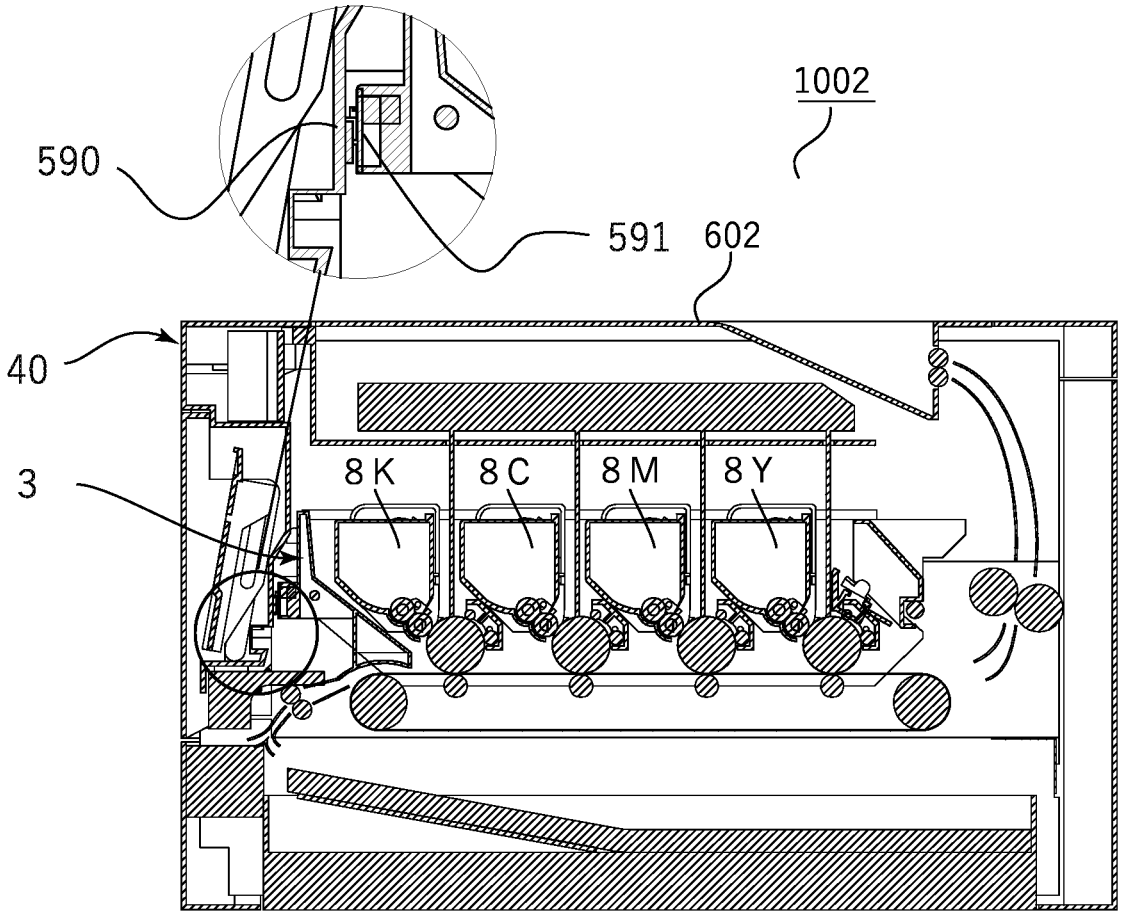
FIG. 30 is an overall section view of an image forming apparatus according to a fifth embodiment.

FIGS. 30 to 33C are diagrams illustrating an image forming apparatus 1002 serving as a comparative example FIG. 30 is an overall section view of the image forming apparatus 1002. FIG. 31A is a perspective view of the image forming apparatus 1002 in a state in which the front door 40 is open. FIG. 31B is a section view of the image forming apparatus 1002 in a state in which the front door 40 is open.

Figure 32A:
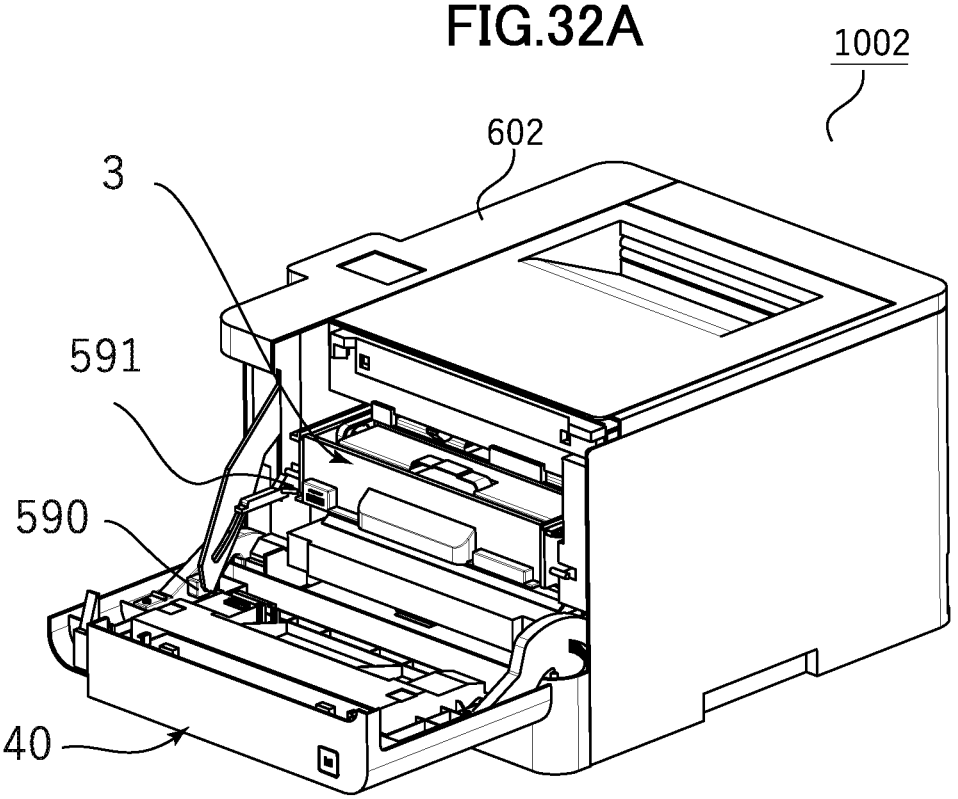
FIG. 32A is a perspective view of the image forming apparatus holding a cartridge tray positioned at an intermediate position.
Figure 32B:
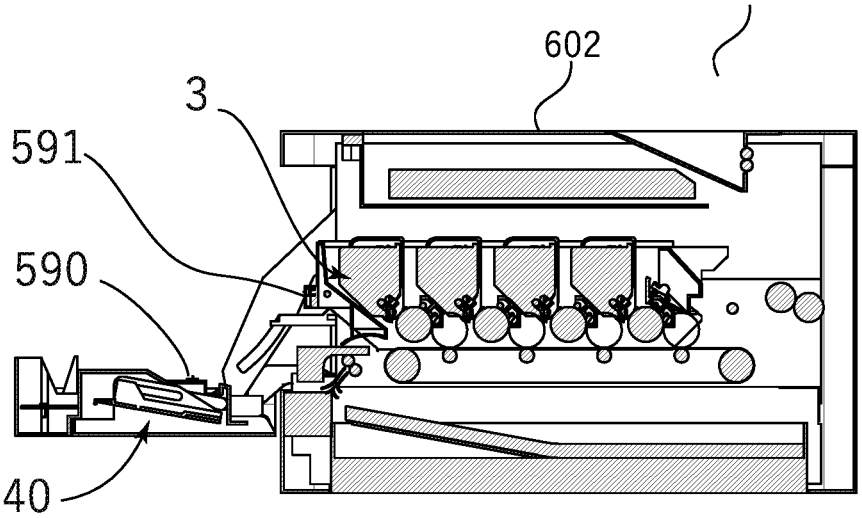
FIG. 32B is a section view of the image forming apparatus holding the cartridge tray positioned at the intermediate position.
Figure 33A:
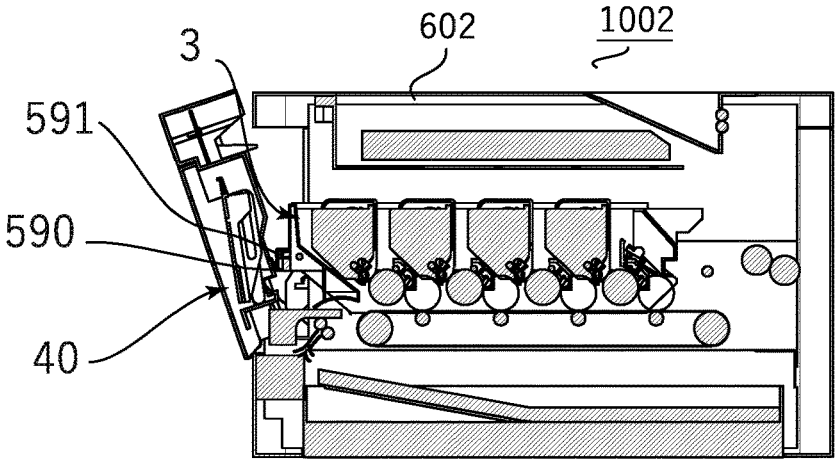
FIG. 33A is a section view of the image forming apparatus illustrating a state in which the front door is being closed.
Figure 33B:
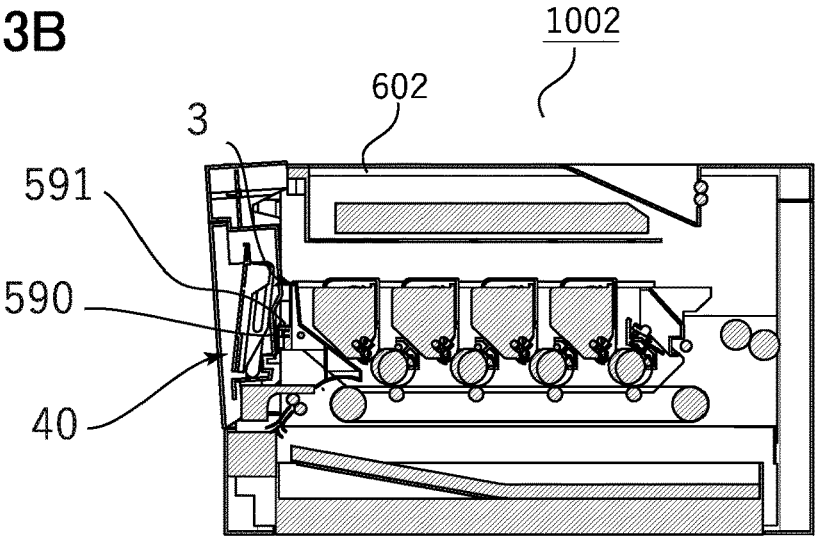
FIG. 33B is another section view of the image forming apparatus illustrating the state in which the front door is being closed.
Figure 33C:
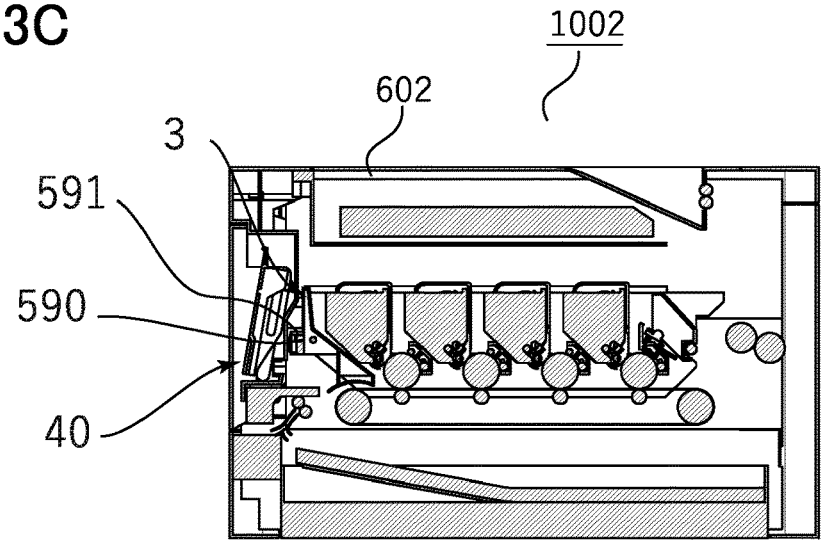
FIG. 33C is a section view of the image forming apparatus illustrating a state in which the front door has been closed.

FIG. 32A is a perspective view of the image forming apparatus 1002 holding the cartridge tray 3 positioned at an intermediate position. FIG. 32B is a section view of the image forming apparatus 1002 holding the cartridge tray 3 positioned at the intermediate position. FIGS. 33A to 33C are section views of the image forming apparatus 1002 illustrating how the front door 40 is closed.

Figure 31A:
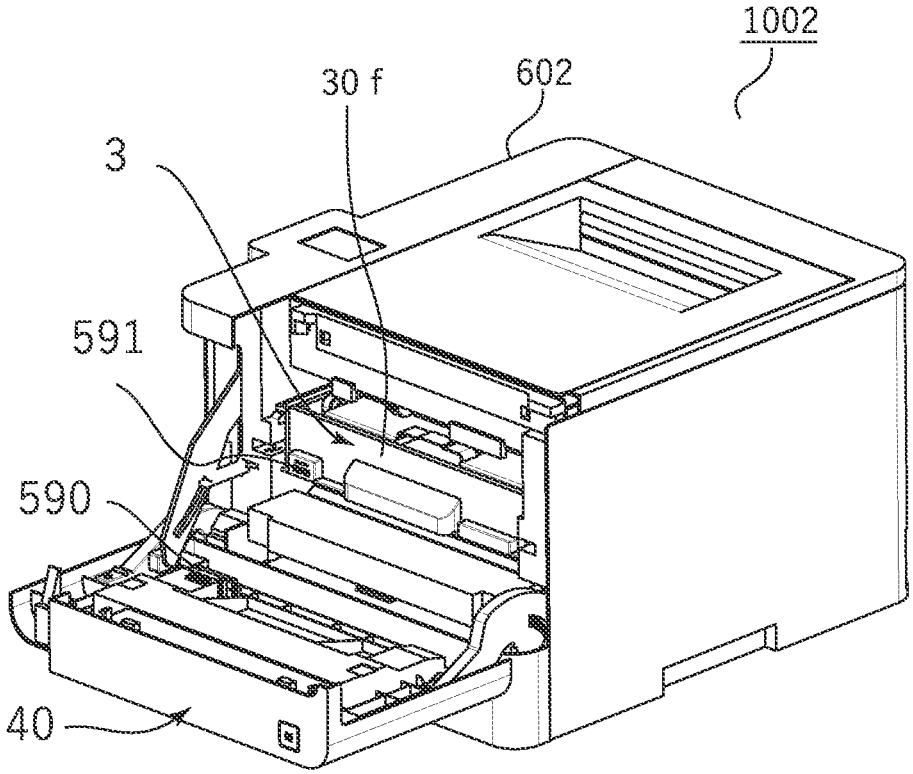
FIG. 31A is a perspective view of the image forming apparatus in a state in which the front door is open.
Figure 31B:
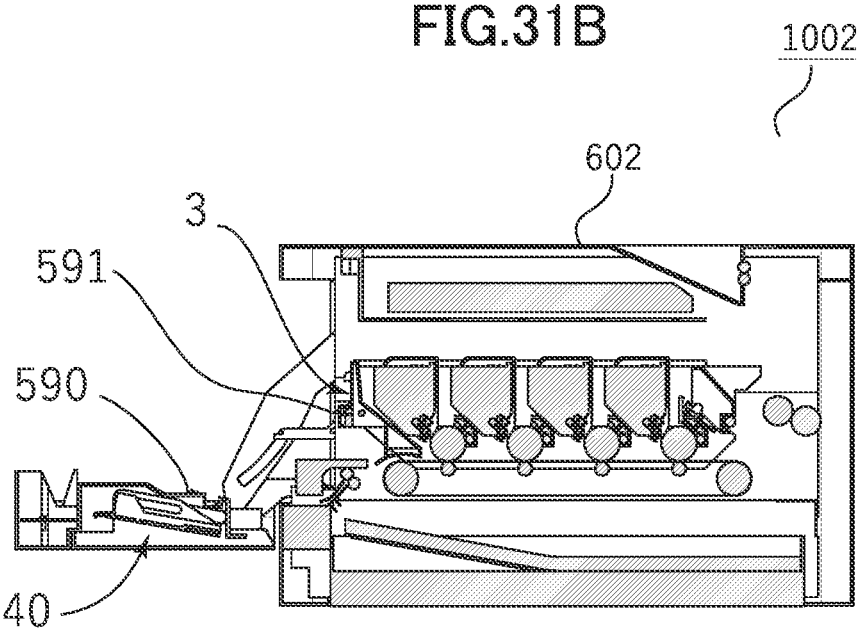
FIG. 31B is a section view of the image forming apparatus in the state in which the front door is open

The image forming apparatus 1002 serving as a comparative example includes an apparatus body 602 that holds the cartridge tray 3 attachably and detachably, and the front door 40 openably and closably supported by the apparatus body 602 as illustrated in FIGS. 30 to 31B.

A tray contact unit 591 electrically connected to the memory tags 81Y, 81M, 81C, and 81K of the respective developing cartridges illustrated in FIG. 3 is disposed on the tray front surface 30*f* of the cartridge tray 3. The tray contact unit 591 projects more to the front than the tray front surface 30*f*.

A door contact unit 590 electrically connected to the control board 43 via the tag body bundle wire 305 passing through the left hinge 201 as illustrated in FIG. 9 is disposed on the front door 40. When the front door 40 is closed, the door contact unit 590 comes into contact with the tray contact unit 591, and thus the control board 43 is electrically connected to the memory tags 81Y, 81M, 81C, and 81K illustrated in FIG. 3.

In FIGS. 29A and 29B, the cartridge tray 3 is held at the intermediate position in which the cartridge tray 3 is slightly drawn out from the attached position. That is, the cartridge tray 3 positioned at the intermediate position is not firmly attached to the apparatus body 602.

When the front door 40 is closed in this state, the door contact unit 590 collides with the tray contact unit 591 as illustrated in FIG. 30A. Then, if the front door 40 is further closed, the door contact unit 590 provided in the front door 40 presses the tray contact unit 591, and thus the cartridge tray 3 is pushed into the attached position as illustrated in FIGS. 30B and 30C.

When such an operation is performed, a large load is applied to the door contact unit 590 and the tray contact unit 591, an unintended friction occurs, and thus there is a possibility that a contact portion between the door contact unit 590 and the tray contact unit 591 is broken. When the contact portion between the door contact unit 590 and the tray contact unit 591 is broken, information of the memory tags 81Y, 81M, 81C, and 81K illustrated in FIG. 3 cannot be read.

Configuration

Figure 34A:
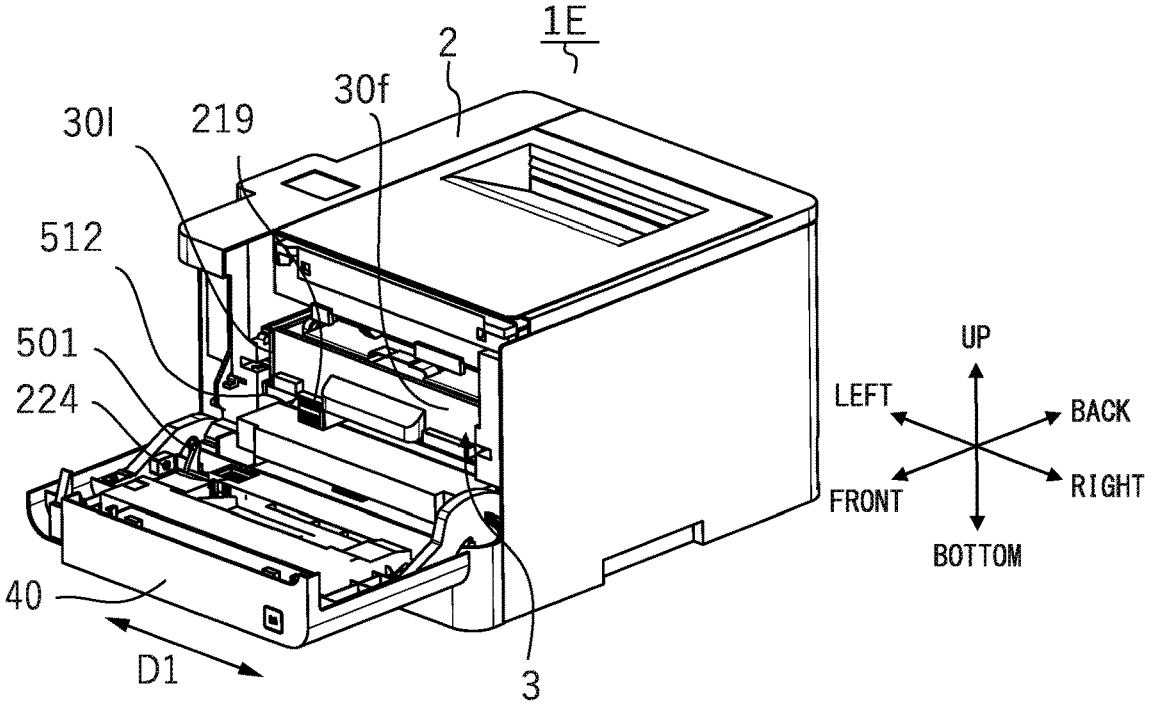
FIG. 34A is a perspective view of an image forming apparatus according to a fifth embodiment in a state in which the front door is open.
Figure 34B:
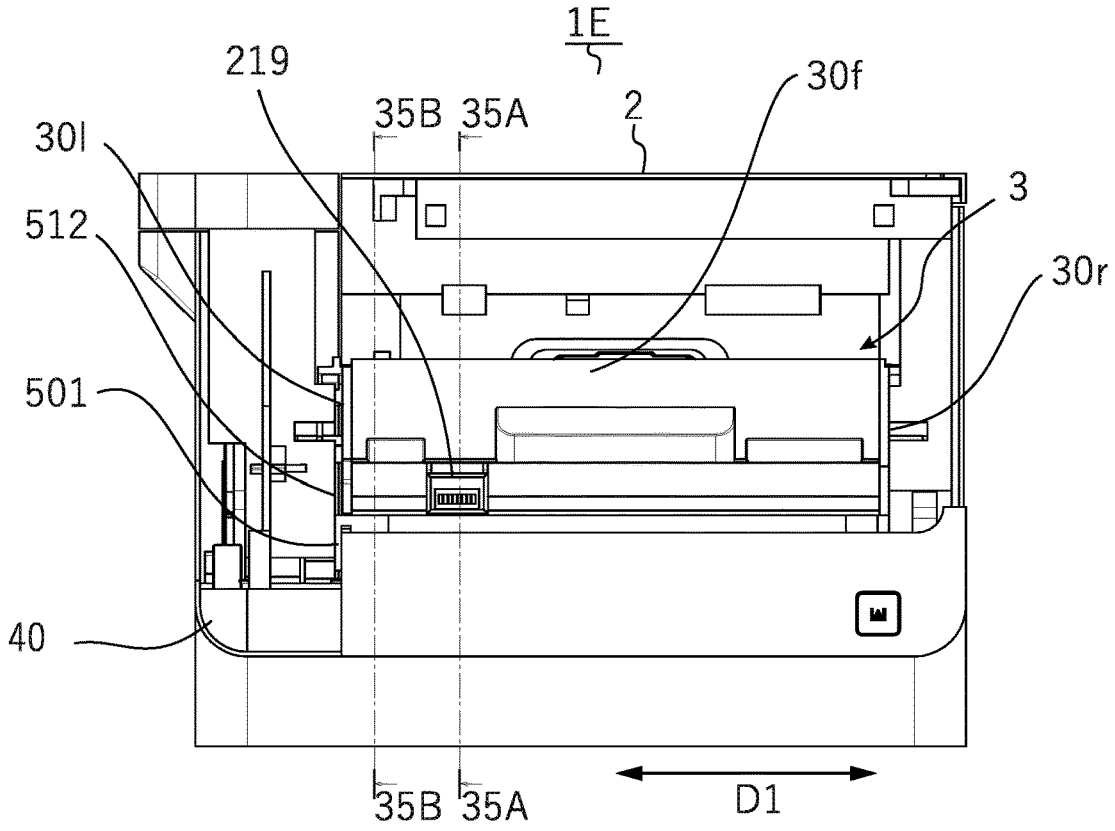
FIG. 34B is a front view of the image forming apparatus according to the fifth embodiment in the state in which the front door is open.
Figure 35A:
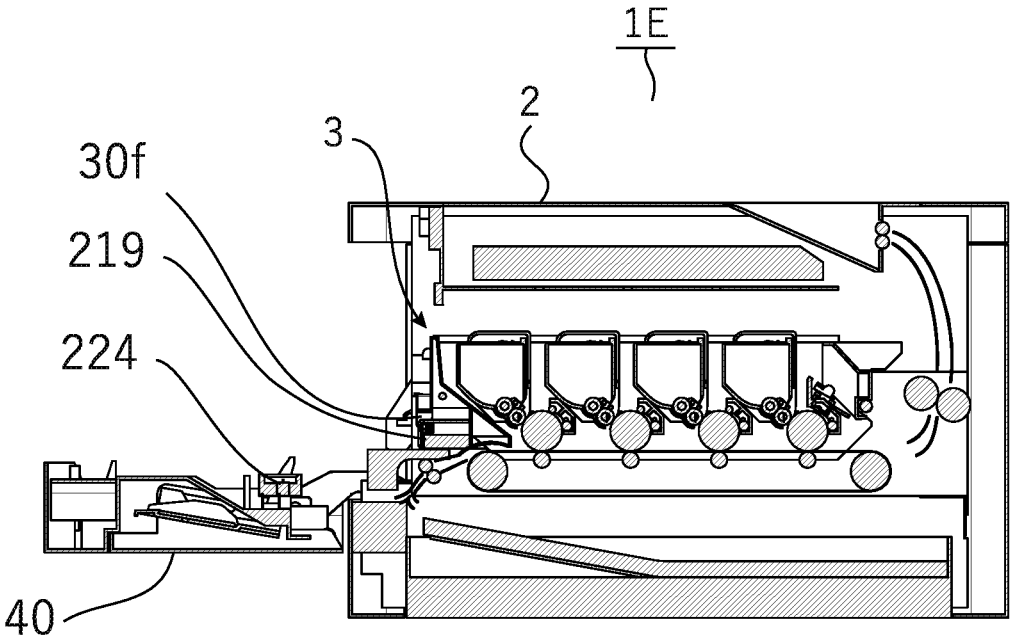
FIG. 35A is a section view taken along a line 35A-35A of FIG. 34B.
Figure 35B:
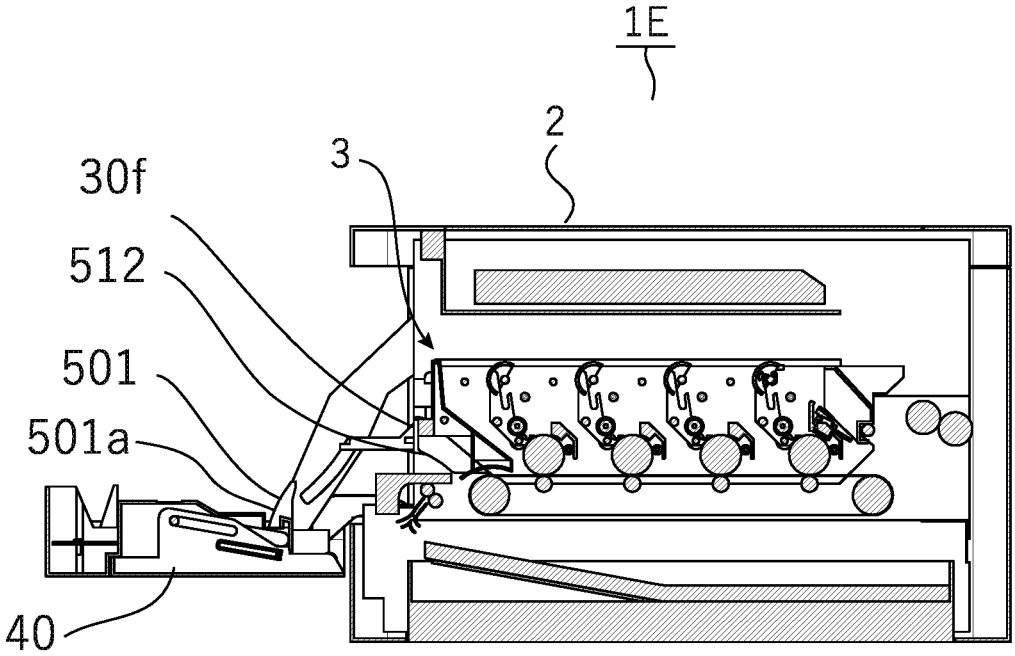
FIG. 35B is a section view taken along a line 35B-35B of FIG. 34B.
Figure 36A:
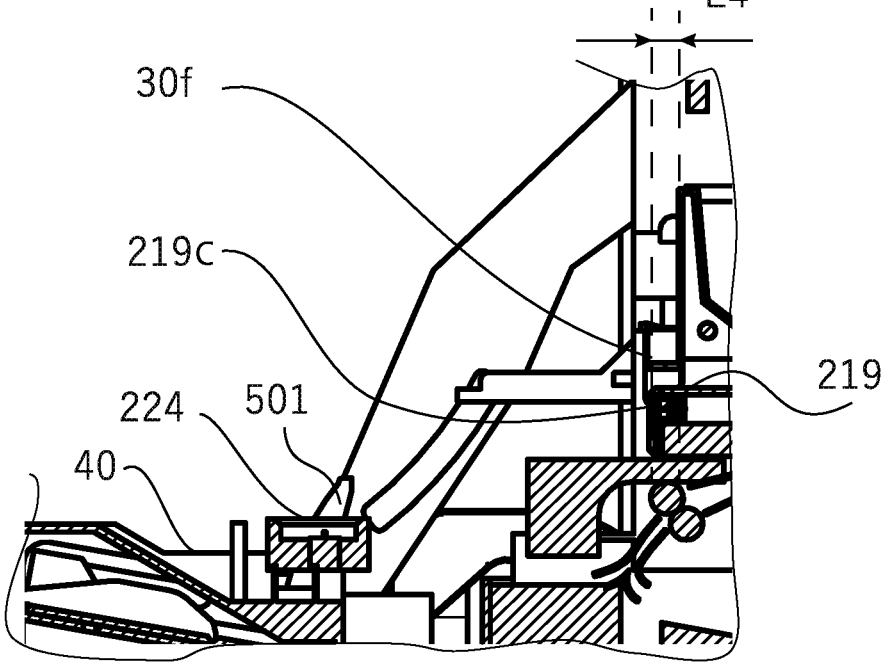
FIG. 36A is an enlarged view of a part of FIG. 35A.
Figure 36B:
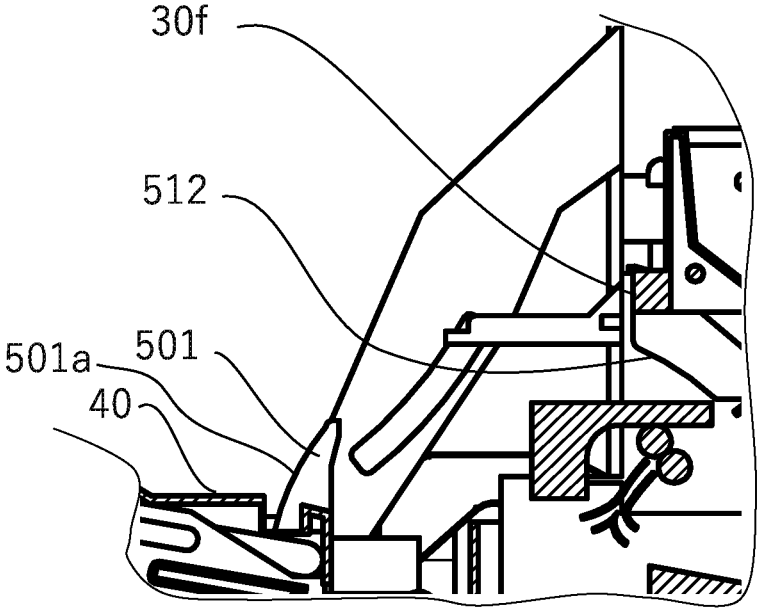
FIG. 36B is an enlarged view of a part of FIG. 35B.

Next, a configuration for solving the problem described above will be described with reference to FIGS. 34A to 41B. FIG. 34A is a perspective view of an image forming apparatus 1E in a state in which the front door 40 is open. FIG. 34B is a front view of the image forming apparatus 1E in a state in which the front door 40 is open. FIG. 35A is a section view taken along a line 35A-35A of FIG. 34B. FIG. 35B is a section view taken along a line 35B-35B of FIG. 34B. FIG. 36A is an enlarged view of a part of FIG. 35A. FIG. 36B is an enlarged view of a part of FIG. 35B. To be noted, the section taken along the line 35A-35A passes through a center portion of the tray contact unit 219.

The image forming apparatus 1E according to the present embodiment includes the apparatus body 2 and the front door 40 openably and closably supported by the apparatus body 2 as illustrated in FIGS. 34A to 36B. The cartridge tray 3 is attached to the apparatus body 2 such that the cartridge tray 3 can be drawn out, and the tray contact unit 219 is provided on the tray front surface 30*f* of the cartridge tray 3. A contact portion 219*c* of the tray contact unit 219 is disposed at a position separated backward from the tray front surface 30*f* by a distance L4. To be noted, the tray front surface 30*f* may or may not include the pressed portion 751.

The front door 40 includes the door contact unit 224 and a front door assisting plate 501. The front door assisting plate 501 serving as a pressing portion projects upward when the front door 40 is positioned at the open position, and projects toward the apparatus body 2 when the front door 40 is positioned at the closed position. In addition, the front door assisting plate 501 is disposed in a position corresponding to the tray left side surface 301 of the cartridge tray 3 in the first direction D1. The front door 40 includes a curved surface 501*a* on the upper surface side thereof.

In addition, an inclined surface portion 512 is formed in the tray left side surface 301 of the cartridge tray 3. The inclined surface portion 512 is inclined so as to extend backward and downward from the same surface as the tray front surface 30*f*. The inclined surface portion 512 is configured to be capable of accommodating the front door assisting plate 501 when the cartridge tray 3 is positioned at the attached position and the front door 40 is positioned at the closed position. The inclined surface shape of the inclined surface portion 512 follows the curved surface 501*a* of the front door assisting plate 501.

In addition, the front door assisting plate 501 is disposed in a position different from the tray contact unit 219 in the first direction D1 as illustrated in FIGS. 34A and 34B. As a result of this, the closing operation of the front door 40 bringing the front door assisting plate 501 into contact with the tray contact unit 219 can be reliably prevented.

Figure 37:
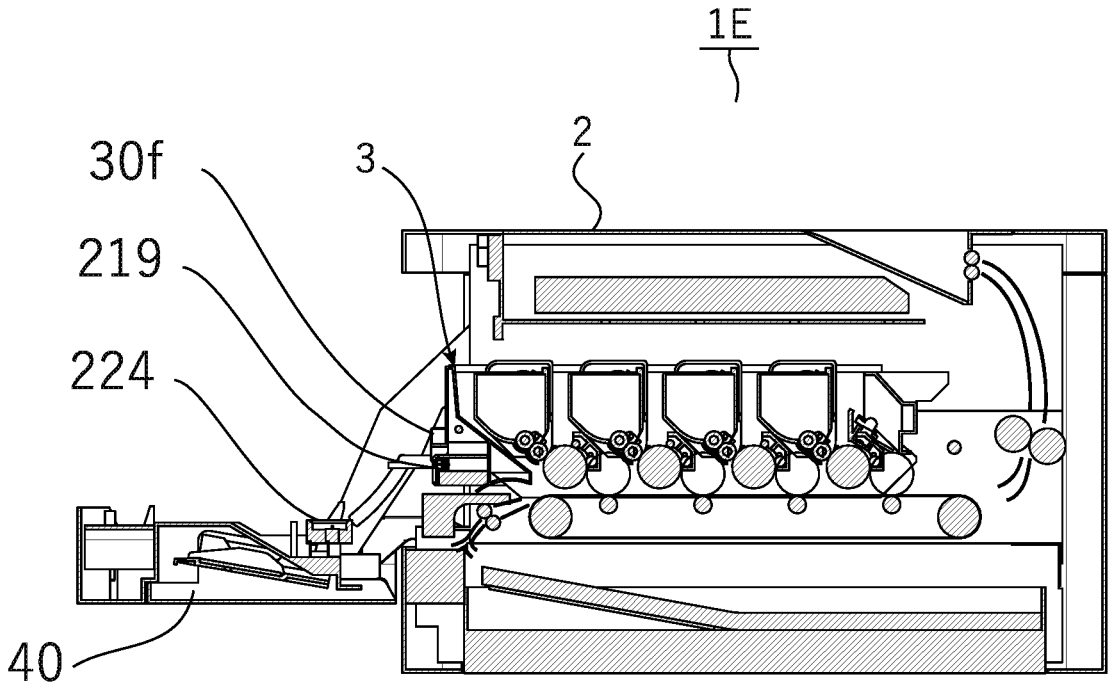
FIG. 37 is a section view of the image forming apparatus illustrating a state in which the cartridge tray is held at the intermediate position.

FIG. 37 is a section view of the image forming apparatus 1E illustrating how the cartridge tray 3 is held at the intermediate position serving as a third position between the attached position and the drawn-out position. That is, the cartridge tray 3 positioned at the intermediate position is not firmly attached to the apparatus body 2.

Figure 38A:
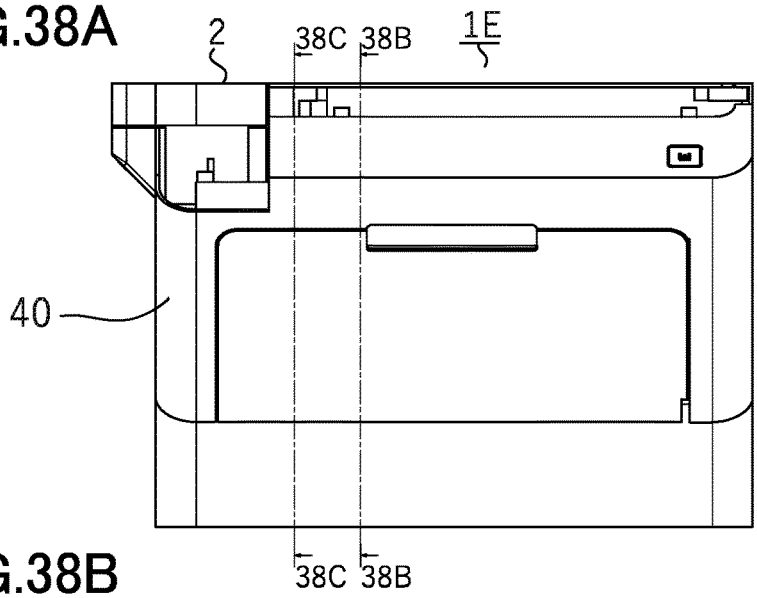
FIG. 38A is a front view of the image forming apparatus in a state in which the front door is slightly open.
Figure 38B:
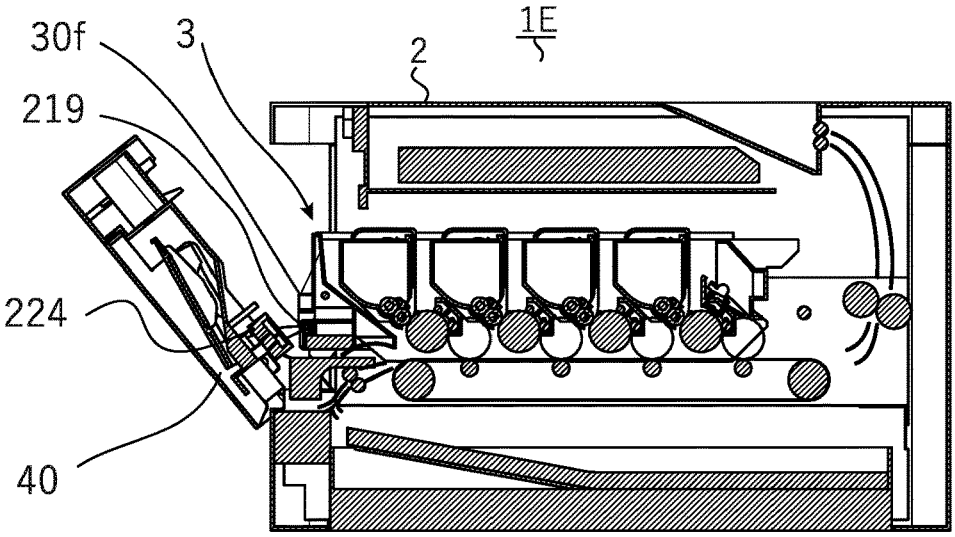
FIG. 38B is a section view taken along a line 38B-38B of FIG. 38A.
Figure 38C:
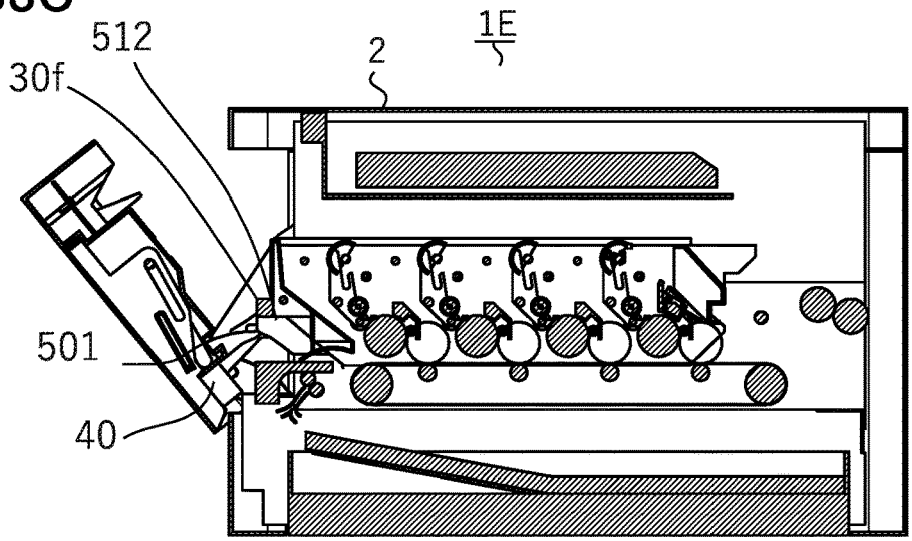
FIG. 38C is a section view taken along a line 38C-38C of FIG. 38A.
Figure 39:
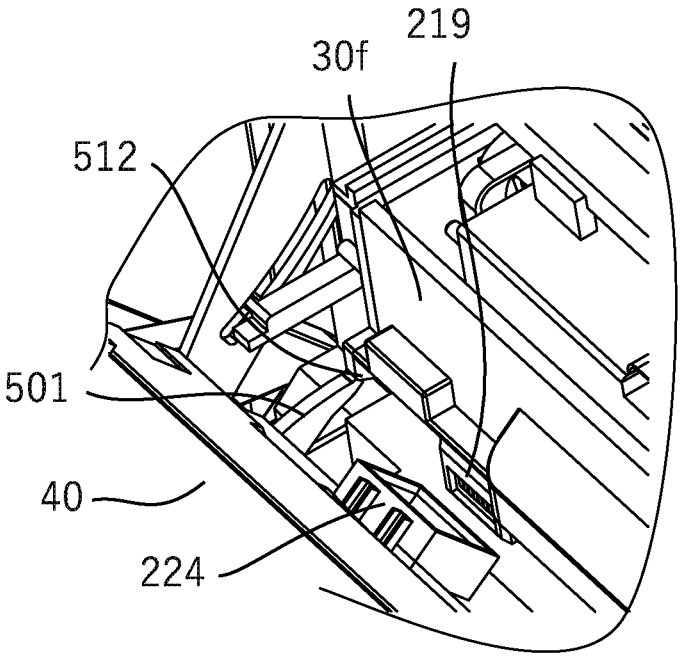
FIG. 39 is an enlarged perspective view of the tray contact unit and the door contact unit in the state in which the front door is slightly open.

A case where the front door 40 is closed from the open position to the closed position in a state in which the cartridge tray 3 is positioned at the intermediate position will be described below. FIG. 38A is a front view of the image forming apparatus 1E in a state in which the front door 40 is slightly opened. FIG. 38B is a section view taken along a line 38B-38B of FIG. 38A. FIG. 38C is a section view taken along a line 38C-38C of FIG. 38A. FIG. 39 is an enlarged perspective view of the tray contact unit 219 and the door contact unit 224 in the state in which the front door 40 is slightly opened.

Figure 40A:
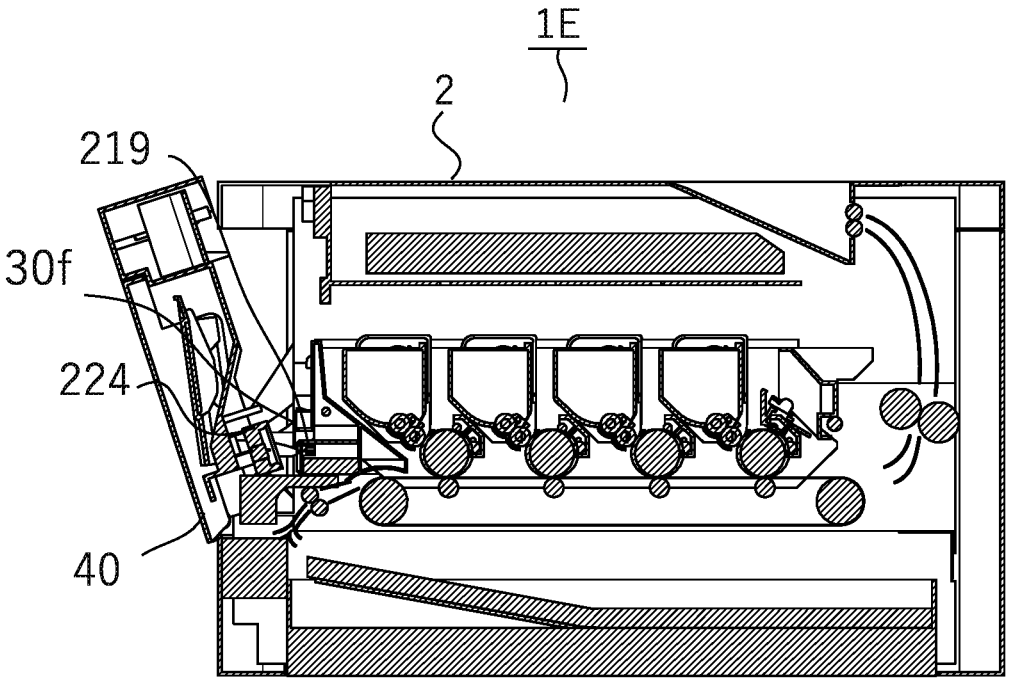
FIG. 40A is a section view of the image forming apparatus illustrating a section passing through the tray contact unit in a state in which the front door is closed further.
Figure 40B:
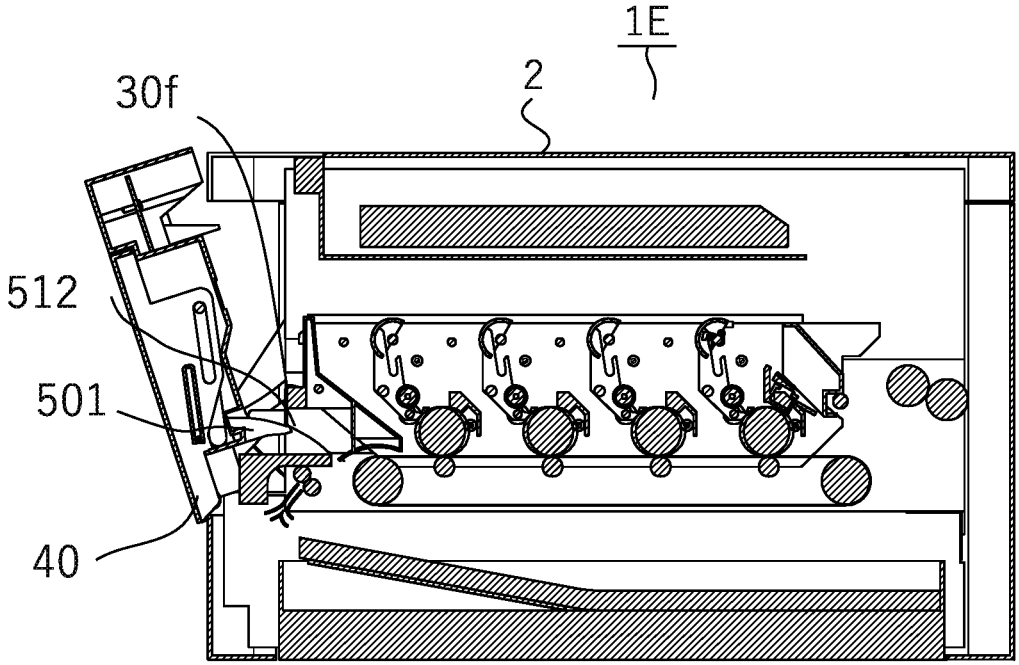
FIG. 40B is a section view of the image forming apparatus illustrating a section near a front door assisting plate in the state in which the front door is closed further.
Figure 41A:
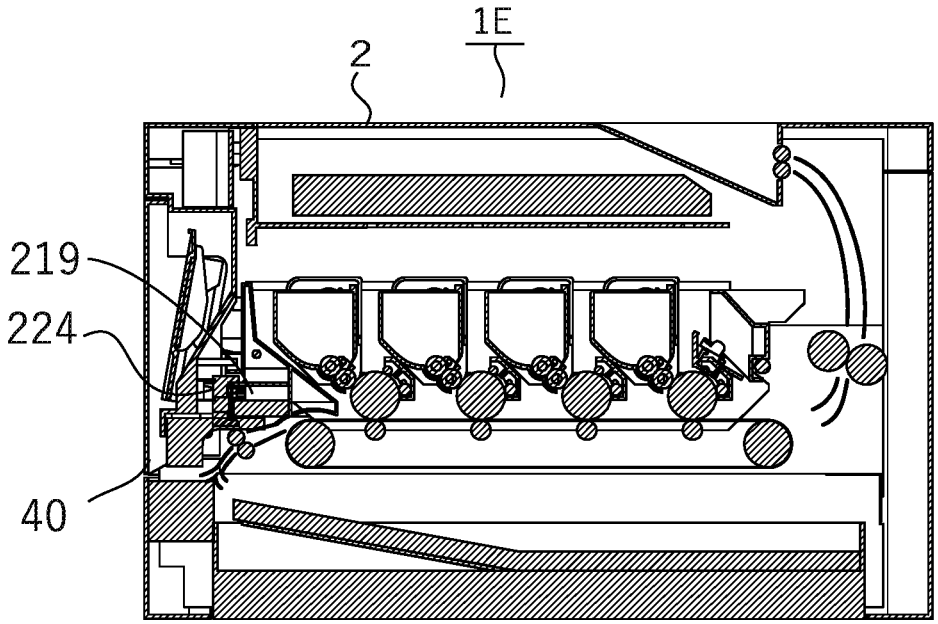
FIG. 41A is a section view of the image forming apparatus illustrating a section passing through the tray contact unit in a state in which the front door is positioned at the closed position.
Figure 41B:
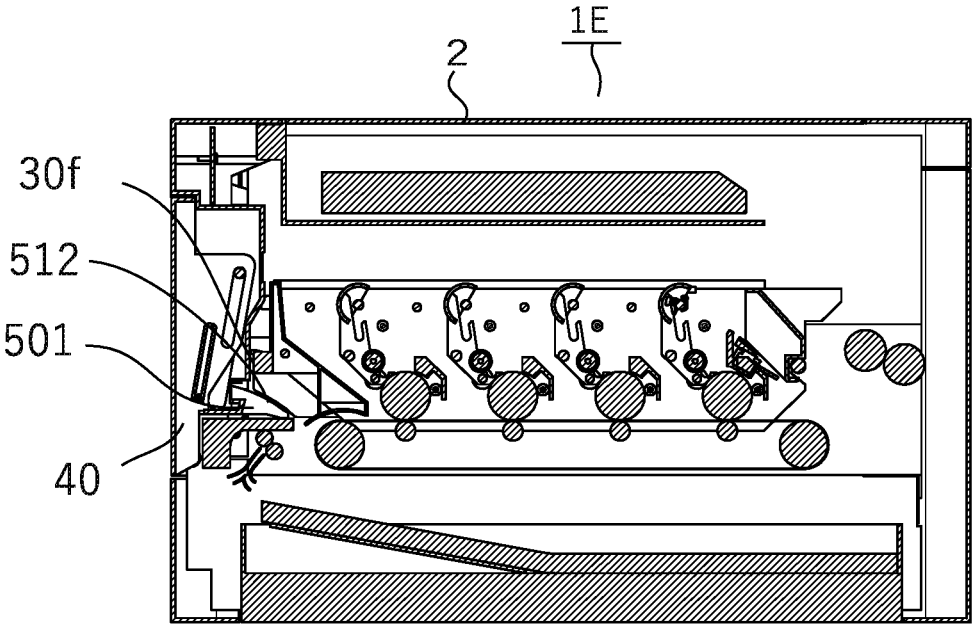
FIG. 41B is a section view of the image forming apparatus illustrating a section near the front door assisting plate in the state in which the front door is positioned at the closed position.

FIG. 40A is a section view of the image forming apparatus 1E in a state in which the front door 40 is further closed illustrating a section passing through the tray contact unit 219. FIG. 40B is a section view of the image forming apparatus 1E in the state in which the front door 40 is further closed illustrating a section near the front door assisting plate 501. FIG. 41A is a section view of the image forming apparatus 1E in a state in which the front door 40 is positioned at the closed position illustrating a section passing through the tray contact unit 219. FIG. 41B is a section view of the image forming apparatus 1E in a state in which the front door 40 is positioned at the closed position illustrating a section near the front door assisting plate 501.

As illustrated in FIGS. 37 to 39, when the user performs the closing operation of the front door 40 in a state in which the cartridge tray 3 is positioned at the intermediate position, the front door assisting plate 501 collides with the inclined surface portion 512 of the cartridge tray 3. In this case, the front door assisting plate 501 does not collide with any other members of the front door 40 and the cartridge tray 3 before colliding with the inclined surface portion 512 of the cartridge tray 3. That is, the front door assisting plate 501 collides with the inclined surface portion 512 of the cartridge tray 3 before the door contact unit 224 comes into contact with the tray contact unit 219.

When the closing operation of the front door 40 further progresses, as illustrated in FIGS. 40A and 40B, the front door assisting plate 501 presses the inclined surface portion 512 of the cartridge tray 3, and the cartridge tray 3 moves toward the attached position. Also in this state, the door contact unit 224 does not come into contact with the tray contact unit 219.

Then, as illustrated in FIGS. 41A and 41B, when the front door moves to the closed position, the front door assisting plate 501 causes the cartridge tray 3 to reach the attached position, and the door contact unit 224 comes into contact with the tray contact unit 219. At this time, the front door assisting plate 501 is slightly separated from the inclined surface portion 512 such that a large load is not applied to the front door assisting plate 501 and the cartridge tray 3. This is realized by the curvature of the curved surface 501*a* of the front door assisting plate 501 and the inclined surface shape of the inclined surface portion 512.

To be noted, a positioning mechanism that positions the cartridge tray 3 in the attached position when the cartridge tray 3 is positioned at the attached position and the front door 40 is positioned at the closed position may be additionally provided.

Effect

As described above, in the present embodiment, a configuration in which the front door assisting plate 501 can press the cartridge tray 3 when the closing operation of closing the front door 40 from the open position to the closed position is employed. Further, the door contact unit 224 and the tray contact unit 219 do not come into contact with each other until the front door 40 reaches the closed position. Therefore, for example, even in the case where the cartridge tray 3 is held in the intermediate position, a large load or friction acting on the door contact unit 224 and the tray contact unit 219 can be reduced, and thus breakage of the contact units can be reduced. As described above, according to the present embodiment, an embodiment of an image forming apparatus in which breakage of contact units is suppressed can be provided.

In addition, the cartridge tray 3 positioned at the intermediate position can be reliably moved to the attached position where image formation can be performed, and thus occurrence of an error in image formation can be reduced. In addition, when the cartridge tray 3 is positioned at the attached position and the front door 40 is positioned at the closed position, since the front door assisting plate 501 is slightly separated from the inclined surface portion 512, a large load is not applied to the front door assisting plate 501 and the cartridge tray 3, and therefore breakage can be suppressed.

To be noted, although the front door assisting plate 501 is separated from the inclined surface portion 512 when the cartridge tray 3 is positioned at the attached position and the front door 40 is positioned at the closed position in the present embodiment, the configuration is not limited to this. For example, a configuration in which the front door assisting plate 501 abuts the inclined surface portion 512 when the cartridge tray 3 is positioned at the attached position and the front door 40 is positioned at the closed position may be employed. In this case, at least one of the front door assisting plate 501 and the inclined surface portion 512 is preferably formed from an elastic member. As a result of this, the cartridge tray 3 can be reliably positioned at the attached position while suppressing breakage of the front door assisting plate 501 and the inclined surface portion 512.

In addition, although the door contact unit 224 and the tray contact unit 219 are configured to not come into contact with each other until the front door 40 reaches the closed position in the present embodiment, the configuration is not limited to this. For example, the door contact unit 224 may come into contact with the tray contact unit 219 in a state in which the front door 40 is positioned further on the front side than the closed position as long as a large load or friction does not act on the door contact unit 224 and the tray contact unit 219.

In addition, although the inclined surface portion 512 and the tray contact unit 219 are disposed in a lower portion of the cartridge tray 3 in the present embodiment, the configuration is not limited to this. For example, the inclined surface portion 512 and the tray contact unit 219 may be disposed in an upper portion of the cartridge tray 3.

In addition, although the contact portion 219*c* of the tray contact unit 219 is disposed in a position further on the back side than the tray front surface 30*f* in the present embodiment, the configuration is not limited to this. The contact portion 219*c* of the tray contact unit 219 may be disposed in any position as long as the front door 40 does not come into contact with the door contact unit 224 until the front door 40 reaches the closed position in the course of the closing operation of the front door 40 in a state in which the cartridge tray 3 is positioned at the intermediate position. For example, the tray contact unit 219 may be disposed in a position closer to the front door 40 if the door contact unit 224 is disposed in a position further on the multi-tray frame member 212 side than the position illustrated in FIG. 39, that is, a position further downstream in the door opening direction than the tray contact unit 219.

To be noted, all the embodiments described above may be arbitrarily combined with one another.

Exemplification of Configurations (or Concepts) Corresponding to Disclosure of Embodiments Examples of configurations (or concepts) corresponding to the disclosure of the first to fifth embodiments will be described below. To be noted, the disclosure of the first to fifth embodiments described above are not limited to just the examples shown below, and configurations not exemplified below are also disclosed.

Configuration A

Configuration A1

For example, as illustrated in FIGS. 1 to 17, an image forming apparatus according to Configuration A1 includes an apparatus body including a control board;

a draw-out unit including a photosensitive drum, a developing unit, and a unit contact, the photosensitive drum being configured to bear a toner image and rotate about a rotation axis, the developing unit including a developing roller and a memory, the developing roller being configured to bear toner and supply the toner to the photosensitive drum, the memory being configured to store information, the unit contact being electrically connected to the memory of the developing unit, the draw-out unit being configured to be drawn out of the apparatus body from a first position in which the developing unit is used for an image formation to a second position in which the developing unit is exposed to an outside of the apparatus body; and a door supported by the apparatus body so as to be movable between a closed position where the door closes an opening portion of the apparatus body and an open position where the door opens the opening portion, the draw-out unit being configured to pass through the opening portion in a case where the draw-out unit is drawn out of the apparatus body the door positioned at the closed position being configured to face the draw-out unit.

The door includes a door contact electrically connected to the control board and configured to be in contact with and electrically connected to the unit contact in a case where the door is positioned at the closed position.

The draw-out unit includes a facing surface configured to face the door positioned at the closed position and a grip portion provided at a center portion of the facing surface in an axial direction of the rotation axis.

The unit contact is provided in a region outside an end surface of the grip portion in the axial direction and below the grip portion in a vertical direction.

Configuration A2

An image forming apparatus according to Configuration A2 is the image forming apparatus according to Configuration A1 further including:

a stacking portion configured to be opened and closed with respect to the door and on which a sheet is stacked; and a holding portion configured to hold the stacking portion so that the stacking portion is opened with respect to the door.

The stacking portion includes a stacking surface on which the sheet is stacked, and an engagement portion configured to project from the stacking surface toward the apparatus body and engage with the holding portion, and The unit contact is disposed between the end surface of the grip portion and the engagement portion in the axial direction.

Configuration A3

An image forming apparatus according to Configuration A3 is the image forming apparatus according to Configuration A2 in which the door includes a projection portion configured to accommodate the engagement portion and project toward the apparatus body, and the unit contact is disposed between the grip portion and the projection portion in the axial direction.

Configuration A4

An image forming apparatus according to Configuration A4 is the image forming apparatus according to Configuration A2 in which the door includes a rib disposed between the engagement portion and the end surface of the grip portion in the axial direction and projecting toward the apparatus body, and the unit contact is disposed between the engagement portion and the rib in the axial direction.

Configuration A5

An image forming apparatus according to Configuration A5 is the image forming apparatus according to Configuration A2 in which the holding portion is slidably supported by the apparatus body and the engagement portion.

Configuration A6

An image forming apparatus according to Configuration A6 is the image forming apparatus according to Configuration A5 in which the engagement portion has an elongated hole portion configured to slidably engage with the holding portion.

Configuration A7

An image forming apparatus according to Configuration A7 is the image forming apparatus according to Configuration A1 in which the door includes a protrusion portion configured to project toward the apparatus body, the protrusion portion is configured not to interfere with a draw-out unit applicable to the apparatus body, and the unit contact is disposed on the same side as the protrusion portion with respect to the grip portion in the axial direction.

Configuration B

Configuration B1

For example, as illustrated in FIGS. 19 to 24B, an image forming apparatus according to Configuration B1 includes:

an apparatus body including a control board and a grounding portion that is grounded;

a draw-out unit including a photosensitive drum, a developing unit, and a unit contact, the photosensitive drum being configured to bear a toner image and rotate about a rotation axis, the developing unit including a developing roller and a memory, the developing roller being configured to bear toner and supply the toner to the photosensitive drum, the memory being configured to store information, the unit contact being electrically connected to the memory of the developing unit, the draw-out unit being configured to be drawn out of the apparatus body from a first position in which the developing unit is used for an image formation to a second position in which the developing unit is exposed to an outside of the apparatus body;

a door supported by the apparatus body so as to be movable between a closed position where the door closes an opening portion of the apparatus body and an open position where the door opens the opening portion, the draw-out unit being configured to pass through the opening portion in a case where the draw-out unit is drawn out of the apparatus body, the door positioned at the closed position being configured to face the draw-out unit;

a door contact provided in the door; and a conductive member provided so as not to be electrically connected to an electric path from the door contact to the control board.

The door contact is configured to be electrically connected to the control board, come into contact with and be electrically connected to the unit contact in a case where the door is positioned at the closed position, and be exposed to the outside of the image forming apparatus without being in contact with the unit contact in a case where the door is positioned at the open position.

The conductive member includes a first end portion and a second end portion, the first end portion being disposed close to the door contact and exposed to the outside of the image forming apparatus in a case where the door is positioned at the open position, the second end portion being electrically connected to the grounding portion.

Configuration B2

An image forming apparatus according to Configuration B2 is the image forming apparatus according to Configuration B1 in which the first end portion of the conductive member is positioned above a contact portion of the door contact in the case where the door is positioned at the open position.

Configuration B3

An image forming apparatus according to Configuration B3 is the image forming apparatus according to Configuration B1 further including:

a first hinge and a second hinge that are configured to openably and closably support the door with respect to the apparatus body; and a bundle wire configured to interconnect the door contact and the control board.

The grounding portion includes an urging portion configured to urge the door in a direction to close the door with respect to the apparatus body.

The first hinge and the second hinge are disposed at different positions in an axial direction of the rotation axis.

Both the urging portion and the bundle wire are disposed at the first hinge.

Configuration B4

An image forming apparatus according to Configuration B4 is the image forming apparatus according to Configuration B3 in which the conductive member is disposed above and along the bundle wire.

Configuration B5

An image forming apparatus according to Configuration B5 is the image forming apparatus according to Configuration B3 in which the urging portion includes a tension spring.

Configuration B6

An image forming apparatus according to Configuration B6 is the image forming apparatus according to Configuration B3 in which the urging portion includes a torsion coil spring.

Configuration C

Configuration C1

For example, as illustrated in FIGS. 25 to 29B, an image forming apparatus according to Configuration C1 includes:

an apparatus body including a control board;

a draw-out unit including a photosensitive drum, a developing unit, and a unit contact, the photosensitive drum being configured to bear a toner image and rotate about a rotation axis, the developing unit including a developing roller and a memory, the developing roller being configured to bear toner and supply the toner to the photosensitive drum, the memory being configured to store information, the unit contact being electrically connected to the memory of the developing unit, the draw-out unit being configured to be drawn out of the apparatus body from a first position in which the developing unit is used for an image formation to a second position in which the developing unit is exposed to an outside of the apparatus body; and a door supported by the apparatus body so as to be movable between a closed position where the door closes an opening portion of the apparatus body and an open position where the door opens the opening portion, the draw-out unit being configured to pass through the opening portion in a case where the draw-out unit is drawn out of the apparatus body, the door positioned at the closed position being configured to face the draw-out unit.

The apparatus body includes a body contact electrically connected to the control board and provided at a position opposing the door positioned at the closed position.

The door includes a first contact and a second contact electrically connected to the first contact.

The first contact is configured to come into contact with and be electrically connected to the unit contact in a case where the door is positioned at the closed position, and be exposed to the outside of the image forming apparatus without being in contact with the unit contact in a case where the door is positioned at the open position.

The second contact is configured to come into contact with and be electrically connected to the body contact in a case where the door is positioned at the closed position, and be exposed to the outside of the image forming apparatus without being in contact with the unit contact in a case where the door is positioned at the open position.

Configuration C2

An image forming apparatus according to Configuration C2 is the image forming apparatus according to Configuration C1 in which the draw-out unit includes a unit holder configured to hold the photosensitive drum and the developing unit, and the unit contact is provided in the unit holder.

Configuration C3

An image forming apparatus according to Configuration C3 is the image forming apparatus according to Configuration C1 in which the apparatus body includes a grounding member that is grounded, and the body contact is disposed in the vicinity of the grounding member.

Configuration C4

An image forming apparatus according to Configuration C4 is the image forming apparatus according to Configuration C1 including an elastic member having conductivity and elasticity that is provided in the door and includes the first contact and the second contact.

When the door is positioned at the closed position, the elastic member is elastically deformed such that the first contact is in pressure contact with the unit contact and the second contact is in pressure contact with the body contact.

Configuration C5

An image forming apparatus according to Configuration C5 is the image forming apparatus according to Configuration C1 including a first contact that is provided in the door and includes the first contact, a second contact that is provided in the door and includes the second contact, and a wiring portion configured to interconnect the first connector and the second connector.

Configuration D

Configuration D1

For example, as illustrated in FIGS. 30 to 41B, an image forming apparatus according to Configuration D1 includes:

an apparatus body including a control board;

a draw-out unit including a photosensitive drum, a developing unit, and a unit contact, the photosensitive drum being configured to bear a toner image and rotate about a rotation axis, the developing unit including a developing roller and a memory, the developing roller being configured to bear toner and supply the toner to the photosensitive drum, the memory being configured to store information, the unit contact being electrically connected to the memory of the developing unit, the draw-out unit being configured to be drawn out of the apparatus body from a first position in which the developing unit is used for an image formation to a second position in which the developing unit is exposed to an outside of the apparatus body; and a door supported by the apparatus body so as to be movable between a closed position where the door closes an opening portion of the apparatus body and an open position where the door opens the opening portion, the draw-out unit being configured to pass through the opening portion in a case where the draw-out unit is drawn out of the apparatus body, the door positioned at the closed position being configured to face the draw-out unit.

The unit contact is provided on a surface of the draw-out unit that faces the door positioned at the closed position.

The door includes a door contact configured to be electrically connected to the control board and a pressing portion that is capable of pressing the draw-out unit when the door is closed from the open position to the closed position.

When the draw-out unit is positioned at a third position between the first position and the second position and the door is closed from the open position to the closed position, the pressing portion abuts the draw-out unit and presses the draw-out unit toward the first position before the door contact comes into contact with the unit contact.

Configuration D2

An image forming apparatus according to Configuration D2 is the image forming apparatus according to Configuration D1 in which the pressing portion is configured to not abut the draw-out unit when the draw-out unit is positioned at the first position and the door is positioned at the closed position.

Configuration D3

An image forming apparatus according to Configuration D3 is the image forming apparatus according to Configuration D1 in which the draw-out unit includes a recess portion capable of accommodating the pressing portion when the draw-out unit is positioned at the first position and the door is positioned at the closed position.

Configuration D4

An image forming apparatus according to Configuration D4 is the image forming apparatus according to Configuration D3 in which the recess portion is disposed at a different position from the unit contact in the axial direction of the rotation axis.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-239950, filed Dec. 27, 2019, Japanese Patent Application No. 2019-239949, filed Dec. 27, 2019, Japanese Patent Application No. 2019-239951, filed Dec. 27, 2019, Japanese Patent Application No. 2019-239952, filed Dec. 27, 2019, which are hereby incorporated by reference herein in their entirety.

What is claimed is:

1. An image forming apparatus comprising:

an apparatus body comprising a control board;

a draw-out unit comprising:

a tray;

a photosensitive drum rotatably attached to the tray and configured to bear a toner image and rotate about a rotation axis;

a developing unit detachably attached to the tray and comprising a developing roller configured to bear toner and supply the toner to the photosensitive drum, the developing unit comprising a memory unit which includes a memory contact portion and a memory configured to store information;

a unit contact attached to the tray;

a tray contact configured to contact with the memory contact portion of the memory unit of the developing unit in a state where the developing unit is attached to the tray; and an electric wire wired in the tray so as to connect the tray contact to the unit contact electrically, wherein the draw-out unit is configured to be drawn out of the apparatus body in a drawing direction from a first position in which the developing unit is used for an image formation to a second position in which the developing unit is detachable from the tray; and a door supported by the apparatus body so as to be movable between a closed position where the door closes an opening portion of the apparatus body and an open position where the door opens the opening portion, the draw out developing unit being configured to pass through the opening portion while the draw-out unit is being drawn out of the apparatus body from the first position to the second position, the door positioned at the closed position being configured to face the draw-out unit, wherein the door comprises a door contact electrically connected to the control board and configured to electrically contact with the unit contact in a case where the door is positioned at the closed position, wherein the draw-out unit comprises a facing surface configured to face the door positioned at the closed position, and a grip portion provided at a center portion of the facing surface in a direction of the rotation axis, the grip portion comprising a side surface which is an end surface of the grip portion in the direction of the rotation axis, and a bottom surface faces downward, and wherein the unit contact is provided in a region outside the side surface of the grip portion in the direction of the rotation axis and below the bottom surface of the grip portion in a vertical direction.

2. The image forming apparatus according to claim 1, further comprising:

a stacking unit configured to open and close with respect to an outside surface of the door, wherein the outside surface of the door is opposite to an inside surface facing the draw-out unit when the door is positioned at the closed position, the stacking unit comprising a stacking surface on which a sheet is stacked in a case where the stacking unit is opened with respect to the outside surface of the door; and a holding arm configured to hold the stacking unit so that the stacking unit is opened with respect to the door, wherein the stacking unit comprises an engagement portion configured to engage with the holding arm and projecting from a surface of the stacking unit on which the stacking surface is provided, and wherein the unit contact is disposed between the side surface of the grip portion and the engagement portion in the direction of the rotation axis when viewed in the drawing direction.

3. The image forming apparatus according to claim 2, wherein the door comprises a projection portion projecting toward the apparatus body from the inside surface of the door in a case where the door is positioned at the closed position, the projection portion forming an accommodating space, on a side of the outside surface, configured to accommodate the engagement portion of the stacking unit in a case where the door is positioned at the closed position, and wherein the unit contact is disposed between the side surface of the grip portion and the projection portion in the direction of the rotation axis when viewed in the drawing direction.

4. The image forming apparatus according to claim 2, wherein the door comprises a rib disposed between the engagement portion and the side surface of the grip portion in the direction of the rotation axis and projecting toward the apparatus body in a case where the door is positioned at the closed position, and wherein the unit contact is disposed between the engagement portion and the rib in the direction of the rotation axis in a case where the door is positioned at the closed position.

5. The image forming apparatus according to claim 2, wherein a first end part, in a longitudinal direction of the holding arm, of the holding arm is slidably supported by the engagement portion of the stacking unit, and wherein a second end part, opposite to the first end part in the longitudinal direction, of the holding arm is supported by the apparatus body.

6. The image forming apparatus according to claim 5, wherein the engagement portion has an elongated hole portion configured to slidably engage with the first end part of the holding arm.

7. The image forming apparatus according to claim 1, wherein the door comprises a protrusion portion configured to project toward the apparatus body in a case where the door is positioned at the closed position, wherein the protrusion portion is configured not to interfere with the draw-out unit, and wherein the unit contact is disposed on the same side as the protrusion portion with respect to the grip portion in the direction of the rotation axis.

8. The image forming apparatus according to claim 1, further comprising a conductive member provided so as not to be electrically connected to an electric path from the door contact to the control board, wherein the door contact is configured to be exposed to an outside of the image forming apparatus without being in contact with the unit contact in a case where the door is positioned at the open position, and wherein the conductive member comprises a first end portion and a second end portion, the first end portion being disposed close to the door contact and exposed to the outside of the image forming apparatus in a case where the door is positioned at the open position, the second end portion being electrically connected to a grounding portion provided in the apparatus body.

9. The image forming apparatus according to claim 8, wherein the first end portion of the conductive member is positioned above a contact portion of the door contact in a case where the door is positioned at the open position.

10. The image forming apparatus according to claim 8, further comprising:

a first hinge and a second hinge that are configured to openably and closably support the door with respect to the apparatus body; and a bundle wire configured to interconnect the door contact and the control board, wherein the grounding portion comprises an urging portion configured to urge the door in a direction to close the door with respect to the apparatus body, wherein the first hinge and the second hinge are disposed at different positions in the direction of the rotation axis, and wherein both the urging portion and the bundle wire are disposed at the first hinge.

11. The image forming apparatus according to claim 10, wherein the conductive member is disposed above and along the bundle wire.

12. The image forming apparatus according to claim 10, wherein the urging portion comprises a tension spring.

13. The image forming apparatus according to claim 10, wherein the urging portion comprises a torsion coil spring.

14. An image forming apparatus comprising:

an apparatus body comprising a control board;

a draw-out unit comprising:

a tray;

a photosensitive drum rotatably attached to the tray and configured to bear a toner image and rotate about a rotation axis;

a developing unit detachably attached to the tray and comprising a developing roller configured to bear toner and supply the toner to the photosensitive drum, the developing unit comprising a memory unit which includes a memory contact portion and a memory configured to store information;

a unit contact attached to the tray;

a tray contact configured to contact with the memory contact portion of the memory unit of the developing unit in a state where the developing unit is attached to the tray; and an electric wire wired in the tray so as to connect the tray contact to the unit contact electrically, wherein the draw-out unit is configured to be drawn out of the apparatus body in a drawing direction from a first position in which the developing unit is used for an image formation to a second position in which the developing unit is detachable from the tray; and a door supported by the apparatus body so as to be movable between a closed position where the door closes an opening portion of the apparatus body and an open position where the door opens the opening portion, the developing unit being configured to pass through the opening portion while the draw-out unit is being drawn out of the apparatus body from the first position to the second position, the door positioned at the closed position being configured to face the draw-out unit, wherein the door comprises a door contact electrically connected to the control board and configured to electrically contact with the unit contact in a case where the door is positioned at the closed position.

* * * * *